US006159671A

United States Patent [19]

Matsuda

[11] Patent Number: 6,159,671

[45] Date of Patent: Dec. 12, 2000

[54] SILVER HALIDE COLOR PHOTOGRAPHIC LIGHTSENSITIVE MATERIAL

[75] Inventor: Naoto Matsuda, Minami-Ashigara, Japan

[73] Assignee: Fuji Photo Film Co., Ltd., Kanagawa, Japan

[21] Appl. No.: 09/172,030

[22] Filed: Oct. 14, 1998

[30] Foreign Application Priority Data

Oct. 14, 1997 [JP] Japan ..... 9-296286

[51] Int. Cl.[7] ..... G03C 1/46

[52] U.S. Cl. ..... 430/505; 430/544; 430/558; 430/506

[58] Field of Search ..... 430/505, 543, 430/544, 558, 586

[56] References Cited

U.S. PATENT DOCUMENTS

| | | | |
|---|---|---|---|
| 4,960,685 | 10/1990 | Bowne | 430/505 |
| 5,272,049 | 12/1993 | Sakanoue et al. . | |
| 5,340,706 | 8/1994 | Naruse et al. | 430/505 |
| 5,384,236 | 1/1995 | Matsuoka et al. | 430/558 |
| 5,688,964 | 11/1997 | Romanet et al. . | |
| 5,756,274 | 5/1998 | Matsuda et al. | 430/558 |

FOREIGN PATENT DOCUMENTS 11-119393 4/1999 Japan .

*Primary Examiner*—Geraldine Letscher
*Attorney, Agent, or Firm*—Birch, Stewart, Kolasch & Birch LLP

[57] ABSTRACT

A silver halide color photographic lightsensitive material comprises a support and, superimposed thereon, a yellow color-forming blue-sensitive emulsion layer, a magenta color-forming green-sensitive emulsion layer containing a magenta coupler represented by a general formula (MC-1):

(MC-1)

and a cyan color-forming red-sensitive emulsion layer containing a cyan coupler represented by a general formula (PC-1)or a general formula (NC-1):

(PC-1)

(NC-1)

8 Claims, No Drawings

SILVER HALIDE COLOR PHOTOGRAPHIC LIGHTSENSITIVE MATERIAL

BACKGROUND OF THE INVENTION

The present invention relates to a silver halide color photographic lightsensitive material. More particularly, the present invention relates to a silver halide color photographic lightsensitive material improved in color reproducibility.

It is important to improve the hue of the dye which forms images in the improvement of the color reproducibility of the silver halide color photographic lightsensitive material. In the field of, for example, the silver halide color reversal photographic lightsensitive material, a 5-pyrazolone magenta coupler is commonly employed as a magenta color-forming coupler and a 2,5-diamidophenol coupler as a cyan color-forming coupler. However, the hue of the image forming dye produced from these couplers has not been fully satisfactory because of intense secondary absorption or sub-absorption.

In this situation, the use of various pyrazoloazole couplers leading to excellent hue has been proposed as a magenta coupler. Further, the use of naphthol couplers having the property of undergoing an association to thereby realize shorter wave leading to desirable absorption and the use of pyrroloazole couplers capable of producing excellent hue have been proposed as a cyan coupler.

For attaining the further improvement of the color reproducibility, it has been proposed to employ an associable naphthol coupler in combination with pyrazolo-[5,1-c]-1,2,4-triazole magenta coupler having a phenylene group at its 3- or 6-position as disclosed in, for example, Jpn. Pat. Appln. KOKAI Publication No. (hereinafter referred to as JP-A-) 4-37747 and to employ a pyrroloazole coupler in combination with a pyrazoloazole magenta coupler as disclosed in JP-A-5-150418. Specifically, it is described to employ such a cyan coupler leading to excellent hue in combination with a two-equivalent pyrazoloazole magenta coupler. However, as a result of the inventors' testing of the use of the pyrroloazole and associable cyan coupler in combination with two-equivalent pyrazoloazole magenta coupler, it has been found that the combined use involves difficulty because of the problems such that color mixing between a green-sensitive layer and a red-sensitive layer is aggravated to thereby deteriorate the color reproducibility and such that, when the image is stored in a highly humid atmosphere, magenta stain occurs.

BRIEF SUMMARY OF THE INVENTION

An object of the present invention is to provide a silver halide color photosensitive lightsensitive material which is excellent in color reproducibility and image preservability. Especially, it is intended to apply the present invention to a color reversal photographic lightsensitive material that is sequentially subjected to black-and-white development, reversal processing and color development.

DETAILED DESCRIPTION OF THE INVENTION

The object of the present invention has been attained by a following silver halide color photographic light-sensitive material:

(1) a silver halide color photographic lightsensitive material comprising a support and, superimposed thereon, a yellow color-forming blue-sensitive emulsion layer comprising at least one lightsensitive emulsion sub-layer, a magenta color-forming green-sensitive emulsion layer comprising at least one lightsensitive emulsion sub-layer and a cyan color-forming red-sensitive emulsion layer comprising at least one lightsensitive emulsion sub-layer, wherein said at least one sub-layer in said green-sensitive emulsion layer contains at least one magenta coupler represented b a general formula (MC-1):

(MC-1)

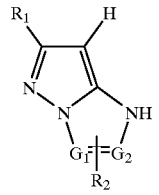

wherein $R_1$ represents a hydrogen atom or a substituent; and each of $G_1$ and $G_2$ represents a nitrogen atom or a carbon atom, provided that $G_2$ is a carbon atom when $G_1$ is a nitrogen atom, $G_1$ is a carbon atom when $G_2$,is a nitrogen atom; and $R_2$ binds to $G_1$ or $G_2$ that is a carbon atom, wherein $R_2$ represents a substituent;

and said at least one sub-layer in said red-sensitive emulsion layer contains at least one cyan coupler ed by a general formula (PC-1):

(PC-1)

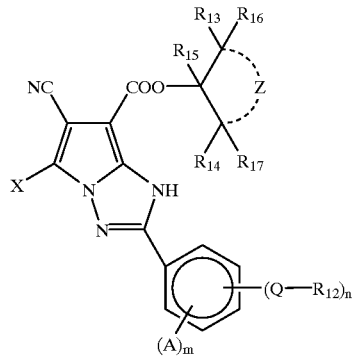

wherein X represents a hydrogen atom or a group capable of dissociating by a coupling reaction with an aromatic primary amine color developing agent; A represents a substituent; m is an integer of 0 to 4; Q represents a divalent group selected from —O—, —COO—, —$SO_2$—, —OC(O)—, —$NR_{18}$CO—, —CO$NR_{18}$—, —$NR_{18}SO_2$—, —$SO_2NR_{18}$—, —$NR_{18}$COO— and —$NR_{18}CONR_{19}$—, wherein each of $R_{18}$ and $R_{19}$ independently represents a hydrogen atom or an alkyl group; $R_{12}$ represents a substituent having a moiety of an aryl group or alkyl group each having at least 6 total carbon atoms; n is 1 or 2, provided that, when n is 1, $R_{12}$ has at least one dissociating group and that, when n is 2, two —Q—$R_{12}$ groups may be the same or different from each other and may contain a dissociating group; each of $R_{13}$ and $R_{14}$ independently represents an alkyl group; each of $R_{15}$, $R_{16}$ and $R_{17}$ independently represents a hydrogen atom or an alkyl group; and Z represents a group of nonmetallic atoms forming a 5 to 8-membered carbocyclic or heterocyclic ring, with which a saturated or unsaturated carbocyclic or heterocyclic ring may be condensed; and (2) a silver halide color photographic lightsensitive material comprising a support and, superimposed thereon, a yellow color-forming blue-sensitive emulsion layer comprising at least one lightsensitive emulsion sub-layer, a magenta color-forming green-sensitive emulsion layer comprising at least one lightsensitive emulsion sub-layer and a cyan color-forming red-sensitive emulsion layer comprising at least one lightsensitive emulsion sub-layer, wherein said at least one sub-layer in said green-sensitive emulsion layer contains at least one magenta coupler represented by the general formula (MC-1) set forth in item (1) above, and said at least one sub-layer in said red-sensitive emulsion layer contains at least one cyan coupler represented by a general formula (NC-1):

(NC-1)

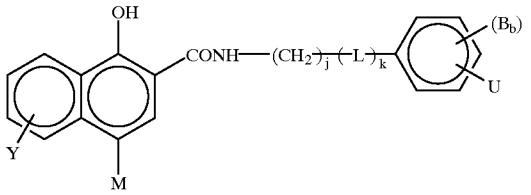

wherein M has the same meaning as X of the above general formula (PC-1); Y represents a hydrogen atom or a substituent, provided that, when Y is a substituent, Y binds to any one of 5 to 8-positions of the naphthol ring; L represents a divalent group; U represents a substituent containing at least one —NH— therein; j is an integer of 1 to 3; k is 0 or 1; B represents a substituent; and b is an integer of 0 to 4.

The present invention will be described in detail Ad below.

First, the general formula (MC-1) will be described.

In the general formula (MC-1), $R_1$ represents a hydrogen atom or a substituent. The substituent is, for example, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an acyloxy group, a carbamoyloxy group, a silyloxy group, an aryloxycarbonylamino group, an imido group, a heterocyclic thio group, a sulfinyl group, a phosphonyl group, an aryloxycarbonyl group or an acyl group.

In the following description, the term "total carbon atoms" of each substituent means the number of all carbon atoms possessed by the substituent which, when the substituent is substituted with a group, include carbon atoms of the substitution group.

More specifically, $R_1$, when being a substituent, represents a halogen atom (e.g., a chlorine atom or a bromine atom), an alkyl group (e.g., a linear or branched alkyl group, aralkyl group, alkenyl group, alkynyl group, cycloalkyl group or cycloalkenyl group, each having 1 to 32 total carbon atoms, such as methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecanamido}phenyl}propyl, 2-ethoxytridecyl, trifluoromethyl, cyclopentyl or 3-(2,4-di-t-amylphenoxy)propyl), an aryl group (e.g., phenyl, 4-t-butylphenyl, 2,4-di-t-amylphenyl or 4-tetradecanamidophenyl), a heterocyclic group (e.g., 2-furyl, 2-thienyl, 2-pyrimidinyl or 2-benzothiazolyl), a cyano group, a hydroxyl group, a nitro group, a carboxyl group, an amino group, an alkoxy group (e.g., methoxy, ethoxy, 2-methoxyethoxy, 2-dodecylethoxy or 2-methanesulfonylethoxy), an aryloxy group (e.g., phenoxy, 2-methylphenoxy, 4-t-butylphenoxy, 3-nitrophenoxy, 3-t-butyloxycarbamoylphenoxy or 3-methoxycarbamoylphenoxy), an acylamino group (e.g., acetamido, benzamido, tetradecanamido, 2-(2,4-di-t-amylphenoxy)butanamido, 4-(3-t-butyl-4-hydroxyphenoxy)butanamido or 2-{4-(4-hydroxyphenylsulfonyl)phenoxy}decanamido), an alkylamino group (e.g., methylamino, butylamino, dodecylamino, diethylamino or methylbutylamino), an anilino group (e.g., phenylamino, 2-chloroanilino, 2-chloro-5-tetradecanaminoanilino, 2-chloro-5-dodecyloxycarbonylanilino, N-acetylanilino or 2-chloro-5-(α-(3-t-butyl-4-hydroxyphenoxy)dodecanamido)-anilino), a ureido group (e.g., phenylureido, methylureido or N,N-dibutylureido), a sulfamoylamino group (e.g., N,N-dipropylsulfamoylamino or N-methyl-N-decylsulfamoylamino), an alkylthio group (e.g., methylthio, octylthio, tetradecylthio, 2-phenoxyethylthio, 3-phenoxypropylthio or 3-(4-t-butylphenoxy)propylthio), an arylthio group (e.g., phenylthio, 2-butoxy-5-t-octylphenylthio, 3-pentadecylphenylthio, 2-carboxyphenylthio or 4-tetradecanamidophenylthio), an alkoxycarbonylamino group (e.g., methoxycarbonylamino or tetradecyloxycarbonylamino), a sulfonamido group (e.g., methanesulfonamido, hexadecanesulfonamido, benzenesulfonamido, p-toluenesulfonamido, octadecanesulfonamido or 2-methyloxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl or N-{3-(2,4-di-t-amylphenoxy)propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl or N,N-diethylsulfamoyl), a sulfonyl group (e.g., methanesulfonyl, octanesulfonyl, benzenesulfonyl or toluenesulfonyl), an alkoxycarbonyl group (e.g., methoxycarbonyl, buytloxycarbonyl, dodecyloxycarbonyl or octadecyloxycarbonyl), a heterocyclic oxy group (e.g., 1-phenyltetrazol-5-oxy or 2-tetrahydropyranyloxy), an acyloxy group (e.g. acetoxy), a carbamoyloxy group (e.g., N-methylcarbamoyloxy or N-phenylcarbamoyloxy), a silyloxy group (e.g., trimethylsilyloxy or dibutylmethylsilyloxy), an aryloxycarbonylamino group (e.g., phenoxycarbonylamino), an imido group (e.g., N-succinimido, N-phthalimido or 3-octadecenylsuccinimido), a heterocyclic thio group (e.g., 2-benzothiazolylthio, 2,4-di-phenoxy-1,3,5-triazole-6-thio or 2-pyridylthio), a sulfinyl group (e.g., dodecanesulfinyl, 3-pentadecylphenylsulfinyl or 3-phenoxypropylsulfinyl), a phosphonyl group (e.g., phenoxyphosphonyl, octyloxyphosphonyl or phenylphosphonyl), an aryloxycarbonyl group (e.g., phenoxycarbonyl) or an acyl group (e.g., acetyl, 3-phenylpropanoyl, benzoyl or 4-dodecyloxybenzoyl).

Of these substituents, an alkyl group, an aryl group, an alkoxy group, an aryloxy group, an amino group, an acylamino group, a ureido group, a carbamoyl group, an alkoxycarbonylamino group, a sulfonyl group, a sulfonamido group, a sulfamoyl group, a sulfamoylamino group, a hydroxyl group, a carboxyl group, an alkoxycarbonyl group and an acyloxy group are preferred. An alkyl group, an aryl group, an alkoxy group and an aryloxy group are more preferred.

Either one of $G_1$ and $G_2$ is a nitrogen atom, and the other is a carbon atom. The carbon atom has a substituent represented by $R_2$ shown in the general formula (MC-1).

$R_2$ represents a substituent whose examples, preferred examples and more preferred examples are the same as those mentioned with respect to $R_1$.

Of the compounds represented by the general formula (MC-1), preferred one is, for example, represented by the general formula (MC-2):

(MC-2)

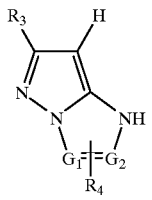

wherein $G_1$ and $G_2$ each has the same meaning as defined in formula (MC-1), at least either of $R_3$ and $R_4$ represents a substituted or unsubstituted tertiary alkyl group, provided that the sum of the total carbon atoms contained in $R_3$ and the total carbon atoms contained in $R_4$ is 10 or more. When only either of $R_3$ and $R_4$ represents a substituted or unsubstituted tertiary alkyl group, the other has the same meaning as $R_1$.

With respect to the problems of color mixing and magenta stain during image storage to be solved by the present invention, improvement has been attained by the use of the compound of the general formula (MC-1). However, the yellow coloring on white background which occurs when images are irradiated with light has not been satisfactory. The use of the compound of the general formula (MC-2) has been preferable because it attains improvement in the problem of yellow coloring on white background as well.

In the general formula (MC-2), at least either of $R_3$ and $R_4$ represents a substituted or unsubstituted tertiary alkyl group. The tertiary alkyl group is, for example, t-butyl, t-amyl, t-hexyl, t-octyl, 1,1-dimethyldecyl, adamantyl or 1-methylcyclohexyl.

Of the compounds represented by the general formula (MC-2), preferred one is provided when only either of $R_3$ and $R_4$ represents a substituted or unsubstituted tertiary alkyl group while the other is represented by the general formula (BL-1):

(BL-1)

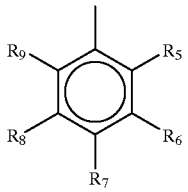

or the general formula (BL-2):

(BL-2)

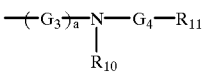

In the general formula (BL-1), each of $R_5$, $R_6$, $R_7$, $R_8$ and $R_9$ independently represents a hydrogen atom or a substituent, provided that at least two of $R_5$, $R_6$, $R_8$ and $R_9$ each independently represent a substituent having a moiety of a substituted or unsubstituted alkyl group each having 4 to 70 total carbon atoms or a substituent having a moiety of a substituted or unsubstituted aryl group each having 6 to 70 total carbon atoms.

The groups represented by the general formula (BL-1) will be described below. Each of $R_5$, $R_6$, $R_7$, $R_8$ and $R_9$ independently represents a hydrogen atom or a substituent. When each of $R_5$, $R_6$, $R_7$, $R_8$ and Rg represents the substituent, the substituent is, for example, as mentioned with respect to $R_1$. Although at least two of $R_5$, $R_6$, $R_8$ and $R_9$ each independently represent a substituent having a moiety of a substituted or unsubstituted alkyl group each having 4 to 70 total carbon atoms or a substituent having a moiety of a substituted or unsubstituted aryl group each having 6 to 70 total carbon atoms, it is preferred that they each independently represent a substituted acylamino group, ureido group, carbamoyl group, alkoxycarbonylamino group, sulfonyl group, sulfonamido group, sulfamoyl group, sulfamoylamino group or alkoxycarbonyl group, each having a moiety of a substituted or unsubstituted alkyl group each having 4 to 70 total carbon atoms or having a moiety of a substituted or unsubstituted aryl group having 6 to 70 total carbon atoms.

It is especially preferred that each of the two groups $R_6$ and $R_8$ represents a substituent having a moiety of a substituted or unsubstituted alkyl group each having 4 to 70 total carbon atoms (more preferably, 8 to 40 total carbon atoms) or having a moiety of a substituted or unsubstituted aryl group each having 6 to 70 total carbon atoms (more preferably, 6 to 40 total carbon atoms). When the alkyl group having 4 to 70 total carbon atoms or the aryl group having 6 to 70 total carbon atoms has a substituent, this substituent is, for example, one of those mentioned with respect to $R_1$.

In the general formula (BL-2), $G_3$ represents a substituted or unsubstituted methylene group; a is an integer of 1 to 3; $R_{10}$ represents a hydrogen atom, an alkyl group or an aryl group; $G_4$ represents —CO— or —$SO_2$-; and $R_{11}$ represents a substituent having a moiety of a substituted or unsubstituted alkyl or aryl group each having 6 to 100 total carbon atoms. When $R_{11}$ has a substituent, the substituent is, for example, one of those mentioned with respect to $R_1$.

Among the compounds represented by the general formula (MC-2), when $G_1$ and $G_2$ are a nitrogen atom and a carbon atom, respectively, it is preferred that $R_3$ represents a tertiary alkyl group, $R_4$ represents a group represented by the general formula (BL-1) and each of $R_6$ and $R_8$ represents a group selected from an acylamino group, sulfonamido group, ureido group, alkoxycarbonylamino group, sulfonyl group, carbamoyl group, sulfamoyl group, sulfamoylamino group and alkoxycarbonyl group, each substituted with a substituted or unsubstituted alkyl group each having 4 to 70 total carbon atoms or a substituted or unsubstituted aryl group each having 6 to 70 total carbon atoms.

With respect to the compounds represented by the general formula (MC-2), when $G_1$ and $G_2$ are a carbon atom and a nitrogen atom, respectively, it is preferred that $R_3$ represent a tertiary alkyl group and $R_4$ represents a group represented by the general formula (BL-1) or general formula (BL-2). It is especially preferred that $R_4$ be a group represented by the general formula (BL-2).

Specific examples of the compounds of the general formula (MC-1) will be given below, which in no way limit the scope of the present invention:

CA-1
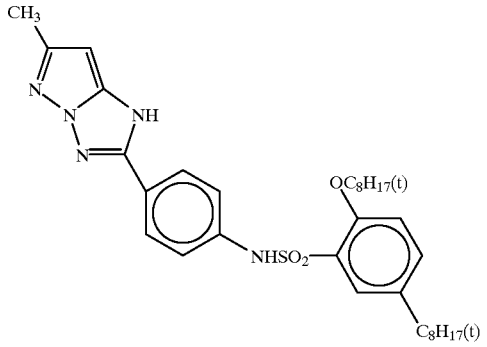
CA-2
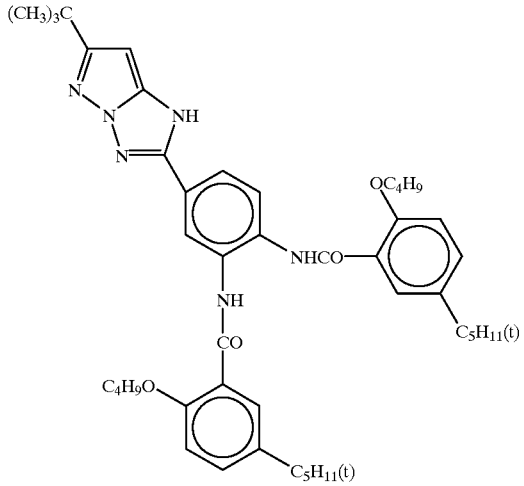
CA-3
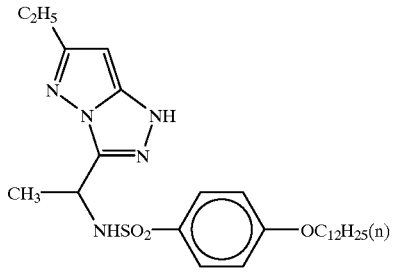
CA-4
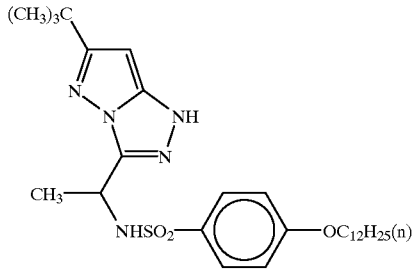
CA-5
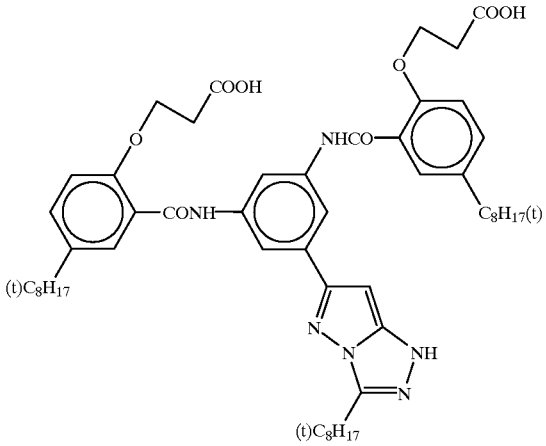
CA-6
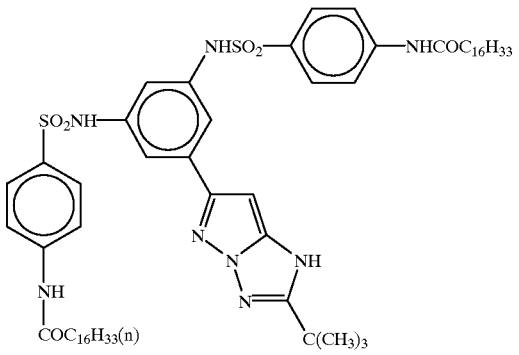
CA-7
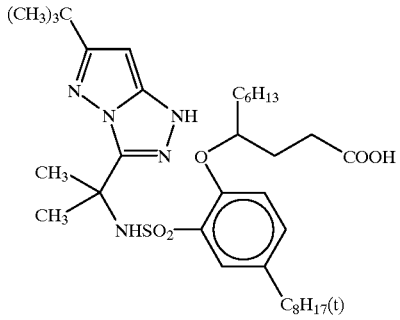
CA-8
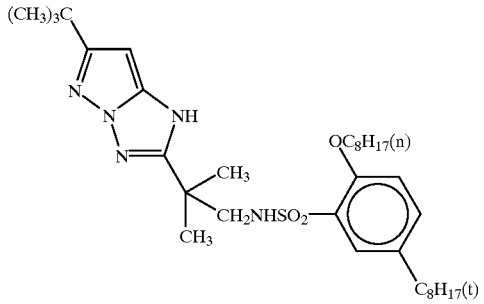

-continued
CA-9
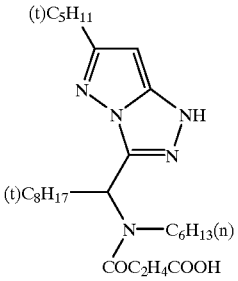
CA-10
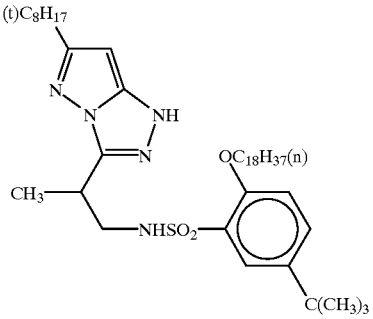
CA-11
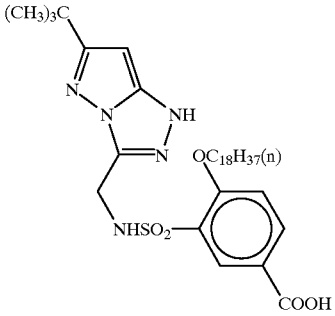
CA-12
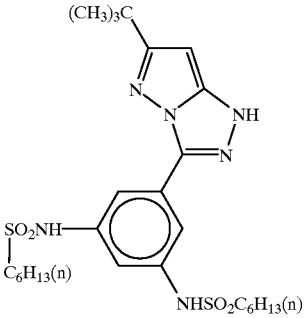
CA-13
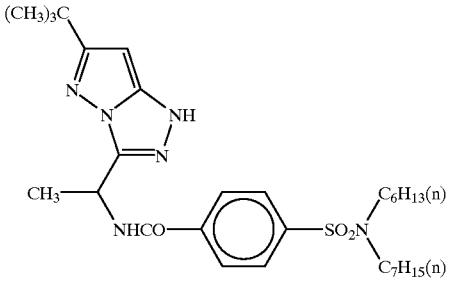
CA-14
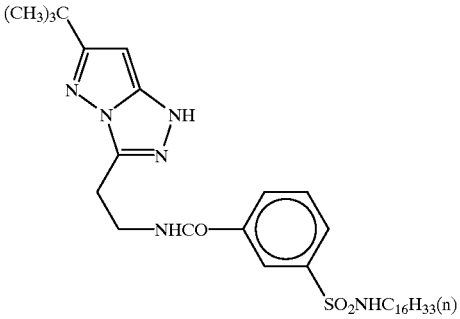
CA-15
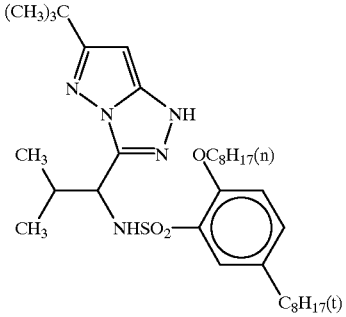
CA-16
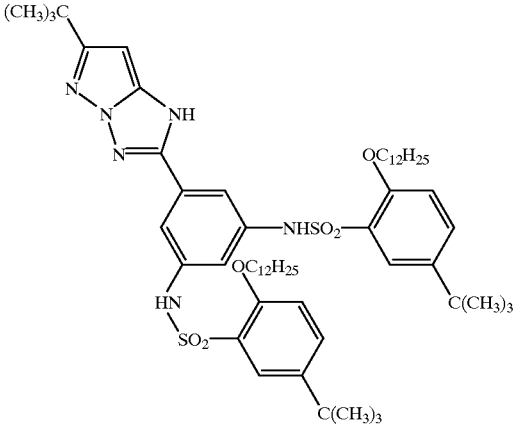

-continued
CA-17
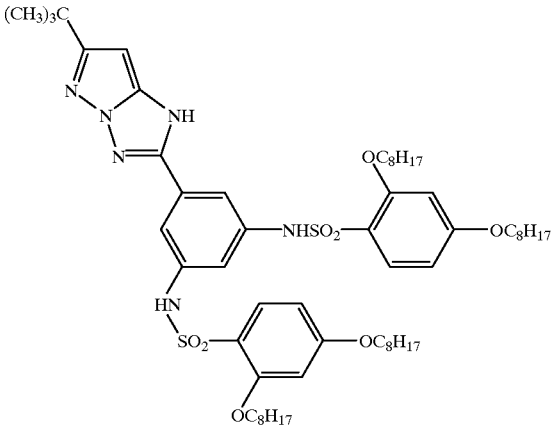
CA-18
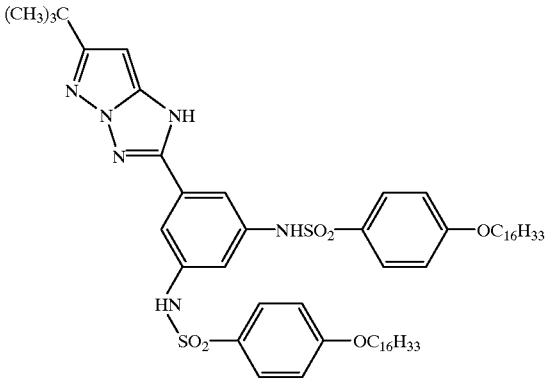
CA-19
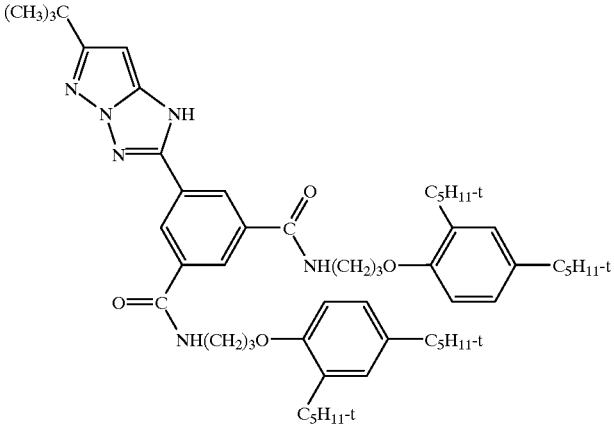
CA-20
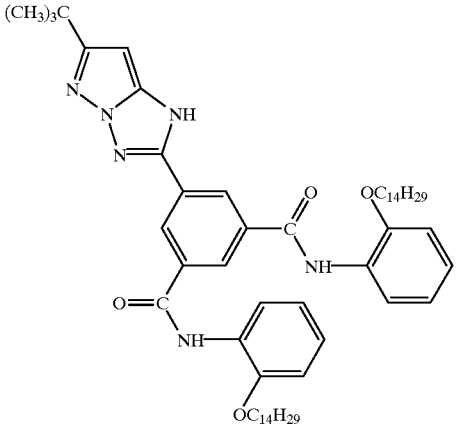
CA-21
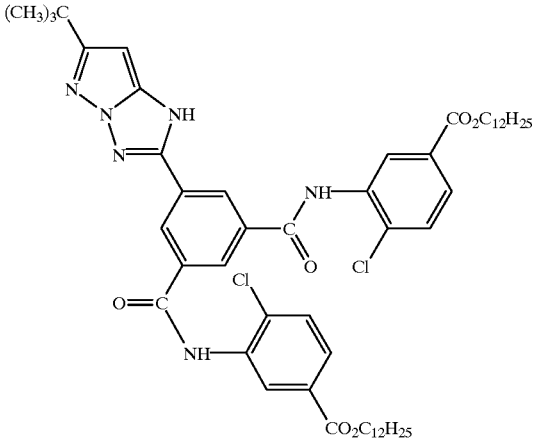

-continued
CA-22
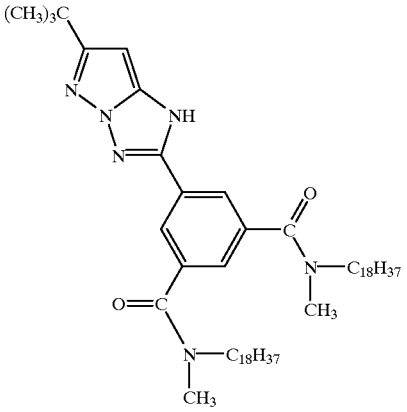
CA-23
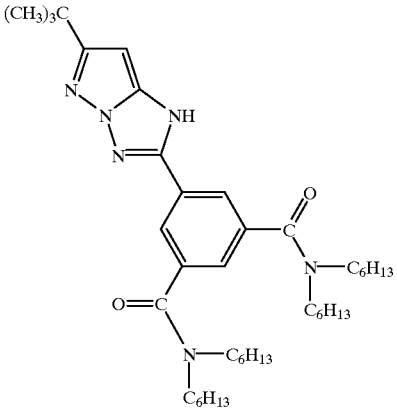
CA-24
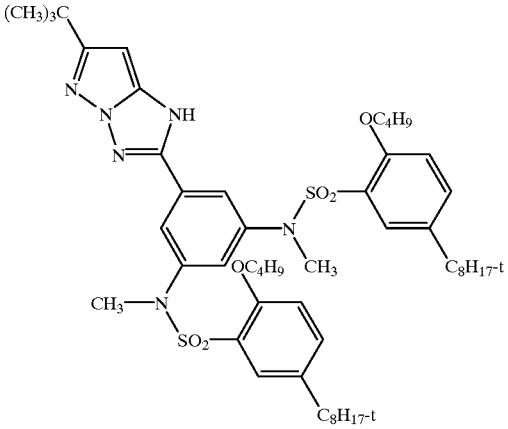
CA-25
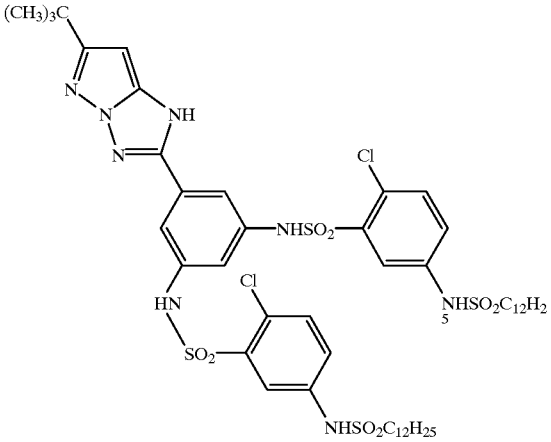
CA-26
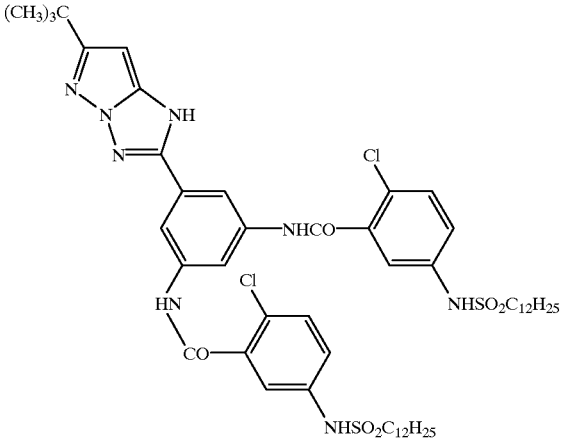

-continued
CA-27
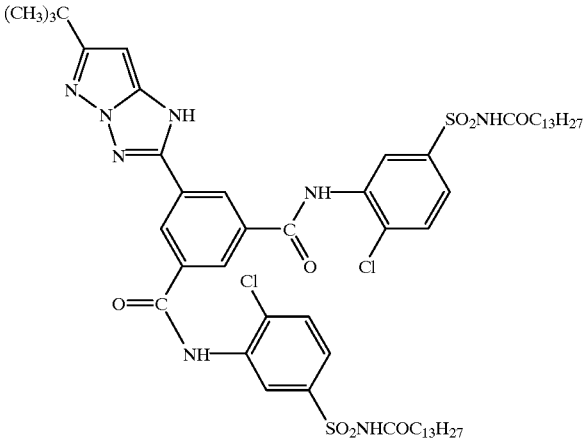
CA-28
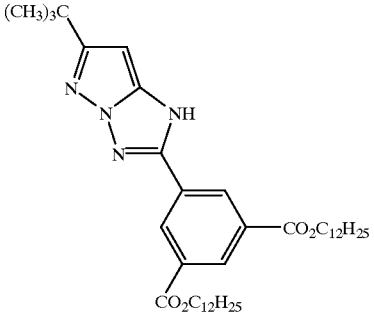
CA-29
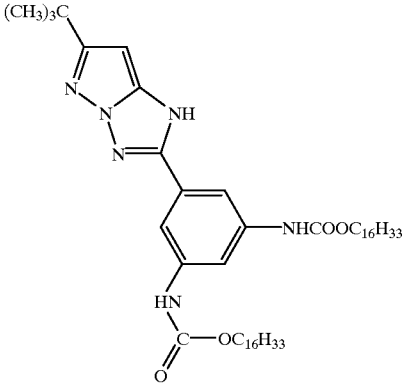
CA-30
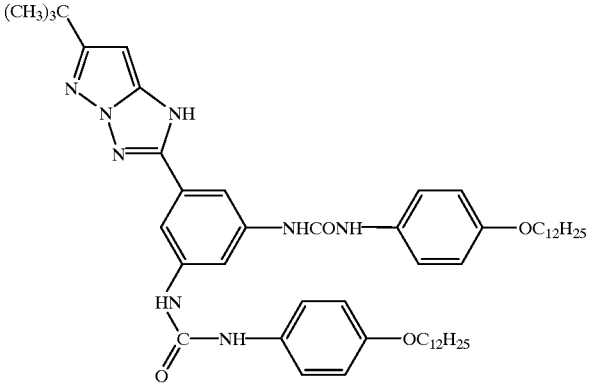

-continued
CA-31
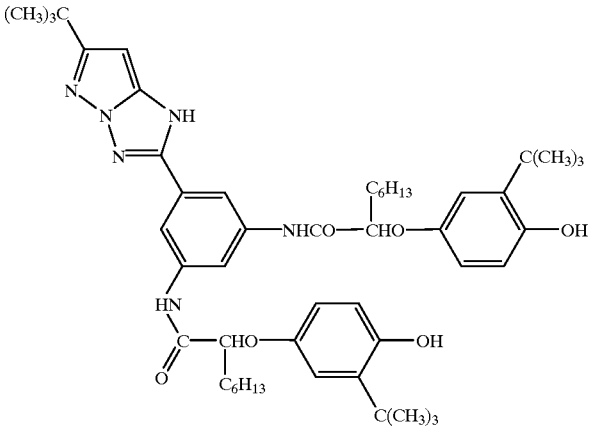
CA-32
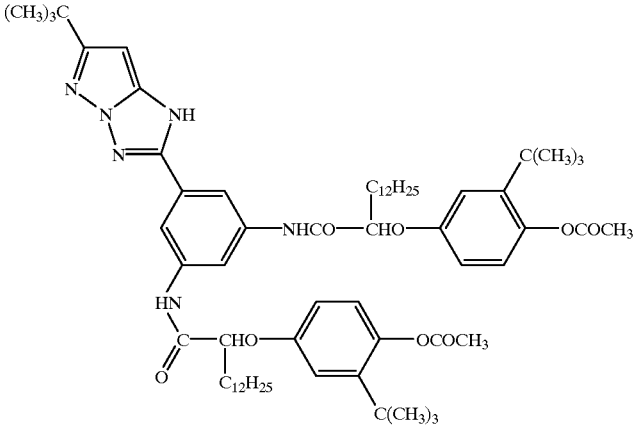
CA-33
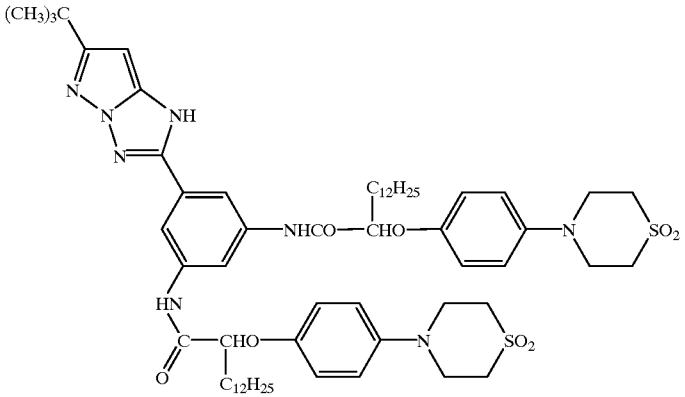

-continued
CA-34
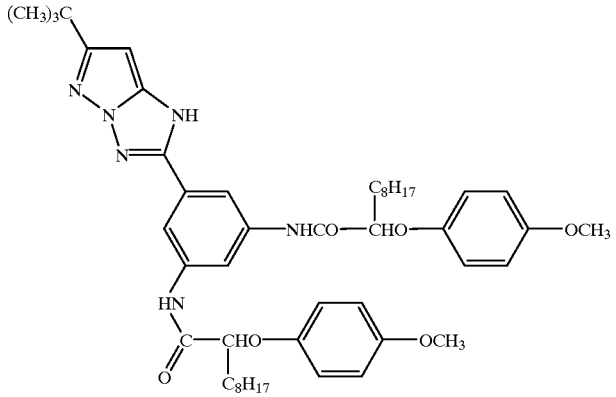
CA-35
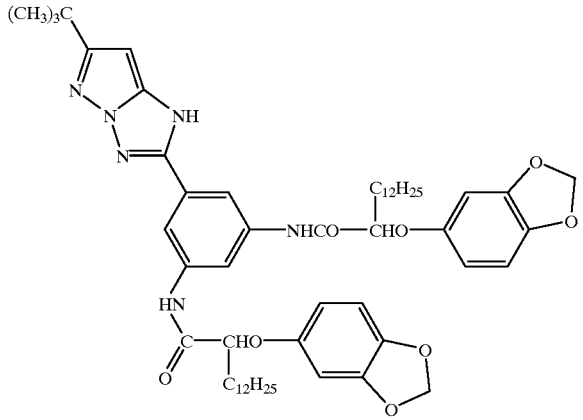
CA-36
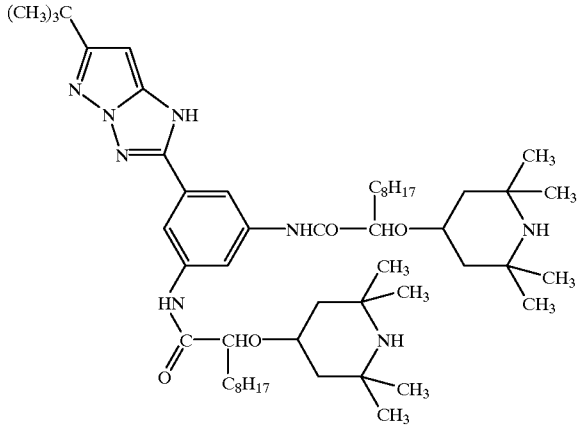

-continued
CA-37
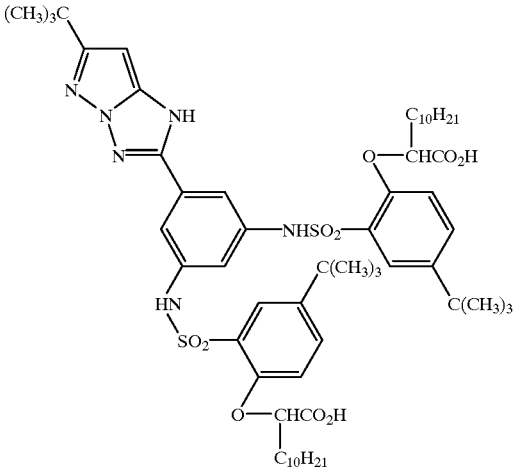
CA-38
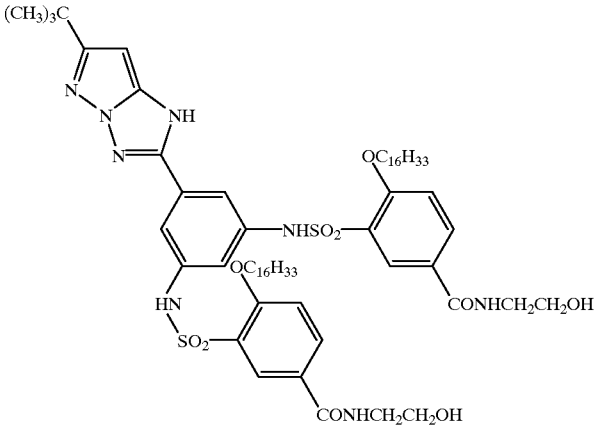
CA-39
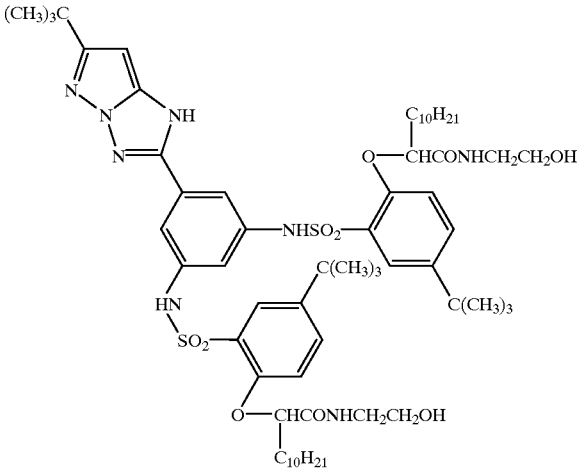

-continued
CA-40
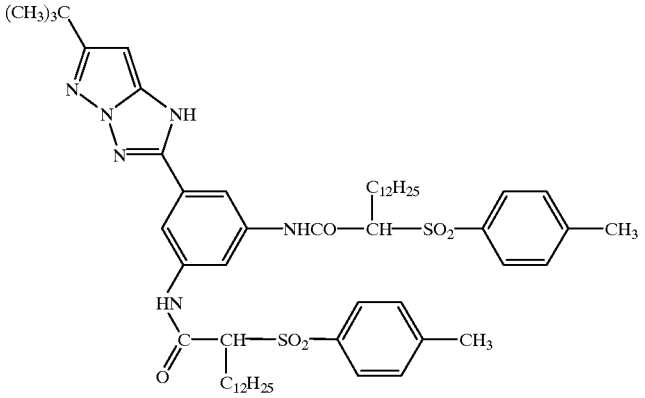
CA-41
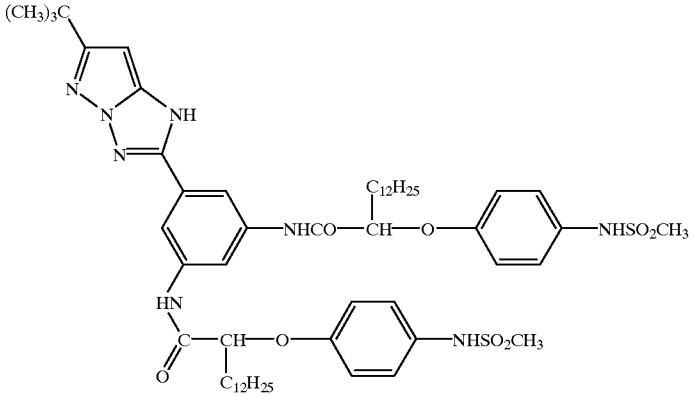
CA-42
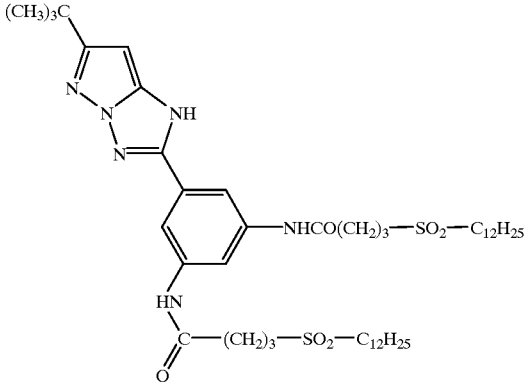
CA-43
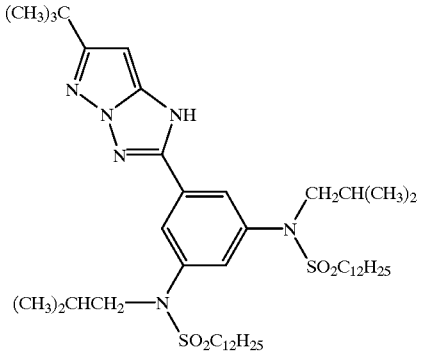
CA-44
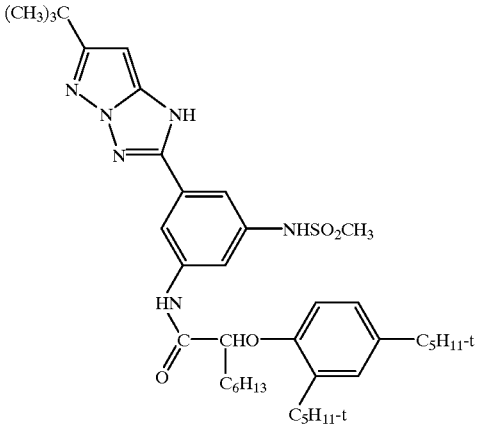

-continued
CA-45
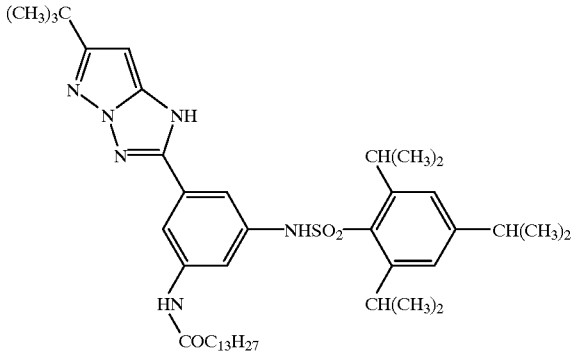
CA-46
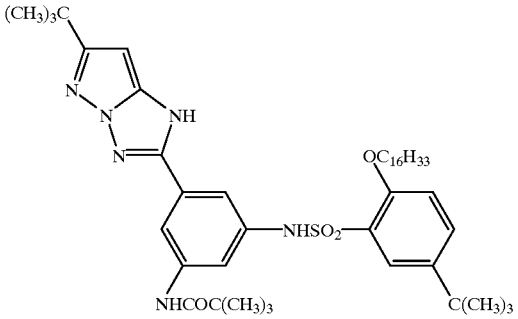
CA-47
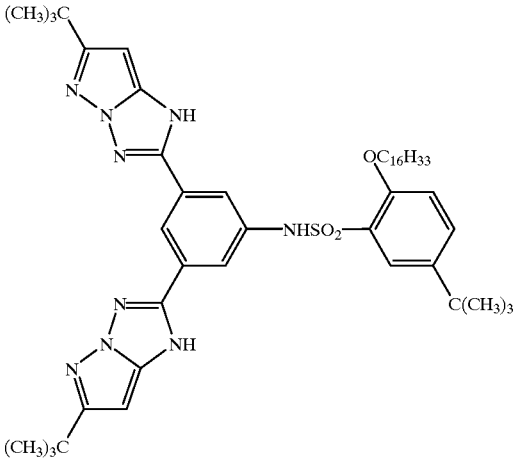
CA-48
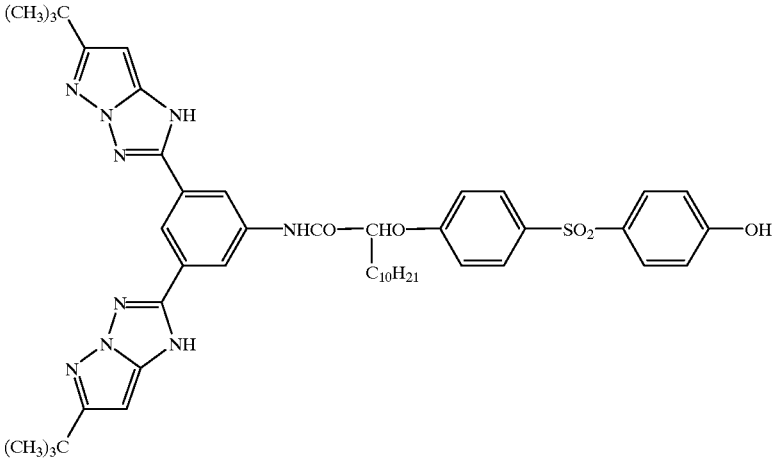

-continued
CA-49
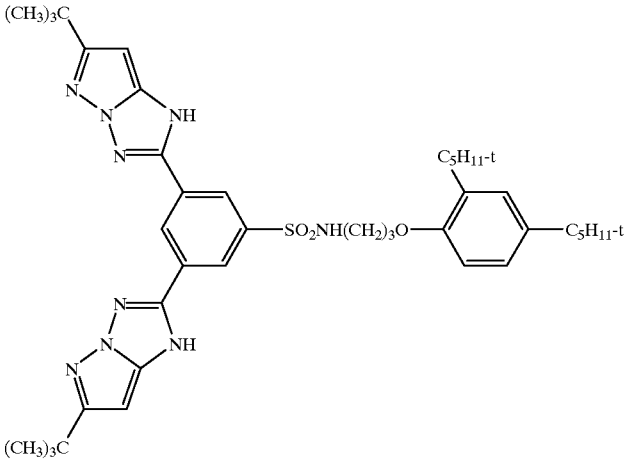
CA-50
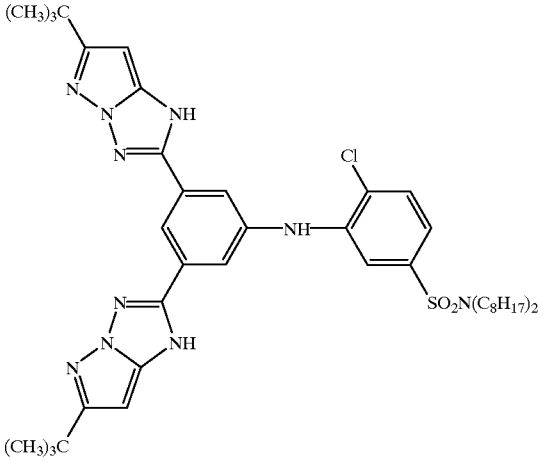
CA-51
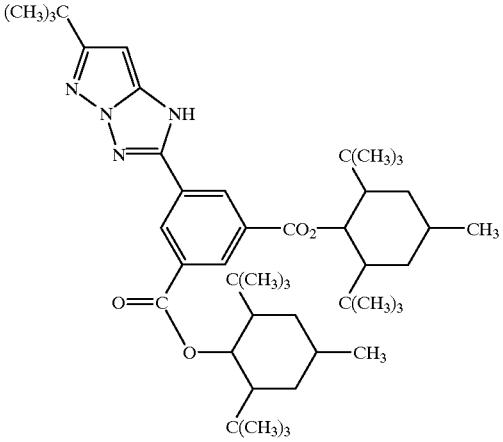
CA-52
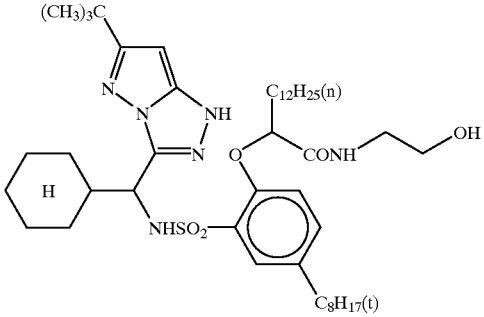
CA-53
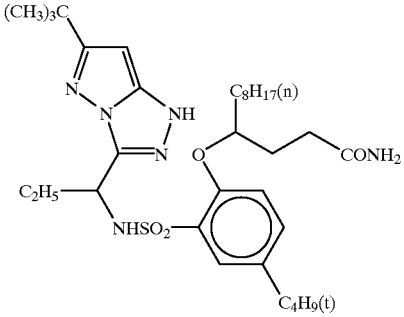
CA-54
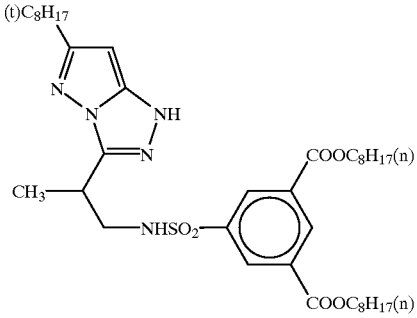
CA-55
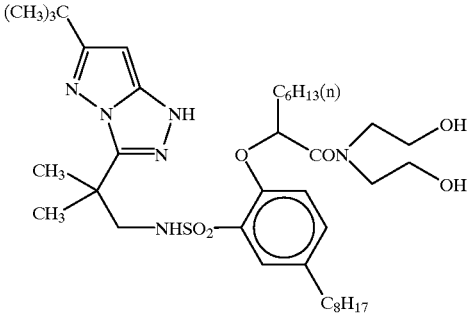

-continued

CA-56

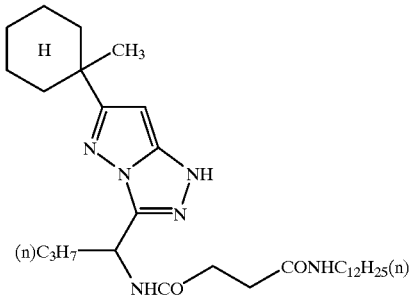

CA-57

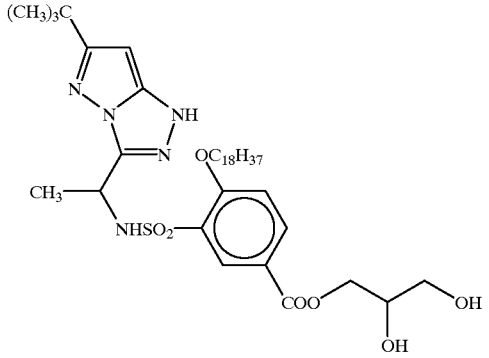

The couplers of the general formula (MC-1) of the present invention can be synthesized by publicly known methods, for example, those described in U.S. Pat. No. 4,540,654, U.S. Pat. No. 4,705,863, U.S. Pat. No. 5,451,501, JP-A-61-65245, JP-A-62-209457, JP-A-62-249155, JP-A-63-41851, Jpn. Pat. Appln. KOKOKU Publication No. (hereinafter referred to as JP-B-) 7-122744, JP-B-5-105682, JP-B-7-13309, JP-B-7-82252, U.S. Pat. No. 3,725,067, U.S. Pat. No. 4,777,121, JP-A-2-201442, JP-A-2-101077, JP-A-3-125143 and JP-A-4-242249, the disclosures of which are herein incorporated by reference.

The general formula (PC-1) will be described.

A represents a substituent, which is, for example, one of those mentioned with respect to $R_1$ of the general formula (MC-1). Substituents preferred as A include a halogen atom, an alkyl group, an aryl group, an alkoxy group, an aryloxy group, an amino group, an acylamino group, a ureido group, a carbamoyl group, an alkoxycarbonylamino group, a sulfonyl group, a sulfonamido group, a sulfamoyl group, a sulfamoylamino group, a hydroxyl group, a carboxyl group, an alkoxycarbonyl group, an acyloxy group, a cyano group and a sulfonyl group. m is an integer of 0 to 4.

X represents a hydrogen atom or a group capable of dissociating by coupling with an aromatic primary amine color developing agent (hereinafter simply referred to as "dissociating group"). When X represents a dissociating group, it is, for example, a halogen atom (e.g., fluorine atom, chlorine atom or bromine atom), an alkoxy group (e.g., methoxy, ethoxy or methoxyethoxy), an aryloxy group (e.g., phenoxy, 4-chlorophenoxy, 4-carboxyphenoxy or naphthyloxy), a heterocyclic oxy group (e.g., 5-phenyltetrazolyloxy or 2-benzothiazolyloxy), an acyloxy group (e.g., acetoxy, tetradecanoyloxy or benzoyloxy), an alkyl-, aryl- or heterocyclic-sulfonyloxy group (e.g., methanesulfonyloxy or benzenesulfonyloxy), a dialkyl- or diaryl-phosphonoxy group (e.g., dimethylphosphonoxy or diphenylphosphonoxy), a dialkyl- or diaryl-phosphinoxy group (e.g., dimethylphosphinoxy), an alkyl-, aryl- or heterocyclic-sulfonyl group (e.g., ti methanesulfonyl, toluenesulfonyl or tetrazolylsulfonyl), an alkyl-, aryl- or heterocyclic-sulfinyl group (e.g., phenylsulfinyl, ethylsulfinyl or tetrazolylsulfinyl), an acylamino group (e.g., dichloroacetylamino or heptafluorobutylamino), an alkyl-, aryl- or heterocyclic-sulfonamido group (e.g., methanesulfonamido, trifluoromethanesulfonamido or benzenesulfonamido), an alkoxycarbonyloxy group (e.g., methoxycarbonyloxy or ethoxycarbonyloxy), an aryloxycarbonyloxy group (e.g., phenoxycarbonyloxy), a carbamoyloxy group (e.g., diethylcarbamoyloxy or morpholinocarbonyloxy), an alkyl-, aryl- or heterocyclic-thio group (e.g., ethylthio, phenylthio or tetrazolylthio), a carbamoylamino group (e.g., N-methylcarbamoylamino or N-phenylcarbamoylamino), a 5- or 6-membered nitrogen containing heterocyclic group that bonds to the coupling site via its nitrogen atom (e.g., imidazolyl, pyrazolyl, triazolyl or tetrazolyl), an imido group (e.g., succinimido or phthalimido) or an arylazo group (e.g., phenylazo).

X is preferably selected from a hydrogen atom, a chlorine atom, an alkoxy group, an aryloxy group, a heterocyclic oxy group, an acyloxy group, an alkoxycarbonyloxy group, an aryloxycarbonyloxy group and a carbamoyloxy group and is more preferably selected from a hydrogen atom, an acyloxy group, an alkoxycarbonyloxy group and a carbamoyloxy group.

$R_{12}$ represents a substituent having a moiety of a substituted or unsubstituted alkyl or aryl group each having 6 to 60 total carbon atoms. When $R_{12}$ is substituted, the substituent can be one of those mentioned with respect to $R_1$. n is 1 or 2. When n is 1, $R_{12}$ contains at least one dissociating group. m is an integer of 0 to 4. The term "dissociating group" used herein means a group having a dissociable proton, which exhibits a pKa value of 13 or less. The pKa value can be measured by the method described in Albart, A. and Serjeant, E. P., "The Determination of Ionization Constants", 2nd edn., chap. 2, pp. 14–38, Chapman and Hall, London (a 1:1 solution of tetrahydrofuran and water is used as the solvent, and a 0.2 N aqueous solution of sodium hydroxide is used as the titrant). The dissociating group is, for example, —COOH, —OH, —$SO_kH$ (k=0 to 3), —$SO_2NH_2$, —$SO_2NHR'$, —$SO_2NHCOR'$, —$SO_2NHCOOR'$, —$SO_2NHCONR'R''$, —CONHCOR', —CONHCOOR', —$CONHSO_2NR'R''$, —CON(R")OH, —$SO_2NHSO_2R'$, —$NHC_nF_{2n+1}$ or —$CONHC_nF_{2n+1}$. In the formulae, n is a natural number. R' represents an alkyl group, an aryl group or a heterocyclic group. R" represents a hydrogen atom, an alkyl group, an aryl group or a heterocyclic group.

Q represents a divalent group selected from —O—, —COO—, —$SO_2$—, —OC(O)—, —$NR_{18}CO$—, —$CONR_{18}$—, —$NR_{18}SO_2$—, —$SO_2NR_{18}$—, —$NR_{18}COO$— and —$NR_{18}CONR_{18}$—. Each of $R_{18}$ and $R_{19}$ independently represents a hydrogen atom or an alkyl group. Q is preferably selected from —$NR_{18}CO$—, —$CONR_{18}$—, —$NR_{18}SO_2$— and —$SO_2NR_{18}$—.

Each of $R_{13}$ and $R_{14}$ independently represents an alkyl group having 1 to 36 total carbon atoms, for example, a cycloalkyl group or a linear or branched alkyl group each having 1 to 36 total carbon atoms, in particular, such as methyl, ethyl, propyl, isopropyl, t-butyl, t-amyl, t-octyl, tridecyl, cyclopentyl or cyclohexyl. Each of $R_{13}$ and $R_{14}$ preferably represents a branched or cyclic alkyl group each having 3 to 30 total carbon atoms, more preferably, a tertiary alkyl group having 4 to 16 total carbon atoms and, most preferably, t-butyl, t-amyl, t-octyl, 1-methylcyclohexyl or 1-methyl-1-cyclohexylethyl.

Each of $R_{15}$, $R_{16}$ and $R_{17}$ independently represents a hydrogen atom or an alkyl group. The alkyl group can be one of those mentioned with respect to $R_{13}$ and $R_{14}$. $R_{15}$, $R_{16}$ and $R_{17}$ each preferably represents a hydrogen atom.

Z represents a group of nonmetallic atoms required to form a 5 to 8-membered carbocyclic or heterocyclic ring together with the three carbon atoms to which $R_{13}$, $R_{15}$ and $R_{14}$ are attached, respectively. This ring may be substituted, may be a saturated ring and may have an unsaturated bond, may be condensed with a saturated or unsaturated carbocyclic or heterocyclic ring. The nonmetallic atom is preferably a nitrogen atom, an oxygen atom, a sulfur atom or a carbon atom and, more preferably, a carbon atom.

The ring formed by Z is, for example, a cyclopentane ring, a cyclohexane ring, a cycloheptane ring, a cyclooctane ring, a cyclohexene ring, a piperazine ring, an oxane ring or a thiane ring. These rings may have a substituent as mentioned with respect to A. The ring formed by Z is preferably a substituted or unsubstituted cyclohexane ring, more preferably, a cyclohexane ring substituted with an alkyl group (substituted or unsubstituted) having 1 to 24 total carbon atoms at its 4-position.

It is preferred that the pyrrolotriazole ring at 3-, 4- or 5-position of the benzene ring be substituted with —(Q-$R_{12}$)— Of the general formula (PC-1), the following general formulae (PC-2) and (PC-3) are preferred, and the general formula (PC-2) is more preferred.

(PC-2)

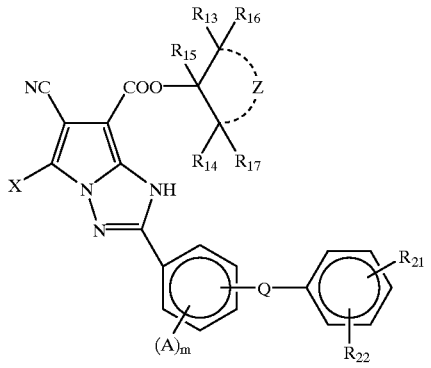

-continued (PC-3)

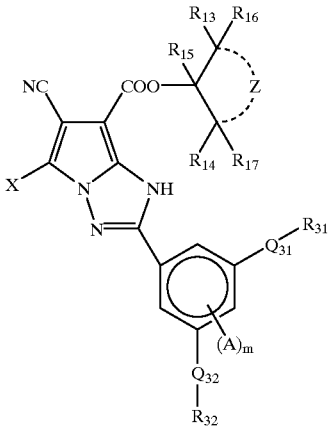

In the general formula (PC-2), all the same characters as those in the general formula (PC-1) have the same meaning as defined in the general formula (PC-1). $R_{21}$ represents a substituent containing a dissociating group which exhibits a pKa value of 13 or less. The dissociating group has the same meaning as defined with respect to that possessed by $R_{12}$ of the general formula (PC-1).

$R_{22}$ represents a substituent. Examples thereof and also preferred examples thereof are the same as mentioned with respect to A. It is especially preferred that $R_{22}$ have a moiety of a secondary or tertiary alkyl group each having 3 to 50 total carbon atoms.

Especially preferred compounds among those represented by the general formula (PC-2) are obtained when both $R_{13}$ and $R_{14}$ are t-butyl groups, the ring formed with Z contained therein is a cyclohexane ring, $R_{15}$, $R_{16}$ and $R_{17}$ are all hydrogen atoms, A is a group selected from alkoxy and alkyl groups each having up to 6 total carbon atoms and aryloxy groups having up to 10 total carbon atoms, $R_{21}$ is a substituent having a dissociating group which is selected from —OH, —COOH, —$SO_2NHCOR'$, —$SO_2NH_2$ and —$NHSO_2R'$, wherein R' represents an alkyl group, an aryl group or a heterocyclic group, $R_{22}$ is a group having a moiety of a tertiary alkyl group having 4 to 30 total carbon atoms, preferably, 4 to 16 total carbon atoms, Q is a group selected from —$NR_{18}CO$—, —$NR_{18}SO_2$—, —$CONR_{18}$— and —$SO_2NR_{18}$—, wherein $R_{18}$ is a hydrogen atom or an alkyl group having up to 3 total carbon atoms.

In the general formula (PC-3), the same characters as in the general formula (PC-1) and (PC-2) have the same meaning as defined in the general formula (PC-1) or (PC-2).

Each of $Q_{31}$ and $Q_{32}$ represents a divalent group selected from groups represented by Q of the general formula (PC-1). $Q_{31}$ and $Q_{32}$ may be the same with or different from each other. Preferred examples Of $Q_{31}$ and $Q_{32}$ groups are the same as mentioned with respect to Q.

Each of $R_{31}$ and $R_{32}$ independently represents a substituted or unsubstituted alkyl group having 4 to 50 total carbon atoms or a substituted or unsubstituted aryl group having at least 6 total carbon atoms. $R_{31}$ and $R_{32}$ may be the same or different from each other.

Of the compounds represented by the general formula (PC-3), those especially preferred are those when each of $Q_{31}$ and $Q_{32}$ is a group selected from —$NR_{18}CO$—, —$NR_{18}SO_2$—, —$CONR_{18}$— and —$SO_2NR_{18}$—, and when each of $R_{31}$ and $R_{32}$ independently represents a group having a moiety of an alkyl or aryl group each having 6 to 30 total carbon atoms.
Specific examples of the compounds represented by the general formula (PC-1) will be listed below, which in no way limit the scope of the present invention.
(CB-1)
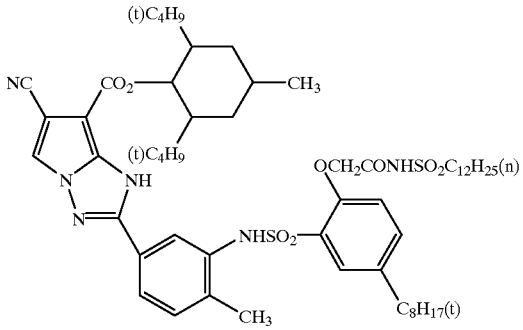
(CB-2)
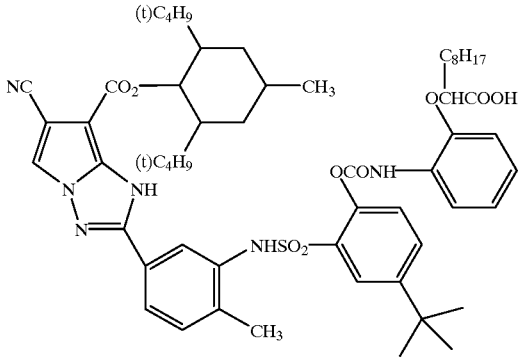
(CB-3)
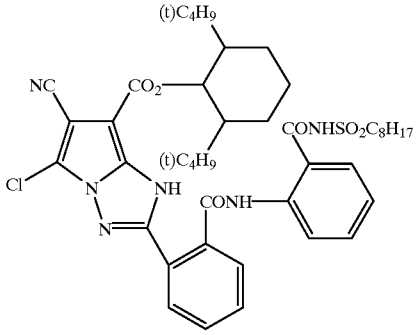
(CB-4)
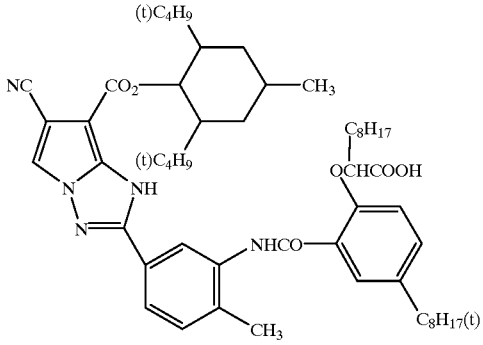
(CB-5)
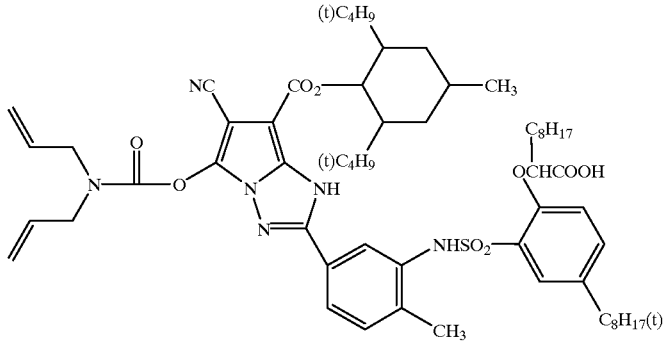
(CB-6)
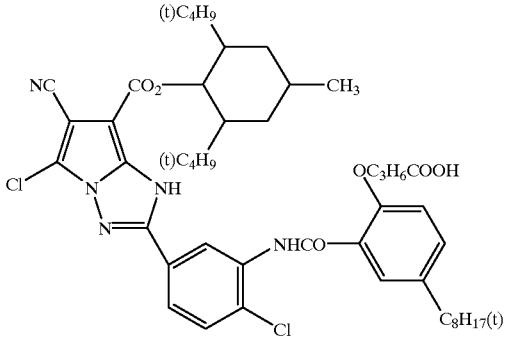
(CB-7)
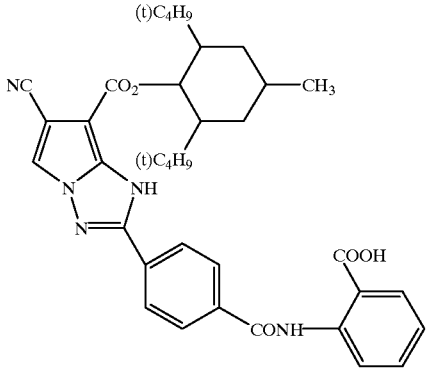

-continued
(CB-8)
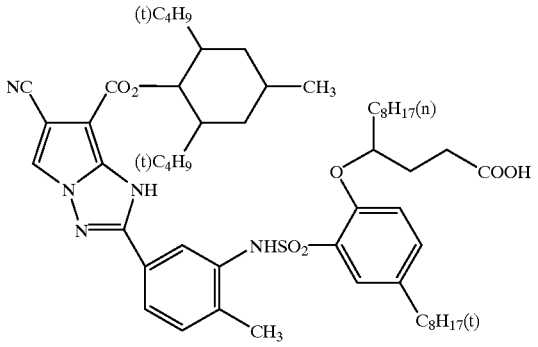
(CB-9)
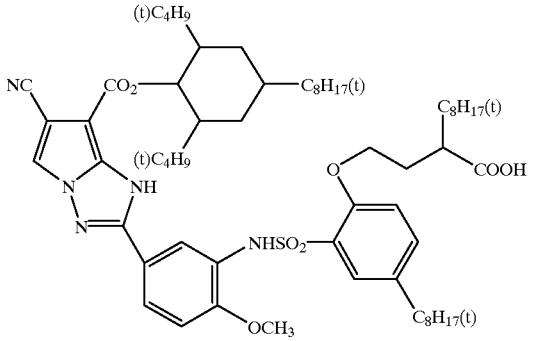
(CB-10)
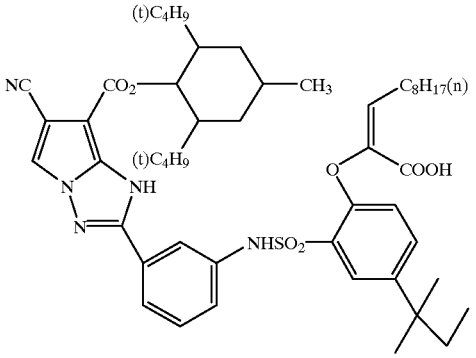
(CB-11)
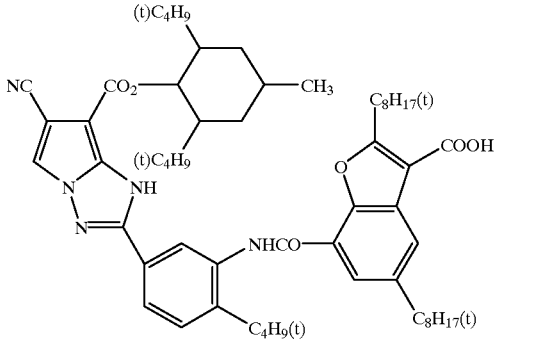
(CB-12)
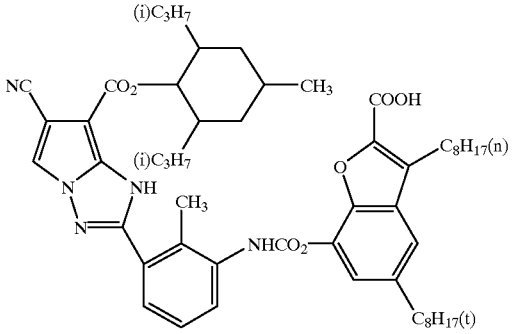
(CB-13)
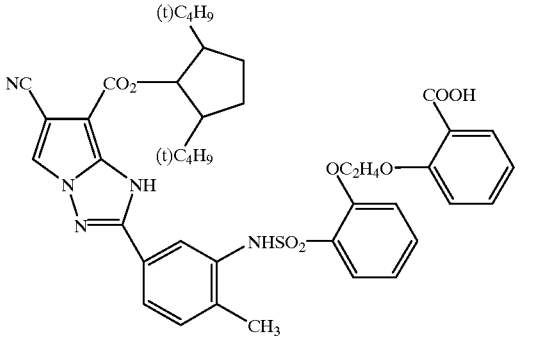
(CB-14)
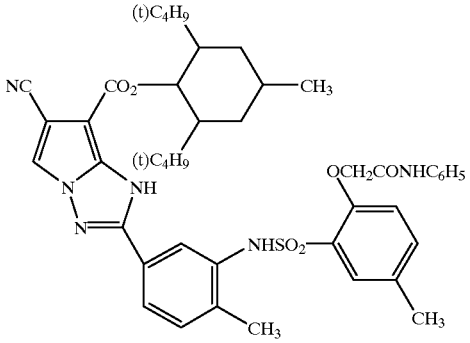

-continued
(CB-15)
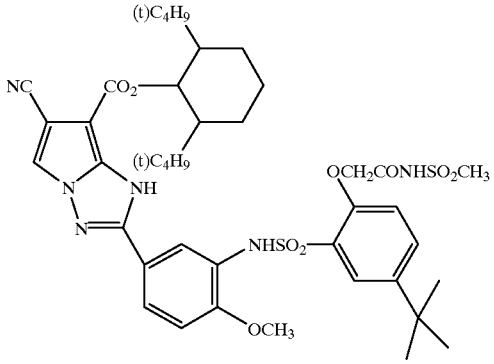
(CB-16)
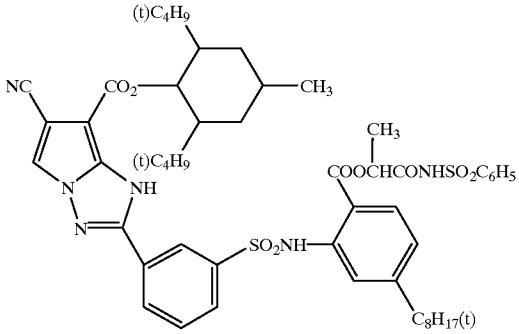
(CB-17)
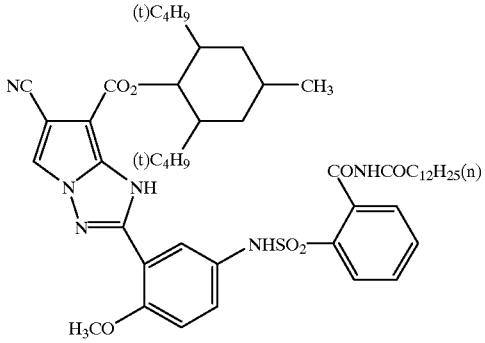
(CB-18)
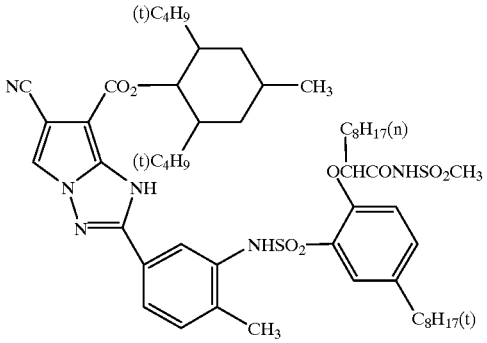
(CB-19)
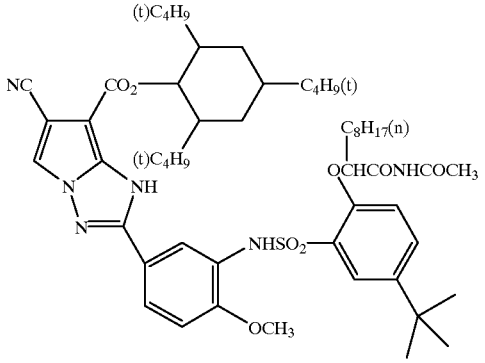
(CB-20)
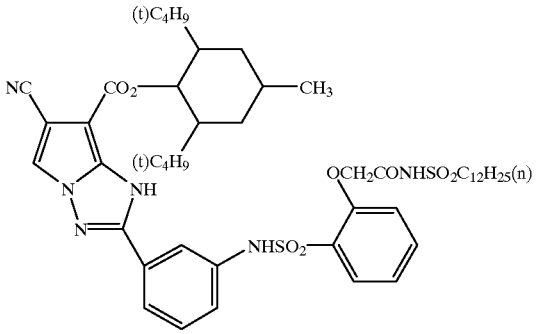
(CB-21)
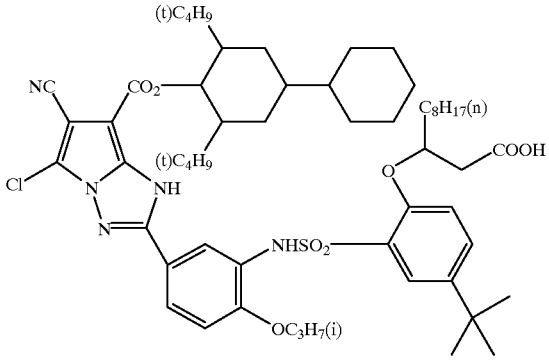

-continued
(CB-22)
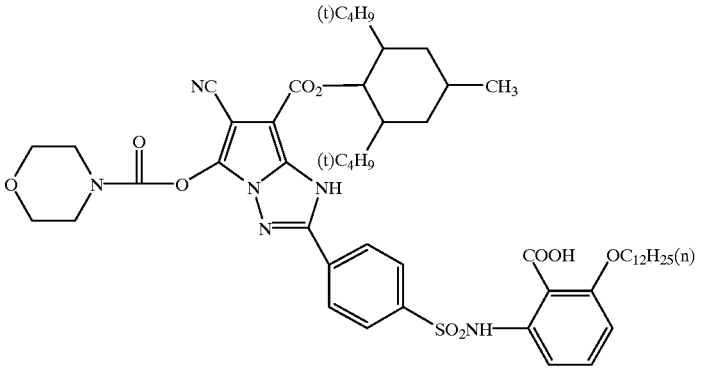
(CB-23)
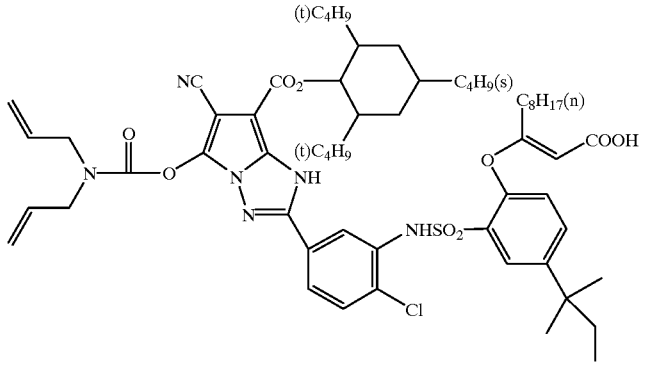
(CB-24)
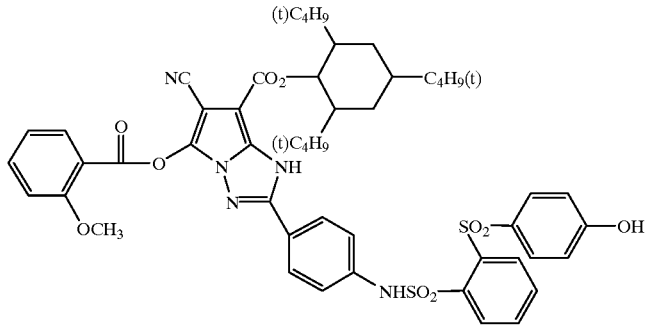
(CB-25)
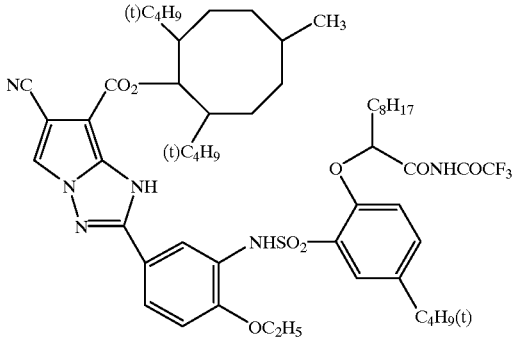
(CB-26)
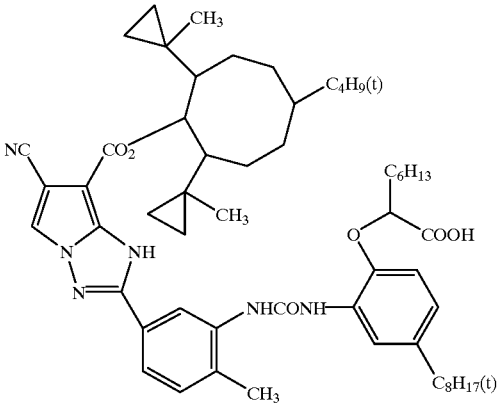

-continued
(CB-27)
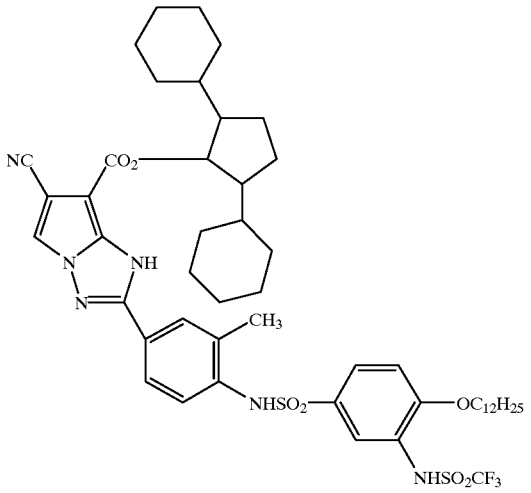
(CB-28)
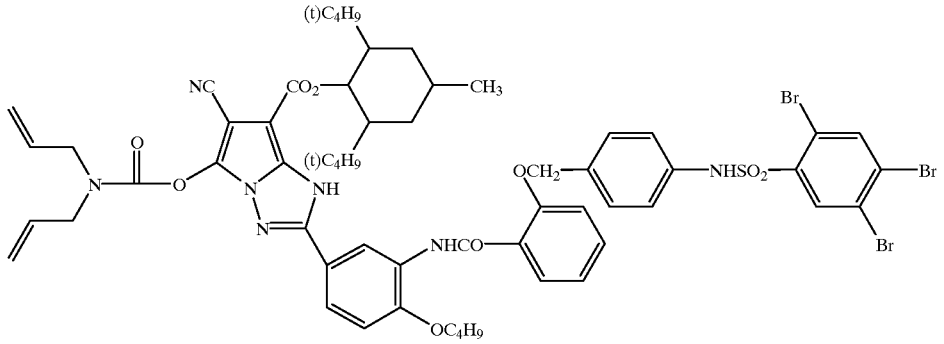
(CB-29)
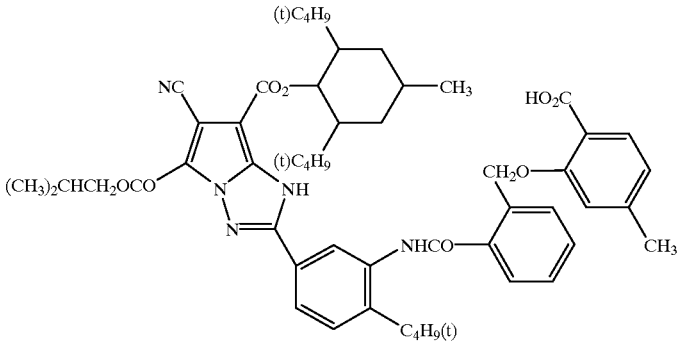
(CB-30)
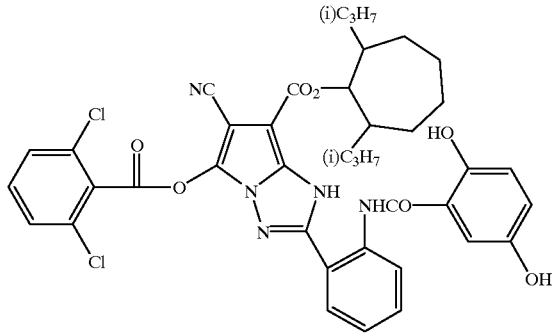

-continued
(CB-31)
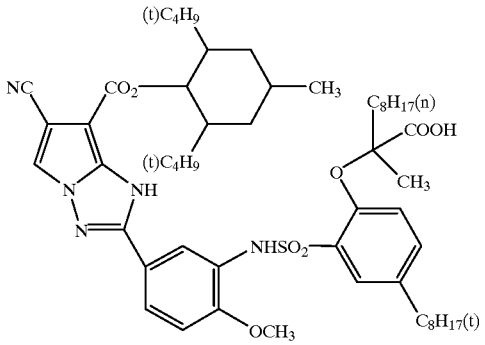
(CB-32)
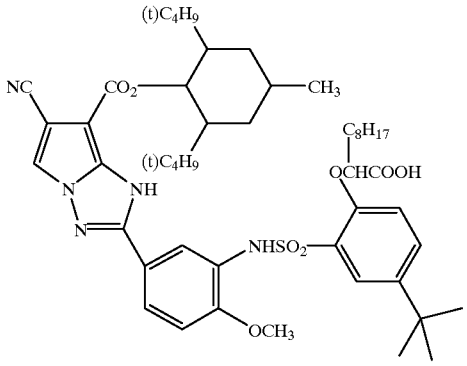
(CB-33)
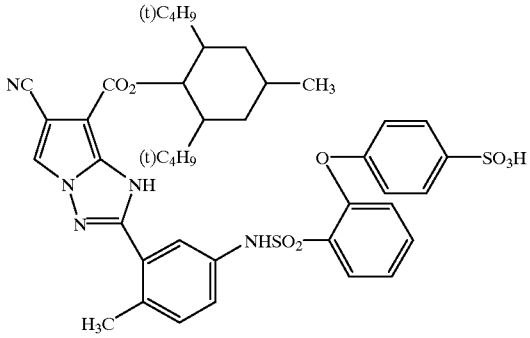
(CB-34)
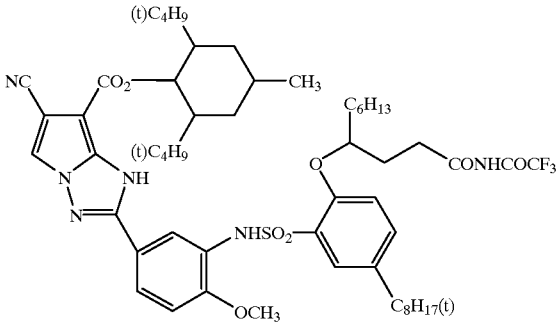
(CB-35)
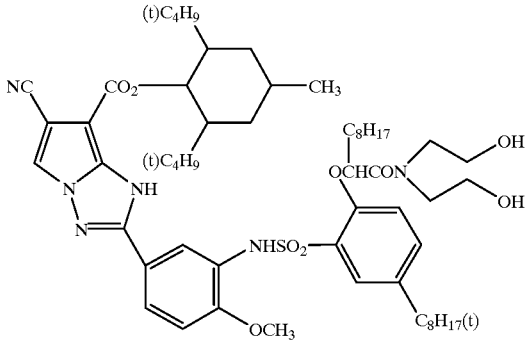
(CB-36)
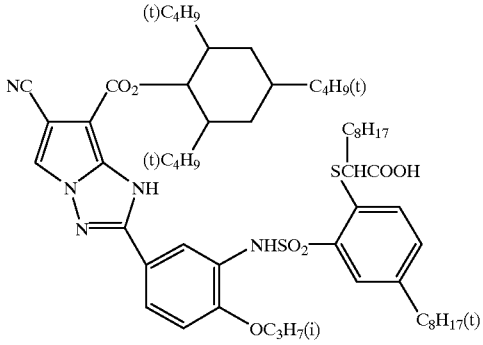
(CB-37)
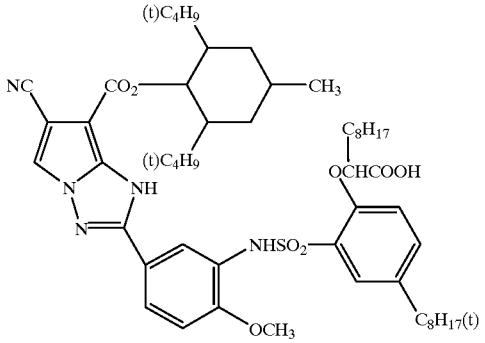
(CB-38)
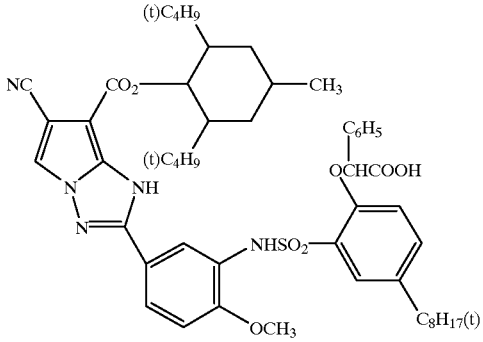

-continued
(CB-39)
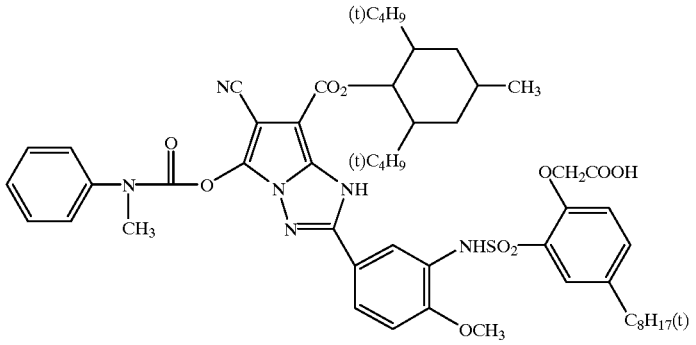
(CB-40)
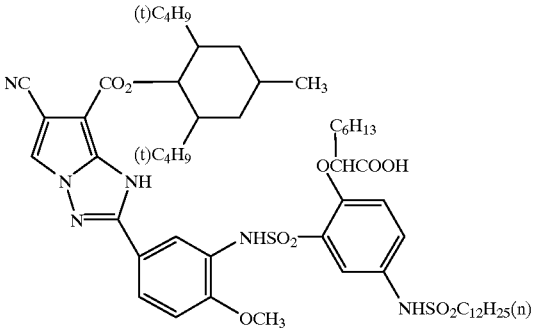
(CB-41)
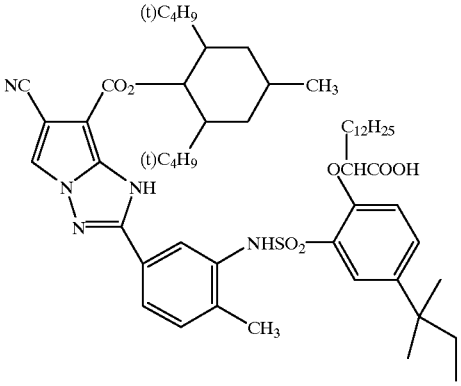
(CB-42)
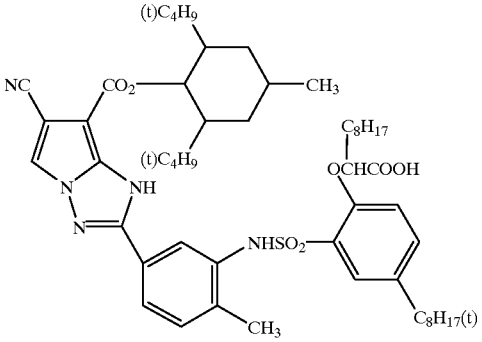
(CB-43)
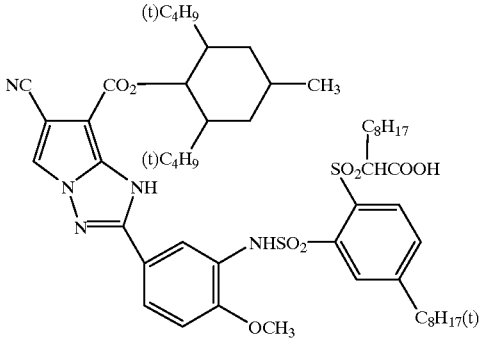
(CB-44)
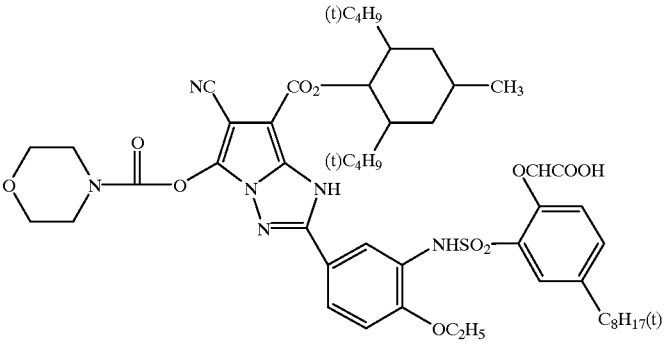

-continued
(CB-45)
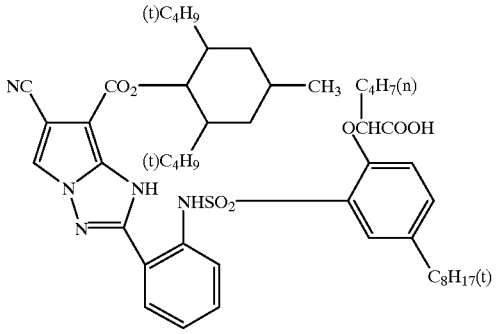
(CB-46)
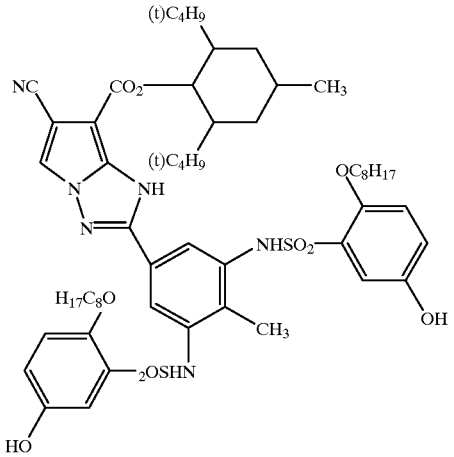
(CB-47)
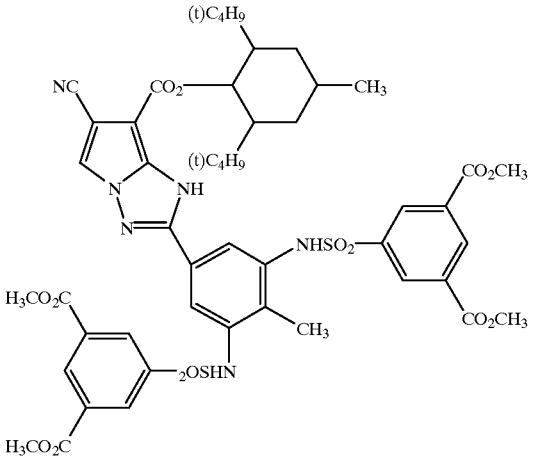
(CB-48)
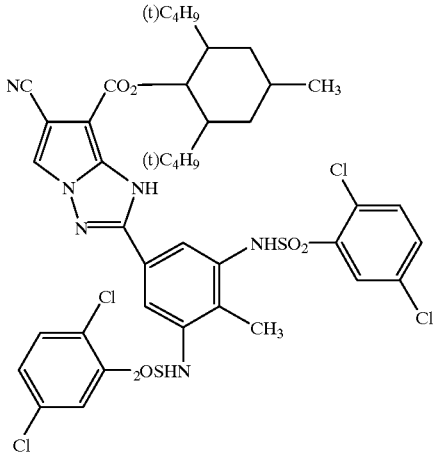

-continued
(CB-49)
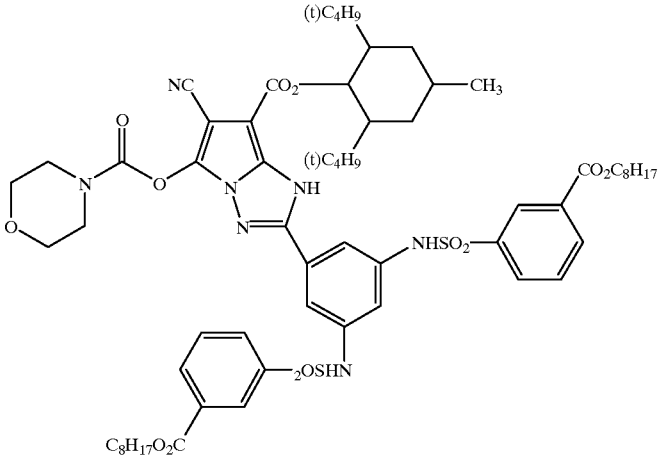
(CB-50)
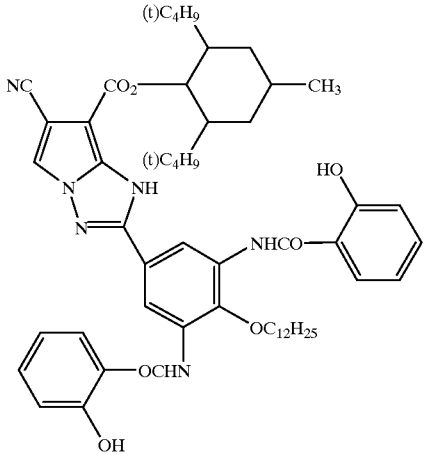
(CB-51)
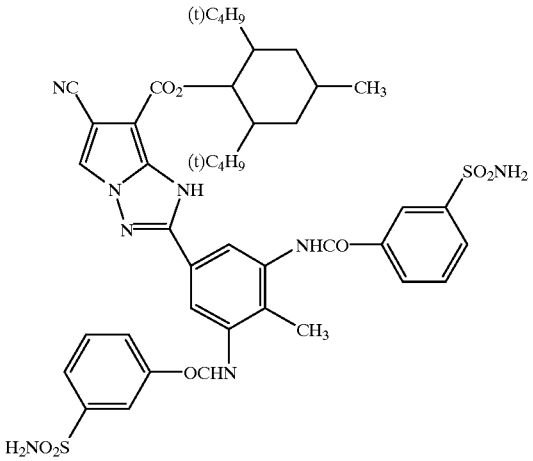

-continued
(CB-52)
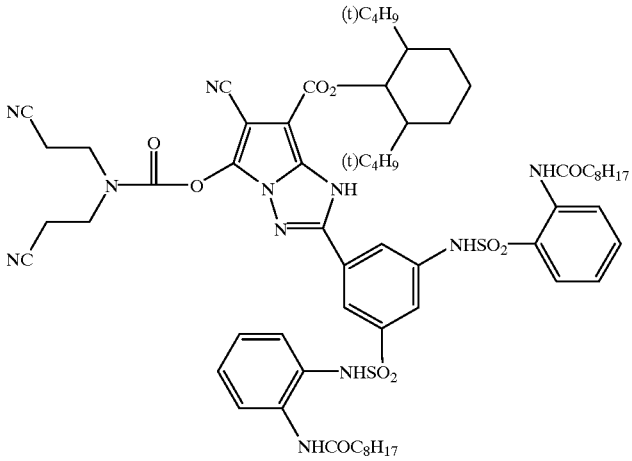
(CB-53)
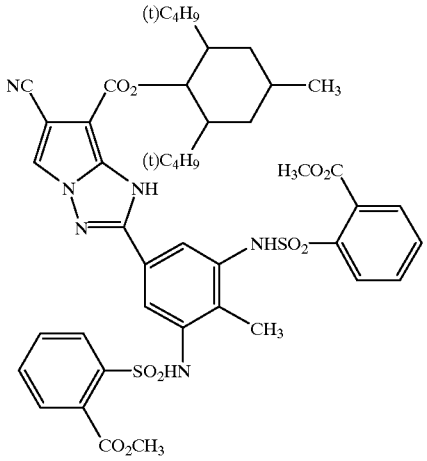
(CB-54)
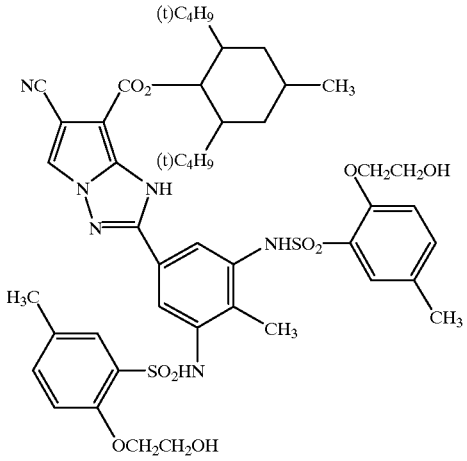
(CB-55)
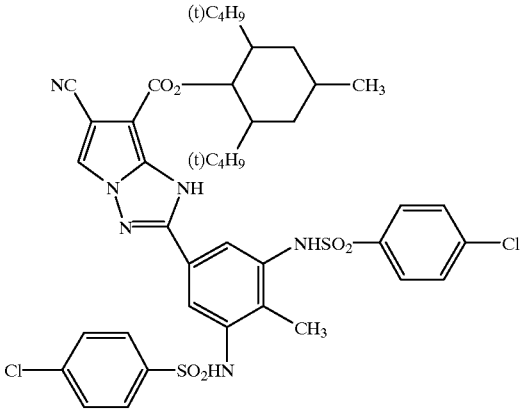
(CB-56)
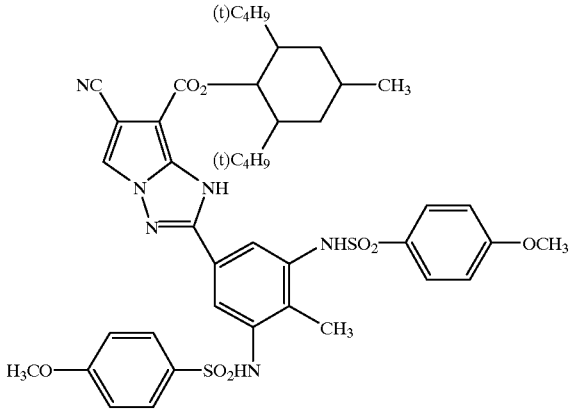

-continued
(CB-57)
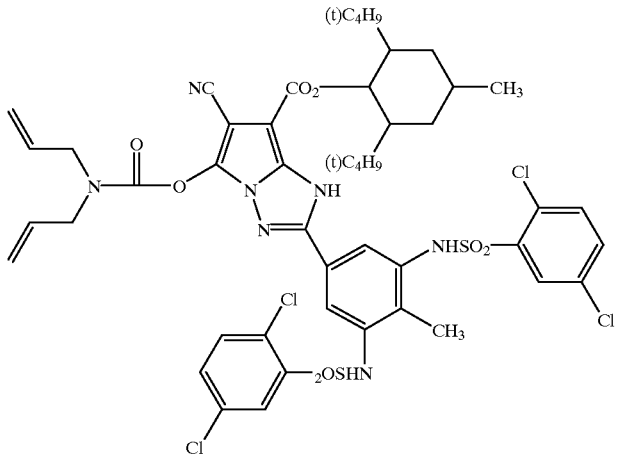
(CB-58)
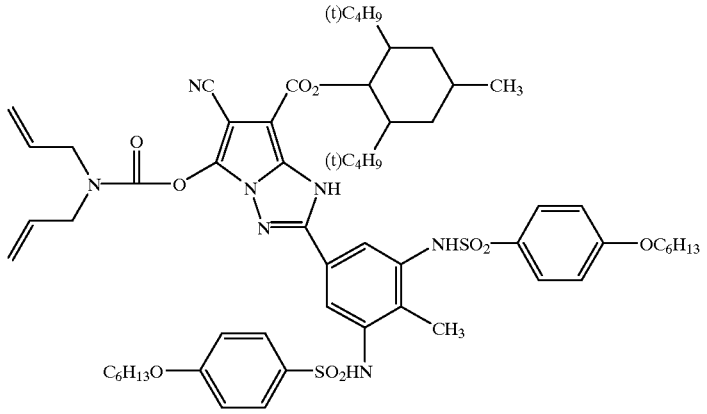
(CB-59)
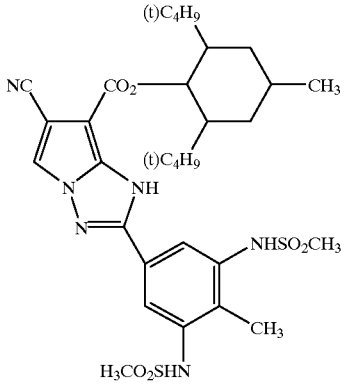
(CB-60)
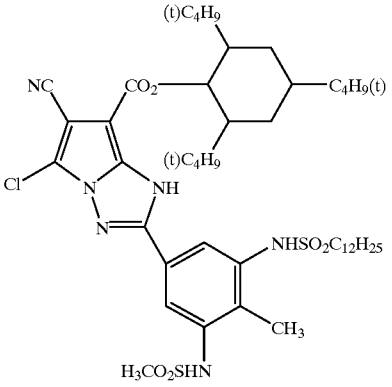

-continued
(CB-61)
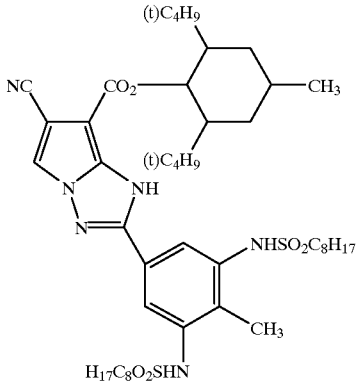
(CB-62)
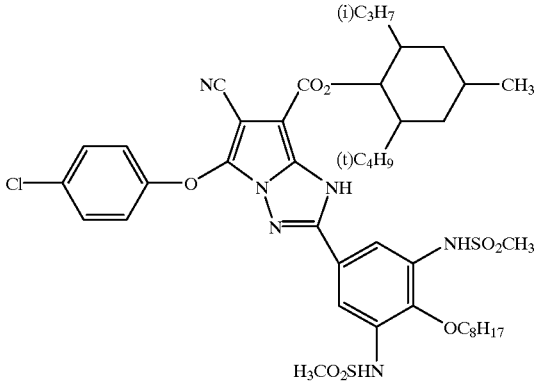
(CB-63)
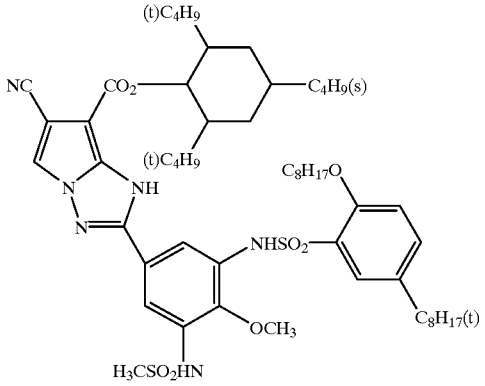
(CB-64)
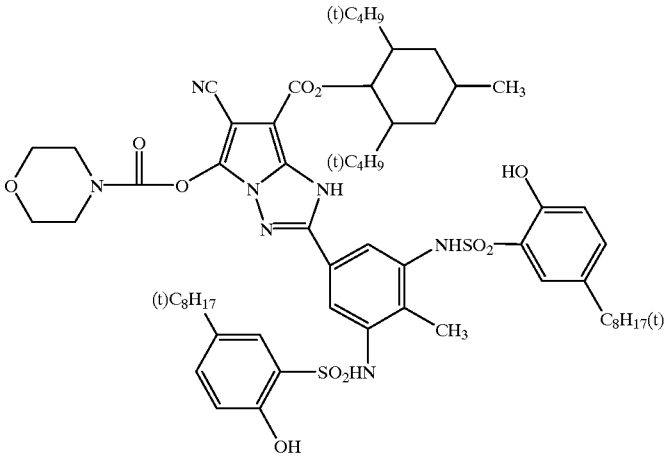

-continued (CB-65)

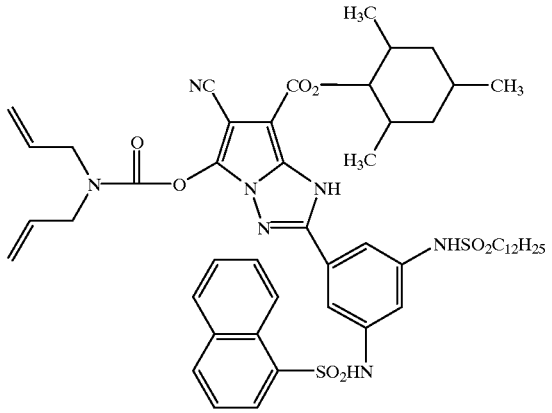

The compounds of the general formula (PC-1) according to the present invention can be synthesized by, for example, any of the methods described in JP-A-6-347960, JP-A-7-48336 and JP-A-7-330771, the disclosures of which are herein incorporated by reference.

The general formula (NC-1) will be described.

The dissociating group represented by M of the general formula (NC-1) has the same meaning as described with respect to X of the general formula (PC-1). M preferably represents a hydrogen atom, a chlorine atom, an alkoxy group, an aryloxy group, a heterocyclic oxy group, an acyloxy group, an alkoxycarbonyloxy group, an aryloxycarbonyloxy group, a carbamoyloxy group, an arylthio group or an alkylthio group. Of these, an alkoxy group, an aryloxy group, an acyloxy group, an alkoxycarbonyloxy group, an aryloxycarbonyloxy group, a carbamoyloxy group, an arylthio group and an alkylthio group, each having a substituted or unsubstituted alkyl or aryl group each having 6 to 50 total carbon atoms are preferred.

j is an integer of 1 to 3, preferably, 1 or 2. L represents a divalent group and is preferably selected from —O—, —CO—, —COO—, —OC(O)—, —NH— therein, —$NR_{31}CO$—, —$CONR_{31}$—, —$NR_{31}CONR_{32}$—, —$NR_{31}COO$— and —$OCONR_{31}$—. Each of $R_{31}$ and $R_{32}$ represents a hydrogen atom or an alkyl group having up to 5 total carbon atoms. k is 0 or 1.

U represents a substituent having at least one —NH— therein and is, for example, an alkyl group, an aryl group, a heterocyclic group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an acyloxy group, a carbamoyloxy group, an aryloxycarbonylamino group, an imido group, a heterocyclic thio group, a sulfinyl group, an aryloxycarbonyl group or an acyl group.

Of these, an alkyl group, an aryl group, an acylamino group, an alkylamino group, an anilino group, a ureido group, a sulfamoylamino group, an alkoxycarbonylamino group, a sulfonamido group, a carbamoyl group, a sulfamoyl group, a carbamoyloxy group, an aryloxycarbonylamino group and an imido group each having at least one —NH— therein are preferred.

B represents a substituent, which is, for example, one of those mentioned with respect to $R_1$ of the general formula (MC-1). b is an integer of 0 to 4.

Y represents a hydrogen atom or a substituent. The substituent is, for example, one of those mentioned with respect to $R_1$ of the general formula (MC-1). Y preferably represents a hydrogen atom, an alkoxy group, an alkyl group, an aryloxy group, an acylamino group or a sulfonamido group.

When M is a hydrogen atom, it is preferred that Y, U or B be substituted with a substituted or unsubstituted alkyl or aryl group each having 6 to 50 total carbon atoms to thereby endow the compound of the general formula (NC-1) with immobility in the lightsensitive material.

In the general formula (NC-1), it is especially preferred that Y be a hydrogen atom; M represent an alkoxy group, an aryloxy group, an acyloxy group, an alkoxycarbonyloxy group, an aryloxycarbonyloxy group, a carbamoyloxy group, an arylthio group or an alkylthio group, each having a substituted or unsubstituted alkyl or aryl group each having 6 to 50 total carbon atoms; j be 1 or 2; k be 0; U represent a group selected from an acylamino group, a carbamoyl group, a ureido group, an alkoxycarbonylamino group and an alkyl group, each having at least one —NH— therein; and b be 0 or 1, provided that, when b is 1, B is a group selected from a halogen atom, an alkyl group, an alkoxy group, an aryl group, an aryloxy group, a hydroxyl group, a cyano group and a ureido group.

Specific examples of the compounds represented by the general formula (NC-1) will be listed below, which in no way limit the scope of the present invention.

CC-1
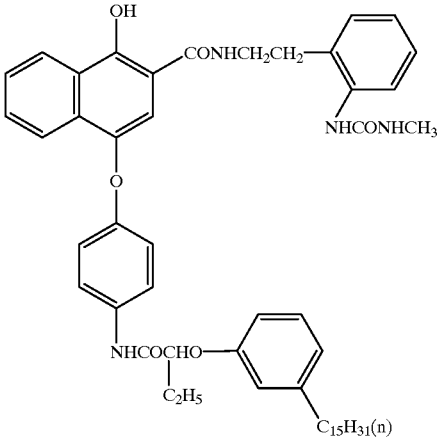
CC-2
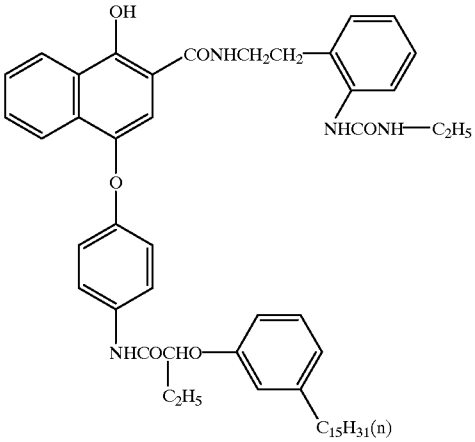
CC-3
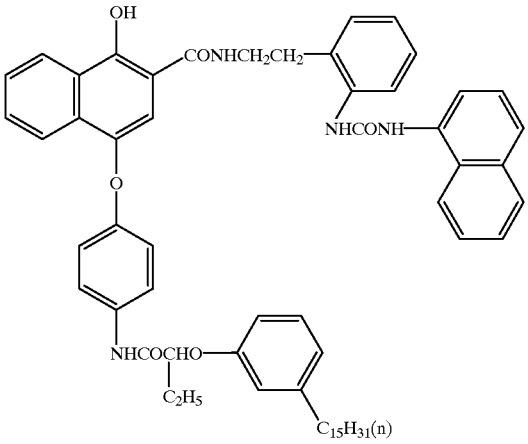
CC-4
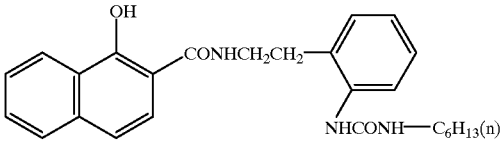
CC-5
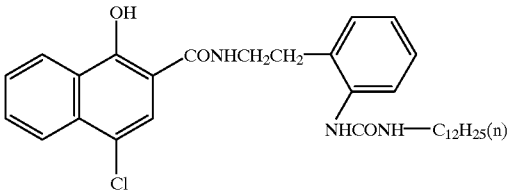
CC-6
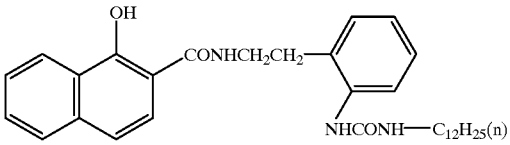

-continued
CC-7
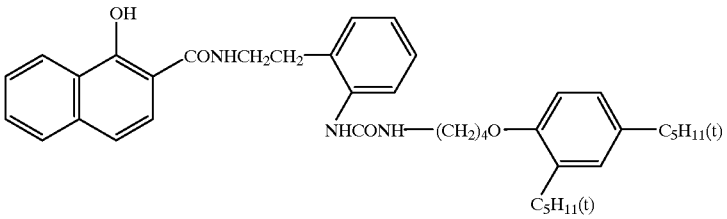
CC-8
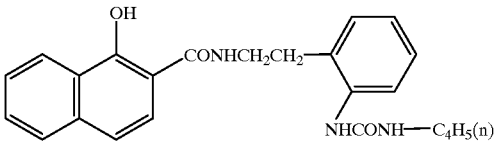
CC-9
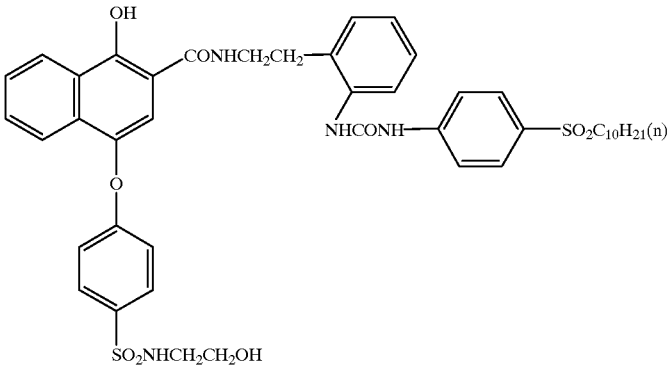
CC-10
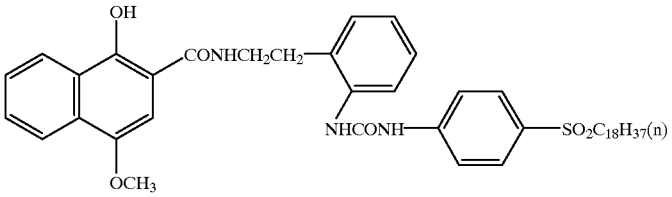
CC-11
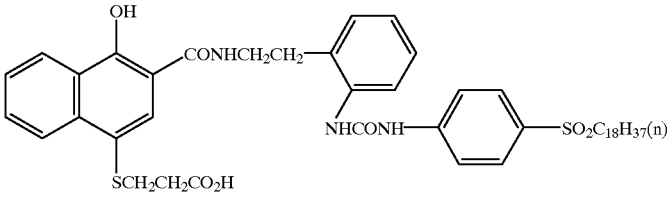
CC-12
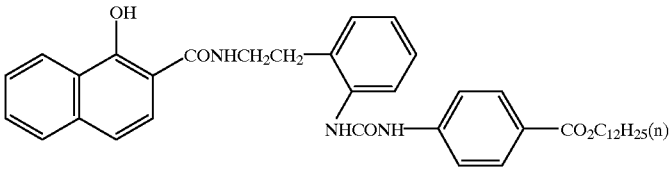
CC-13
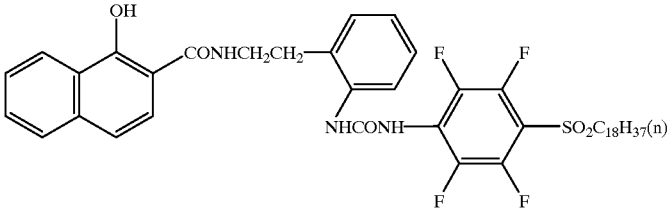

-continued
CC-14
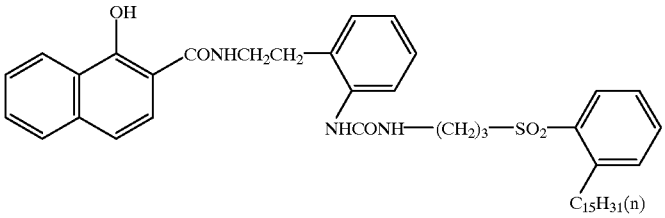
CC-15
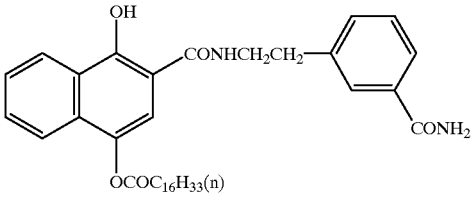
CC-16
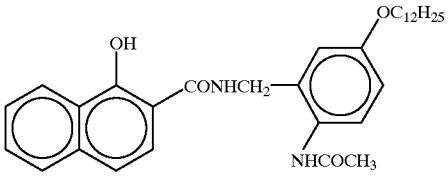
CC-17
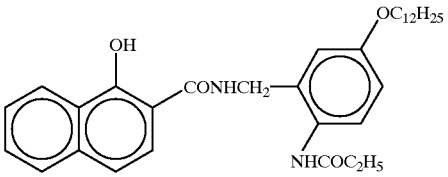
CC-18
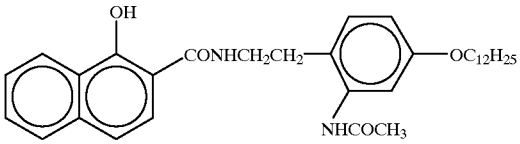
CC-19
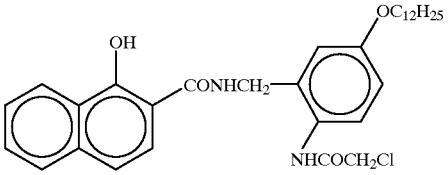
CC-20
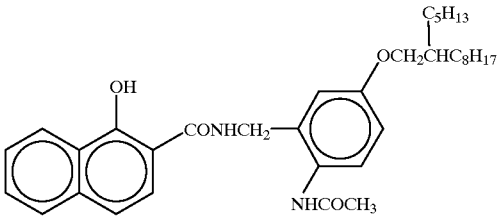
CC-21
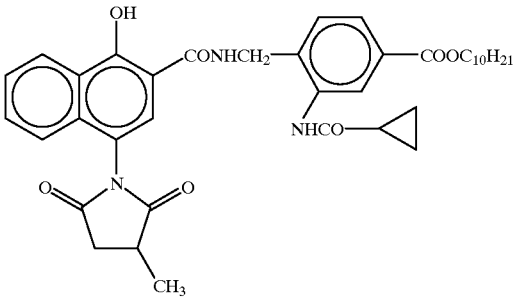
CC-22
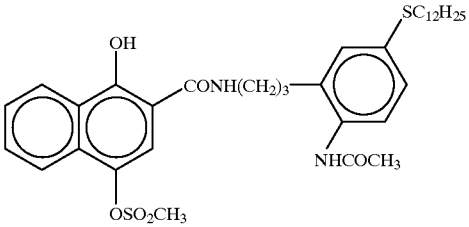

-continued
CC-23
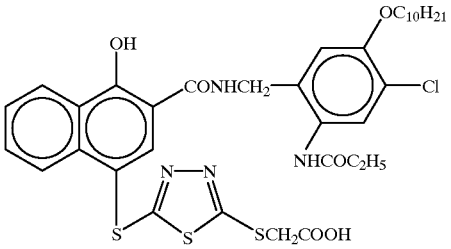
CC-24
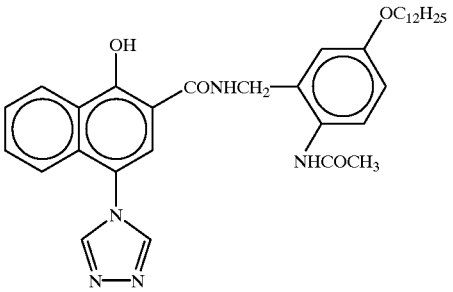
CC-25
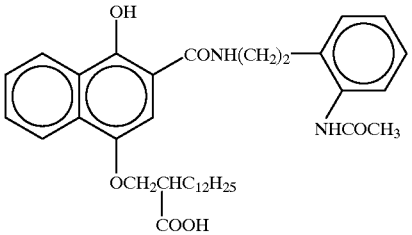
CC-26
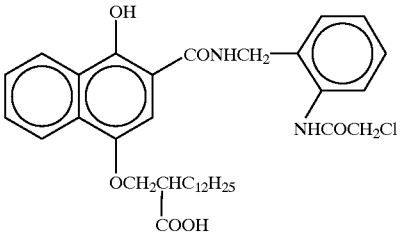
CC-27
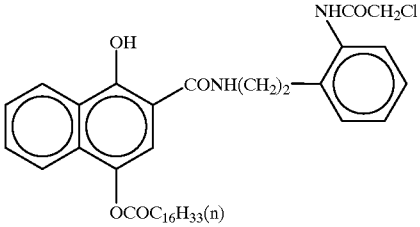
CC-28
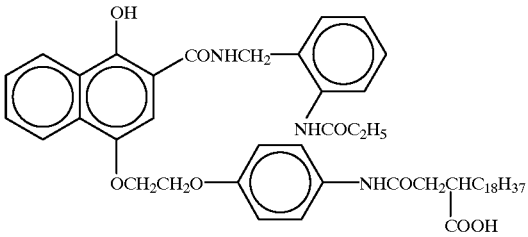
CC-29
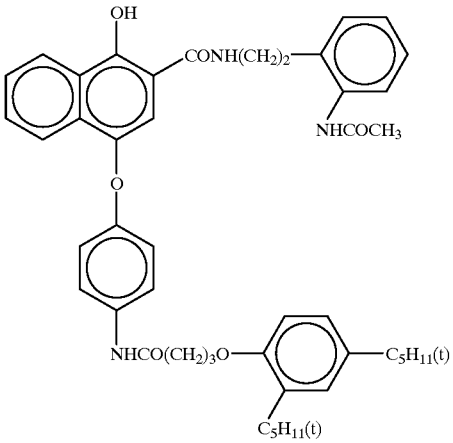
CC-30
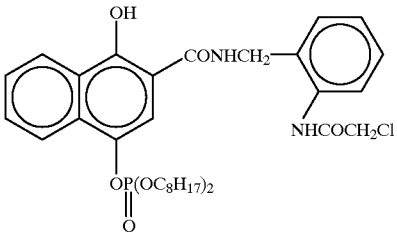

-continued

CC-31

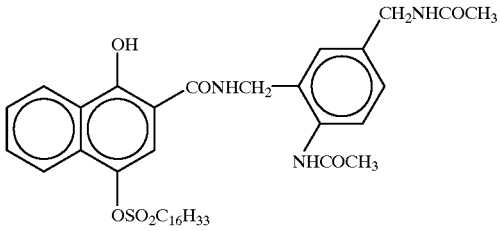

CC-32

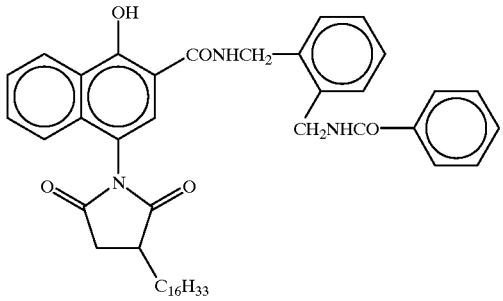

CC-33

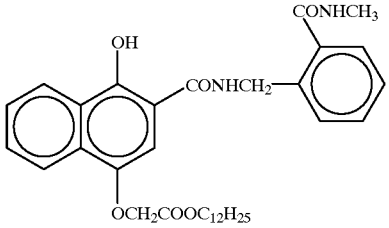

CC-34

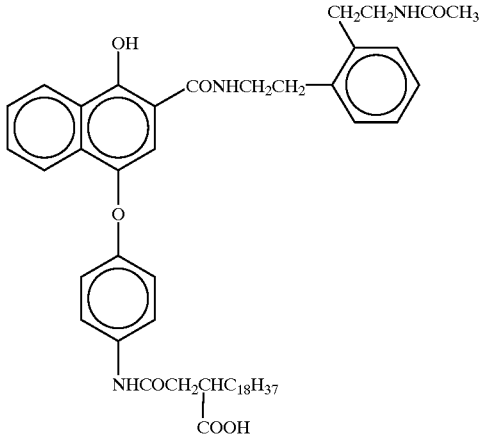

CC-35

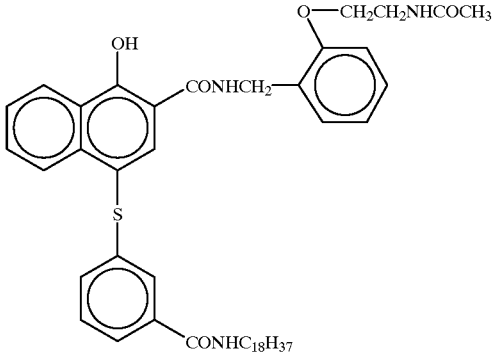

A method of synthesizing the compounds of the general formula (NC-1) is described in, for example, U.S. Pat. No. 5,654,132, the disclosure of which is herein incorporated by reference.

Although the combination of the cyan coupler represented by the general formula (PC-1) or general formula (NC-1) and the magenta coupler represented by the general formula (MC-1) according to the present invention is not particularly limited, it is preferred that when the combination is made with the compound of the general formula (NC-1) and when, in the general formula (MC-1), $G_1$ and $G_2$ represent a carbon atom and a nitrogen atom, respectively, the compound of the general formula (MC-1) be one of the general formula (MC-2) with $R_4$ being a group represented by the general formula (BL-2).

The magenta coupler represented by the general formula (MC-1) can also be incorporated in a layer other than the green-sensitive emulsion layer.

The cyan coupler represented by the general formula (PC-1) or (NC-1) can also be incorporated in a layer other than the red-sensitive emulsion layer.

The cyan coupler represented by the general formula (PC-1), the cyan coupler represented by the general formula (NC-1) can simultaneously be used in an emulsion layer with the same color sensitivities. When, in the lightsensitive material, the layer with the same color sensitivities are composed of a unit of sub-layers with speeds different from each other, the simultaneous use can also be made in one sub-layer or in two or more sub-layers with the same color sensitivity, but with speeds different from each other.

The couplers represented by the general formula (MC-1), (PC-1) and (NC-1) according to the present invention can be introduced in the lightsensitive material by various conventional dispersion methods. The introduction is preferably performed by the method of dispersing oil drops in water wherein the coupler is dissolved in a high-boiling-point organic solvent (in combination with a low-boiling-point solvent if necessary), emulsified and dispersed in an aqueous gelatin solution and added to a silver halide emulsion.

Examples of the high-boiling-point solvent used in the above method of dispersing oil drops in water are set forth in, for example, U.S. Pat. No. 2,322,027, the disclosure of which is herein incorporated by reference. Steps and effect of a latex dispersion method as a polymer dispersion method together with examples of impregnation latexes are set forth in, for example, U.S. Pat. Nos. 4,199,363, DE (OLS) 2,541,274, DE (OLS) 2,541,230, JP-B-53-41091 and EP 029104, the disclosures of which are herein incorporated by reference. Dispersion by the use of an organic solvent soluble polymer is described in PCT International Publication WO 88/00723, the disclosure of which is herein incorporated by reference.

Examples of the high-boiling-point solvents which can be used in the above method of dispersing oil drops in water include phthalic acid esters (e.g., dibutyl phthalate, dioctyl phthalate, dicyclohexyl phthalate, di-2-ethylhexyl phthalate, decyl phthalate, bis(2,4-di-tert-amylphenyl) isophthalate and bis(1,1-diethylpropyl) phthalate), phosphoric acid or phosphonic acid esters (e.g., diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridecyl phosphate and di-2-ethylhexylphenyl phosphate), benzoic acid esters (e.g., 2-ethylhexyl benzoate, 2,4-dichlorobenzoate, dodecyl benzoate and 2-ethylhexyl p-hydroxybenzoate), amides (e.g., N,N-diethyldodecanamide and N,N-diethyllaurylamide), alcohols and phenols (e.g., isostearyl alcohol and 2,4-di-tert-amylphenol), aliphatic esters (e.g., dibutoxyethyl succinate, di-2-ethylhexyl succinate, 2-hexyldecyl tetradecanoate, tributyl citrate, diethyl azelate, isostearyl lactate and trioctyl tosylate), aniline derivatives (e.g., N,N-dibutyl-2-butoxy-5-tert-octylaniline), chlorinated paraffins (e.g., paraffins having a chlorine content of 10 to 80%), trimesic acid esters (e.g., tributyl trimesate), dodecylbenzene, diisopropylnaphthalene, phenols (e.g, 2,4-di-tert-amylphenol, 4-dodecyloxyphenol, 4-dodecyloxycarbonylphenol and 4-(4-dodecyloxyphenylsulfonyl)phenol), carboxylic acids (e.g., 2-(2,4-di-tert-amylphenoxy)butyric acid and 2-ethoxyoctyldecanoic acid) and alkylphosphoric acids (e.g., di-(2-ethylhexyl)phosphoric acid and diphenylphosphoric acid). Besides the above high-boiling-point solvents, the compounds listed in, for example, JP-A-6-258803, the disclosure of which is herein incorporated by reference, are preferably used as the high-boiling-point solvents.

Further, organic solvents having a boiling point so of 30 to approximately 160° C. (for example, ethyl acetate, butyl acetate, ethyl propionate, methyl ethyl ketone, cyclohexanone, 2-ethoxyethyl acetate and dimethylformamide) can be used in combination as an auxiliary solvent.

In the lightsensitive material of the present invention, it is only essential that at least one layer containing the coupler represented by the general formula (MC-1) and at least one layer containing the coupler represented by the general formula (PC-1) or (NC-1) are disposed on a support and that each of the layers containing the couplers represented by the general formula (MC-1), (PC-1) or (NC-1) is lightsensitive emulsion layers disposed on a support. The general lightsensitive material can be constituted by coating a support with at least one blue-sensitive silver halide emulsion layer, at least one green-sensitive silver halide emulsion layer and at least one red-sensitive silver halide emulsion layer in this sequence. The coating may be performed in a sequence different therefrom. When the present invention is applied to a lightsensitive material for photographing, it is preferred that the coating is performed in the sequence of, from the side closer to the support, the red-sensitive silver halide emulsion layer, the green-sensitive silver halide emulsion layer and the blue-sensitive silver halide emulsion layer. Further, it is preferred that each of the color sensitive layers have a unit constitution including a plurality of lightsensitive emulsion sub-layers with different speeds. It is especially preferred that each of the color sensitive layers have a unit of three-sub-layer constitution composed of three lightsensitive emulsion sub-layers consisting of a low-speed layer, an intermediate-speed layer and a high-speed layer arranged in this sequence from the side closer to the support.

In these lightsensitive emulsion layers, the color reproduction according to the subtractive color process can be effected by incorporating therein a silver halide emulsion exhibiting sensitivity in each wavelength range and a color coupler capable of forming a dye which is in a complementary color relationship with the light inducing the sensitivity. However, the lightsensitive emulsion layer and the coloring hue of the color coupler may be so constituted that the above correspondence does not apply.

The content of each of the couplers represented by the general formulae (MC-1), (PC-1) and (NC-1) in the lightsensitive material is in the range of 0.01 to 10 g/m$^2$, preferably, 0.1 to 2 g/m$^2$. The coupler content is suitably in the range of $1\times10^{-3}$ to 1 mol, preferably, $2\times10^{-3}$ to $3\times10^{-1}$ mol per mol of silver halide contained in the emulsion layer.

When the lightsensitive layer has a unit constitution, the content of each of the couplers represented by the general formulae (MC-i), (PC-1) and (NC-1) according to the present invention per mol of silver halide of each sub-layer is preferably in the range of $2\times10^{-3}$ to $1\times10^{-1}$ mol in a low-speed layer and in the range of $3\times10^{-2}$ to $3\times10^{-1}$ mol in a high-speed layer.

The lightsensitive material of the present invention is preferably further doped with a competing compound (compound which reacts with an aromatic primary amine color developer in an oxided form while competing with the image forming coupler but does not form dye images). The competing compound is, for example, a reducing compound selected from hydroquinones, catechols, hydrazines, sulfonamidophenols or a compound which couples with a color developer in an oxided form but substantially does not form color images (e.g., non-color-forming coupler as disclosed in U.S. Pat. No. DE 1,155,675, GB 861,138, U.S. Pat. No. 3,876,428 and U.S. Pat. No. 3,912,513 or water soluble dye-forming coupler as disclosed in JP-A-6-83002), the disclosures of which are incorporated by reference.

The competing compound is preferably added to the lightsensitive emulsion layers containing magenta and cyan couplers represented by the general formulae (MC-1) and (PC-1) or (NC-1), respectively, according to the present invention and also added to nonlightsensitive layers such as a protective layer, an interlayer, a yellow filter layer and an antihalation layer. It is especially preferred that the competing compound and the couplers represented by the general formulae (MC-1) and (PC-1) or (NC-1) according to the present invention is added to the same lightsensitive emulsion layers. The competing compound is added in an amount of 0.01 to 10 g, preferably, 0.10 to 5.0 g per m$^2$ of the lightsensitive material, namely, 1 to 1000 mol %, preferably, 20 to 500 mol % based on coupler used in the present invention.

In the lightsensitive material of the present invention, a non-color-producing interlayer is preferably incorporated in a lightsensitive unit of the same color sensitivity, and a compound which can be selected as the above competing compound is preferably contained in the interlayer.

For preventing the deterioration of photographic performance by formaldehyde gas, it is preferred that the lightsensitive material of the present invention is doped with a compound capable of reacting with formaldehyde gas to thereby immobilize it as described in U.S. Pat. No. 4,411,987 and U.S. Pat. No. 4,435,503, the disclosures of which are herein incorporated by reference.

Lightsensitive silver halide grains for use in the present invention are composed of silver bromide, silver chloride, silver iodide, silver chlorobromide, silver chloroiodide, silver iodobromide and silver chloroiodobromide. Other silver salts such as silver rhodanate, silver sulfide, silver selenide, silver carbonate, silver phosphate and organic acid salts of silver may be contained as separate grains or as portion of silver halide grains. In the present invention, silver iodobromide and silver chloroiodobromide are preferred. It is preferred that 0.5 to 30 mol % of silver iodide be contained. Silver iodobromide and silver chloroiodobromide each containing 1 to 15 mol % of silver iodide are especially preferred.

The silver halide emulsion of the present invention, in the grains thereof, preferably has a distribution or structure with respect to the halogen composition. As a representative example thereof, there can be mentioned core/shell type or double-structure type grains having a grain interior and a surface layer which differ from each other in halogen composition as disclosed in, for example, JP-B-43-13162, JP-A-61-215540, JP-A-60-222845, JP-A-60-143331 and JP-A-61-75337. Furthermore, in place of the simple double structure, there can be mentioned a triple structure as disclosed in JP-A-60-222844, a further multiple structure and a structure in which silver halides with different compositions are thinly applied to the surface of core/shell double-structure grains.

Structuring of grain interior is not limited to the above enclosed structure and can provide grains having a so-called junction structure. Examples of these grains are disclosed in, for example, JP-A-59-133540, JP-A-58-108526, EP 199,290A2, JP-B-58-24772 and JP-A-59-16254. Junction crystal, having a composition different from that of the host crystal, can be formed while junctioning at edges, corner portions or facial portions of the host crystal. The junction crystal can be formed even if the host crystal is uniform with respect to the halogen composition or has a core/shell structure.

With respect to the grains of, for example, silver iodobromide having the above structures, a preferred form is obtained by rendering the silver iodide content of the core portion higher than that of the shell portion. However, it may occur that grains having low silver iodide content at the core portion and high silver iodide content at the shell portion are preferred. Likewise, suitable grains of junction structure can be obtained by rendering the silver iodide content of the host crystal high while rendering the silver iodide content of the junction crystal relatively low and, vice versa. Moreover, the boundary dividing the grains of the above structure into different halogen compositions may be either clear or ambiguous. Also, a preferred form is obtained by positively bestowing continuous composition changes in the grains.

The silver halide grains for use in the present invention can be selected, in conformity with the object, from among regular crystals not containing any twin faces and crystal examples described on page 163 of "Fundamentals of Photographic Engineering, Part "Silver Salt Photography" edited by The Society of Photographic Science and Technology of Japan and published by Corona, for example, single twinned crystals having one twin face, parallel multiple twinned crystals having at least two parallel twin faces and nonparallel multiple twinned crystals having at least two nonparallel twin faces. An example of method of mixing grains of different configurations is disclosed in U.S. Pat. No. 4,865,964. If necessary, this method can be selected. In the instance of regular crystals, use can be made of grains of a cube consisting of (100) faces, grains of an octahedron consisting of (111) faces and grains of a dodecahedron consisting of (110) faces as disclosed in JP-B-55-42737 and JP-A-60-222842. Furthermore, although designing is required in the regulating method, grains of (hkl) faces whose representative is (321) faces, grains of (hko) faces whose representative is (210) faces, grains of (hhl) faces whose representative is (331) faces and grains of (hll) faces whose representative is (211) faces as reported in Journal of Imaging Science, vol. 30, page 247 (1986) can be selected and used in conformity with the objective. Still further, grains in which two different faces or a multiplicity of different faces are simultaneously present, such as grains of a tetradecahedron simultaneously having (100) faces and (111) faces in each grain, grains simultaneously having both (100) faces and (110) faces and grains simultaneously having (111) faces and (110) faces, can be selected and used in conformity with the objective.

The quotient of the equivalent circle diameter of a projected area divided by the grain thickness is termed the aspect ratio, which specifies the configuration of tabular grains. Tabular grains having an aspect ratio of greater than 1 can be used in the present invention. The tabular grains can be prepared by the process as described in, for example, Cleve, "Photography Theory and Practice", page 131 (1930); Gutoff, "Photographic Science and Engineering", vol. 14, pp. 248–257 (1970); and U.S. Pat. No. 4,434,226, U.S. Pat. No. 4,414,310, U.S. Pat. No. 4,433,048, U.S. Pat. No. 4,439,520 and GB 2,112,157. The use of tabular grains is advantageous in that the covering power is enhanced and that the color sensitization efficiency by a spectral sensitizing dye is enhanced. These are described in detail in the above cited U.S. Pat. No. 4,434,226. The average aspect ratio with respect to at least 80% of the total projected area of grains is preferably in the range of 1 to less than 100, more preferably, 2 to less than 20 and, most preferably, 3 to less than 10. For example, a triangle, a hexagon or a circle can be selected as the shape of tabular grains. An equilateral hexagon whose six sides have substantially the same length as described in U.S. Pat. No. 4,797,354 presents a preferred form.

The equivalent circle diameter of the projected area is quite often employed to define the size of tabular grains. Grains whose average diameter is up to 0.6 $\mu$m as described in U.S. Pat. No. 4,748,106 are preferred from the viewpoint that the imaging quality is enhanced. With respect to the configuration of tabular grains, it is preferred that the grain thickness be limited to 0.5 $\mu$m or less, especially, 0.3 $\mu$m or less from the viewpoint the sharpness is enhanced. Furthermore, grains whose thickness and twin face interfacial distance are specified as described in JP-A-63-163451 are also preferred.

More desirable results may be obtained by the use of monodisperse tabular grains having a narrow grain size distribution. U.S. Pat. No. 4,797,354 and JP-A-2-838 describe the process for producing monodisperse hexagonal tabular grains wherein the tabular form ratio is high. Further, EP 514,742 describes the process for producing tabular grains, whose grain size distribution variation coefficient is less than 10%, with the use of a polyalkylene oxide block copolymer. These tabular grains are preferably used in the present invention. Still further, grains exhibiting a grain thickness variation coefficient of up to 30% to thereby have a high thickness uniformity are also preferred.

In the tabular grains, the dislocation lines can be observed through a transmission electron microscope. Grains not containing any dislocation lines, grains containing a few dislocation lines or grains containing a multiplicity of dislocation lines are preferably selected in conformity with the objective. Dislocation linearly introduced, or curved, with respect to a specified direction along the crystal orientation of grains can be selected. Further, selection can be made from dislocation introduction throughout the grains, dislocation introduction at only specified portion, for example, fringe portion of the grains, etc. The introduction of dislocation lines is preferred in not only tabular grains but also regular crystal grains and amorphous grains such as potato-like grains. In this instance as well, the limitation to specified portion such as vertex or edge of grains presents a preferred form.

The grain size of the emulsion for use in the present invention can be evaluated by, for example, the equivalent circle diameter of projected area determined by means of an electron microscope, the equivalent sphere diameter of grain volume calculated from the projected area and the grain thickness, or the equivalent sphere diameter of volume determined by the Coulter counter method. Although, grains can be selected from those ranging from superfine grains with an equivalent sphere diameter of up to 0.05 gm to coarse grains with an equivalent sphere diameter of greater than 10 $\mu$m, it is preferred to employ grains with an equivalent sphere diameter of 0.1 to 3 $\mu$m as lightsensitive silver halide grains.

Whichever of an emulsion having a broad grain size distribution, namely, a polydisperse emulsion and an emulsion having a narrow grain size distribution, namely, a monodisperse emulsion can be selected and used as the emulsion of the present invention in conformity with the objective. The variation coefficient of the equivalent sphere diameter of volume or the projected area equivalent circle diameter of grains may be used as a scale for the size distribution. In the use of a monodisperse emulsion, it is desirable to employ an emulsion with a size distribution exhibiting such a variation coefficient of up to 25%, preferably, up to 20% and, more preferably, up to 15%.

In an emulsion layer of substantially identical color sensitivity, a plurality of monodisperse silver halide emulsions with different grain sizes may either be mixed into a single layer or laminated into separate layers in order to allow the lightsensitive material to satisfy desired gradation. Moreover, a plurality of polydisperse silver halide emulsions or a combination of monodisperse emulsion and polydisperse emulsion can be used by mixing or laminating.

The silver halide grains for use in the present invention can be provided with at least one of sulfur sensitization, selenium sensitization, gold sensitization, palladium sensitization or other noble metal sensitization and reduction sensitization in any of the steps of the process of producing the silver halide emulsion. Sensitization is preferably performed by a combination of two or more types of these. Various types of emulsions can be prepared depending on in which of the steps the chemical sensitization is carried out. These include the type in which a chemical sensitization nucleus is implanted in an inner portion of the grains, the type in which the implantation is performed in a site shallow from the grain surface and the type in which the chemical sensitization nucleus is set in the grain surface. Although the position of the chemical sensitization nucleus can be selected depending on the object in the emulsion of the present invention, it is generally preferred that at least one type of chemical sensitization nucleus be provided in the vicinity of the grain surface.

The silver halide emulsion for use in the present invention is preferably subjected to a reduction sensitization during the grain formation, after the grain formation but before the chemical sensitization, during the chemical sensitization or after the chemical sensitization. The reduction sensitization can be performed by the method selected from the method in which a reduction sensitizer is added to the silver halide emulsion, the method commonly known as silver ripening in which growth or ripening is carried out in an environment of pAg as low as 1 to 7 and the method commonly known as high-pH ripening in which growth or ripening is carried out in an environment of pH as high as 8 to 11. At least two of these methods can be used in combination.

The above method in which a reduction sensitizer is added is preferred from the viewpoint that the level of reduction sensitization can be finely regulated. Examples of known reduction sensitizers include stannous salts, ascorbic acid and derivatives thereof, amines and polyamino acids, hydrazine derivatives, formamidinesulfinic acid, silane compounds and borane compounds. In the reduction sensitization of the present invention, appropriate one may be selected from these known reduction sensitizers and used or at least two may be selected and used in combination. Preferred reduction sensitizers are stannous chloride, thiourea dioxide, dimethylaminoborane, ascorbic acid and derivatives thereof. Although the addition amount of reduction sensitizer must be selected because it depends on the emulsion manufacturing conditions, it is preferred that the addition amount range from $10^{-7}$ to $10^{-3}$ mol per mol of silver halide.

Each reduction sensitizer is dissolved in water or any of solvents such as alcohols, glycols, ketones, esters and amides and added during the grain growth. Although the reduction sensitizer may be put in a reaction vessel in advance, it is preferred that the addition be effected at an appropriate time during the grain growth. It is also suitable to add in advance the reduction sensitizer to an aqueous solution of a water-soluble silver salt or a water-soluble alkali halide and to precipitate silver halide grains with the use of the resultant aqueous solution. Alternatively, the reduction sensitizer solution may preferably be either divided and added a plurality of times in accordance with the grain growth or continuously added over a prolonged period of time.

Although the silver halide emulsion for red-sensitive layer for use in the present invention is subjected to spectral sensitization using, for example, a methine dye as mentioned above, the emulsion may be doped with a dye which itself exerts no spectral sensitizing effect or a substance which absorbs substantially none of visible radiation and exhibits supersensitization, together with the spectral sensitizing dye.

The emulsion may be doped with the spectral sensitizing dye at any stage of the process for preparing the emulsion which is known as being useful.

Although the doping is most usually conducted at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above compound can be divided prior to addition, that is, part of the compound can be added prior to the chemical sensitization with the rest of the compound added after the chemical sensitization as taught in U.S. Pat. No. 4,225,666. Still further, the spectral sensitizing dye can be added at any stage during the formation of silver halide grains according to the method disclosed in U.S. Pat. No. 4,183,756 and other methods.

The addition amount of the spectral sensitizing dye preferably ranges from $4\times10^{-6}$ to $8\times10^{-3}$ mol per mol of silver halide. When the silver halide grain size is in the preferred range of 0.2 to 1.2 $\mu$m, the addition amount more preferably ranges from approximately $5\times10^{-5}$ to $2\times10^{-3}$ mol per mol of silver halide.

The lightsensitive material of the present invention not only is applicable to a color reversal photographic lightsensitive material but also can be used as a color negative, a color paper, a color reversal paper or the like.

The silver halide photographic lightsensitive material of the present invention is preferably provided with a transparent magnetic recording layer.

The transparent magnetic recording layer is obtained by coating a support with an aqueous or organic solvent coating fluid having magnetic material grains dispersed in a binder.

The magnetic material grains for use in the a present invention can be composed of any of ferromagnetic iron oxides such as $\gamma$ $Fe_2O_3$, Co coated $\gamma$ $Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated $\gamma$ $Fe_2O_3$ are preferred. The configuration thereof may be any of acicular, rice grain, spherical, cubic and plate shapes. The specific area is preferably at least 20 $m^2/g$ and more preferably at least 30 $m^2/g$ in terms of $S_{BET}$.

The saturation magnetization ($\sigma_s$) of the ferromagnetic material preferably ranges from $3.0\times10^4$ to $3.0\times10^5$ A/m, more preferably, from $4.0\times10^4$ to $2.5\times10^5$ A/m. The ferromagnetic material grains may have their surface treated with silica and/or alumina or an organic material. Further, the magnetic material grains may have their surface treated with a silane coupling agent or a titanium coupling agent as described in JP-A-6-161032. Still further, use can be made of magnetic material grains having their surface coated with an organic or inorganic material as described in JP-A-4-259911 and JP-A-5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 0.2 ten thousand to 1 million. For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred. The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyhydric alcohols (e.g., reaction product of 3 mol of tolylene diisocyanate and 1 mol of trimethylolpropane) and polyisocyanates produced by condensation of these isocyanates, as described in, for example, JP-A-6-59357.

The above magnetic material is preferably dispersed in the above binder by the method described in JP-A-6-35092 in which a kneader, a pin type mill and an annular type mill are used either individually or in combination. Dispersants listed in JP-A-5-088283 and other common dispersants can be used. The thickness of the magnetic recording layer generally ranges from 0.1 to 10 $\mu$m, preferably, 0.2 to 5 $\mu$m and more preferably from 0.3 to 3 $\mu$m. The weight ratio of magnetic material grains to binder is preferably in the range of 0.5:100 to 60:100 and more preferably 1:100 to 30:100. The coating amount of magnetic material grains ranges from 0.005 to 3 $g/m^2$, preferably, from 0.01 to 2 $g/m^2$ and more preferably from 0.02 to 0.5 $g/m^2$. The transmission yellow density of the magnetic recording layer is preferably in the range of 0.01 to 0.50, more preferably, 0.03 to 0.20 and, most preferably, 0.04 to 0.15. The magnetic recording layer for use in the present invention can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating fluids set forth in JP-A-5-341436 are preferably used.

The magnetic recording layer may also be provided with lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as the magnetic recording layer binder. The lightsensitive material having the magnetic recording layer is described in U.S. Pat. No. 5,336,589, U.S. Pat. No. 5,250,404, U.S. Pat. No. 5,229,259, U.S. Pat. No. 5,215,874 and EP 466,130.

The polyester support preferably employed in the lightsensitive material of the present invention when the magnetic recording layer is arranged will be described below. Particulars thereof together with the below mentioned lightsensitive material, processing, cartridge and working examples are specified in JIII Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol % are especially preferred. Polyethylene 2,6-naphthalate is most preferred. The average molecular weight thereof ranges from approximately 5,000 to 200,000. The Tg of the polyester of the present invention is at least 50° C., preferably, at least 90° C.

The polyester support is subjected to heat treatment at a temperature of 40° C. to less than Tg, preferably, Tg minus 20° C. to less than Tg in order to suppress curling. This heat treatment may be conducted at a temperature held constant within the above temperature range or may be conducted while cooling. The period of heat treatment ranges from 0.1 to 1500 hr, preferably, 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent oral lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

In the lightsensitive material of the present invention in which the magnetic recording layer is used, a surface treatment is preferably conducted for bonding a support and a lightsensitive material constituting layer to each other. The surface treatment is, for example, a surface activating treatment such as chemical treatment, mechanical treatment, corona discharge treatment, flame treatment, ultraviolet treatment, high frequency treatment, glow discharge treatment, active plasma treatment, laser treatment, mixed acid treatment or ozone oxidation treatment. Of these surface treatments, ultraviolet irradiation treatment, flame treatment, corona treatment and glow treatment are preferred.

The undercoating method will be described below. The undercoating may be composed of either a single layer or at least two layers. Use is made of an undercoating layer binder of, for example, a copolymer prepared from monomers as starting materials selected from vinyl chloride, vinylidene chloride, butadiene, methacrylic acid, acrylic acid, itaconic acid and maleic anhydride, polyethyleneimine, an epoxy resin, a grafted gelatin, nitrocellulose or gelatin. Resorcin or p-chlorophenol is used as a support swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-S-triazine), an epichlorohydrin resin or an active vinyl sulfone compound can be used in the undercoating layer. Also, $SiO_2$, $TiO_2$, inorganic fine grains or polymethyl methacrylate copolymer fine grains (0.01 to 10 $\mu$m) may be incorporated therein as a matting agent.

An antistatic agent is preferably used in the lightsensitive material of the present invention in which the magnetic recording layer is employed. Examples of suitable antistatic agents include carboxylic acids and carboxylic salts, sulfonic salt containing polymers, cationic polymers and ionic surfactant compounds.

Most preferred as the antistatic agent are fine grains of at least one crystalline metal oxide selected from ZnO, $TiO_2$, $SnO_2$, $Al_2O_3$, $In_2O_3$, $SiO_2$, MgO, BaO, $MoO_3$ and $V_2O_5$ having a volume resistivity of $10^7$ Ω cm or less, preferably, $10^5$ Ω cm or less and having a grain size of 0.001 to 1.0 $\mu$m or a composite oxide thereof (e.g., Sb, P, B, In, S, Si and C) and fine grains of sol form metal oxides or composite oxides thereof.

The content thereof in the lightsensitive material is preferably in the range of 5 to 500 mg/$m^2$, more preferably, 10 to 350 mg/$m^2$. The ratio of amount of conductive crystalline oxide or composite oxide thereof to binder is preferably in the range of 1/300 to 100/1, more preferably, 1/100 to 100/5.

It is preferred that the lightsensitive material of the present invention have lubricity. The lubricant containing layer is preferably provided on both the lightsensitive layer side and the back side. Preferred lubricity ranges from 0.25 to 0.01 in terms of dynamic friction coefficient. The measured lubricity is a value obtained by conducting a carriage on a stainless steel ball of 5 mm in diameter at 60 cm/min (25° C., 60% RH). In this evaluation, value of approximately the same level is obtained even when the opposite material is replaced by the lightsensitive layer side.

The lubricant which can be used in the present invention is, for example, a polyorganosiloxane, a higher fatty acid amide, a higher fatty acid metal salt and an ester of higher fatty acid and higher alcohol. Examples of suitable polyorganosiloxanes include polydimethylsiloxane, polydiethylsiloxane, polystyrylmethylsiloxane and polymethylphenylsiloxane. The lubricant is preferably added to the back layer or the outermost layer of the emulsion layer. Especially, polydimethylsiloxane and an ester having a long chain alkyl group are preferred.

A matting agent is preferably used in the lightsensitive material of the present invention employing the magnetic recording layer. Although the matting agent may be used on the emulsion side or the back side indiscriminately, it is especially preferred that the matting agent be added to the outermost layer of the emulsion side. The matting agent may be soluble in the processing solution or insoluble in the processing solution, and it is preferred to use the soluble and insoluble matting agents in combination. For example, polymethyl methacrylate, poly(methyl methacrylate/methacrylic acid) (9/1 or 5/5 in molar ratio) and polystyrene grains are preferred. The grain size thereof preferably ranges from 0.8 to 10 $\mu$m. Narrow grain size distribution thereof is preferred, and it is desired that at least 90% of the whole number of grains be included in the range of 0.9 to 1.1 times the average grain size. Moreover, for enhancing the mat properties, it is preferred that fine grains of 0.8 $\mu$m or less be simultaneously added, which include, for example, fine grains of polymethyl methacrylate (0.2 $\mu$m), poly(methyl methacrylate/methacrylic acid) (9/1 in molar ratio, 0.3 $\mu$m), polystyrene grains (0.25/$\mu$m) and colloidal silica (0.03 $\mu$m).

The film patrone preferably employed in the present invention will be described below. The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably further contain, for example, carbon black, metal oxide grains, nonionic, anionic, cationic or betaine type surfactants and polymers. Such an antistatic patrone is described in JP-A-1-312537 and JP-A-1-312538. The resistance thereof at 25° C. in 25% RH is preferably $10^{12}$ Ω or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 $cm^3$ or less, more preferably, 25 $cm^3$ or less. The weight of the plastic used in each patrone or patrone case preferably ranges from 5 to 15 g.

The patrone for use in the present invention may be one capable of feeding a film out by rotating a spool. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. No. 4,834,306 and U.S. Pat. No. 5,226,613. The photographic film for use in the present invention may be a generally so termed raw stock having not yet been developed or a developed photographic film. The raw stock and the developed photographic film may be accommodated in the same new patrone or in different patrones.

The color photographic lightsensitive material of the present invention is suitably used as a negative film for Advanced Photo System (hereinafter referred to as "AP system"). It is, for example, one obtained by working the film into AP system format and accommodating the same in a special purpose cartridge, such as NEXIA A, NEXIA F or NEXIA H (sequentially, ISO 200/100/400) produced by Fuji Photo Film Co., Ltd. (hereinafter referred to as "Fuji Film"). This cartridge film for AP system is charged in a camera for AP system such as Epion series, e.g., Epion 300Z, produced by Fuji Film and put to practical use. Moreover, the color photographic lightsensitive material of the present invention is suitable to a film with lens such as Fuji Color Uturundesu (or Snapshot) Super Slim produced by Fuji Film.

The thus photographed film is printed through the following steps in a minilabo system:

(1) acceptance (receiving an exposed cartridge film from a customer), (2) detaching (transferring the film from the above cartridge to an intermediate cartridge for development), (3) film development, (4) rear touching (returning the developed negative film to the original cartridge), (5) printing (continuous automatic printing of C/H/P three type print and index print on color paper (preferably, Super FA8 produced by Fuji Film)), and (6) collation and delivery (collating the cartridge and index print with ID number and delivering the same with prints).

The above system is, preferably, Fuji Film Minilabo Champion Super FA-298/FA-278/FA-258/FA-238 or Fuji Film Digital Labo System Frontier. Film processor of the Minilabo Champion is, for example, FP922AL/FP562B/FP562B, AL/FP362B/FP3622B, AL, and recommended processing chemical is Fuji Color Just It CN-16L or CN-16Q. Printer processor is, for example, PP3008AR/PP3008A/PPI828AR/PP1828A/PP1258AR/PP1258A/PP-728AR/PP728A, and recommended processing chemical thereof is Fuji Color Just It CP-47L or CP-40FAII. In the Frontier System, use is made of scanner & image processor SP-1000 and laser printer & paper processor LP-1000P or Laser Printer LP-1000W. Fuji Film DT200/DT100 and AT200/AT100 are preferably used as detacher in the detaching step and as rear toucher in the rear touching step, respectively.

The AP system can be enjoyed by photo joy system whose center unit is Fuji Film digital image work station Aladdin 1000. For example, developed AP system cartridge film is directly charged in Aladdin 1000, or negative film, positive film or print image information is inputted with the use of 35 mm film scanner FE-550 or flat head scanner PE-550 therein, and obtained digital image data can easily be worked and edited. The resultant data can be outputted as prints by current labo equipment, for example, by means of digital color printer NC-550AL based on photofixing type thermal color printing system or Pictography 3000 based on laser exposure thermal development transfer system or through a film recorder. Moreover, Aladdin 1000 is capable of directly outputting digital information to a floppy disk or Zip disk or outputting it through a CD writer to CD-R.

On the other hand, at home, photography can be enjoyed on TV only by charging the developed AP system cartridge film in photoplayer AP-1 manufactured by Fuji Film. Charging it in Photoscanner AS-1 manufactured by Fuji Film enables continuously feeding image information into a personal computer at a high velocity. Further, Photovision FV-10/FV-5 manufactured by Fuji Film can be utilized for inputting a film, print or three-dimensional object in the personal computer. Still further, image information recorded on a floppy disk, Zip disk, CD-R or a hard disk can be enjoyed by conducting various workings on the personal computer by the use of Fuji Film Application Soft Photofactory. Digital color printer NC-2/NC-2D based on photofixing type thermal color printing system, manufactured by Fuji Film, is suitable for outputting high-quality prints from the personal computer.

Fuji Color Pocket Album AP-5 Pop L, AP-1 Pop L or AP-1 Pop KG or Cartridge File 16 is preferably employed for storing the developed AP system cartridge film.

With respect to the silver halide photographic emulsion which can be used in the present invention and the various techniques and organic and inorganic materials which can be employed in the silver halide photographic lightsensitive material of the present invention, use can generally be made of those described in Research Disclosure No. 308119 (1989) and No. 37038 (1995).

In addition, specifically, for example, techniques and organic and inorganic materials which can be used in the color photographic lightsensitive material of the present invention are described in the following portions of EP 436,938A2 and the patents cited below, the disclosures of all the references are herein incorporated by reference.

(item: appropriate portions)

1. Layer structure: page 146, line 34 to page 147, line 25
2. Silver halide emulsion usable in combination: page 147, line 26 to page 148 to line 12
3. Yellow coupler usable in combination: page 137, line 35 to page 146, line 33 and page 149, lines 21 to 23
4. Magenta coupler usable in combination: page 149, lines 24 to 28; EP 421,453A1, page 3, line 5 to page 25, line 55
5. Cyan coupler usable in combination: page 149, lines 29 to 33; EP 432,804A2, page 3, line 28 to page 40, line 2
6. Polymer coupler: page 149, lines 34 to 38; EP 435,334A2, page 113, line 39 to page 123, line 37
7. Colored coupler: page 53, line 42 to page 137, line 34 and page 149, lines 39 to 45
8. Other functional couplers usable in combination: page 7, line 1 to page 53, line 41 and page 149, line 46 to page 150, line 3; EP 435,334A2, page 3, line 1 to page 29, line 50

9. Antiseptic and mildewproofing agents: page 150, lines 25 to 28
10. Formalin scavenger: page 149, lines 15 to 17
11. Other additives usable in combination: page 153, lines 38 to 47; EP 421,453A1, page 75, line 21 to page 84, line 56 and page 27, line 40 to page 37, line 40
12. Dispersion method: page 150, lines 4 to 24
13. Support: page 150, lines 32 to 34
14. Thickness/properties of film: page 150, lines 35 to 49
15. Color development: page 150, line 50 to page 151, line 47
16. Desilvering: page 151, line 48 to page 152, line 53
17. Automatic processor: page 152, line 54 to page 153, line 2
18. Washing with water/stabilization: page 153, lines 3 to 37.

EXAMPLES

Example 1

The present invention will be described in more detail below by way of its examples. However, the present invention is not limited to these examples as long as the invention does not depart from the gist of the invention.

Preparation of sample 101

A multilayered color lightsensitive material comprising a support of 127 μm-thick undercoated cellulose triacetate film and, superimposed thereon, layers of the following compositions was prepared and designated sample 101. The value indicates the addition amount per square meter. The effects of added compound are not limited to described use.

| | |
|---|---|
| 1st layer (antihalation layer) | |
| black colloidal silver | 0.15 g |
| gelatin | 2.00 g |
| ultraviolet absorbent U-1 | 0.15 g |
| ultraviolet absorbent U-3 | 0.045 g |
| ultraviolet absorbent U-4 | 0.15 g |
| high b.p. org. solvent Oil-1 | 0.15 g |
| microcrystalline solid dispersion of dye E-1 | 0.10 g |
| 2nd layer (interlayer) | |
| gelatin | 0.50 g |
| compound Cpd-A | 5.0 mg |
| high b.p. org. solvent Oil-3 | 0.05 g |
| dye D-4 | 0.90 mg |
| 3rd layer (interlayer) | |
| surface and interior fogged fine grain silver iodobromide emulsion (av. grain size 0.06 μm, var. coeff. 18%, AgI cont. 1 mol %) | Ag qty. 0.030 g |
| yellow colloidal silver | Ag qty. 0.050 g |
| gelatin | 0.50 g |
| high b.p. org. solvent Oil-3 | 0.05 g |
| 4th layer (low-speed red-sensitive emulsion layer) | |
| emulsion A | Ag qty. 0.35 g |
| emulsion B | Ag qty. 0.35 g |
| gelatin | 0.80 g |
| coupler C-1 | 0.20 g |
| coupler C-6 | 0.03 g |
| Compound Cpd-C | 5.0 mg |
| high b.p. org. solvent Oil-2 | 0.08 g |
| additive P-1 | 0.10 g |
| 5th layer (medium-speed red-sensitive emulsion layer) | |
| emulsion B | Ag qty. 0.25 g |
| emulsion C | Ag qty. 0.25 g |

-continued

| | |
|---|---|
| gelatin | 0.80 g |
| coupler C-1 | 0.30 g |
| high b.p. org. solvent Oil-2 | 0.10 g |
| additive P-1 | 0.10 g |
| 6th layer (high-speed red-sensitive emulsion layer) | |
| emulsion D | Ag qty. 0.55 g |
| gelatin | 1.50 g |
| coupler C-1 | 1.00 g |
| high b.p. org. solvent Oil-2 | 0.45 g |
| high b.p. org. solvent Oil-4 | 0.05 g |
| additive P-1 | 0.10 g |
| 7th layer (interlayer) | |
| gelatin | 0.70 g |
| additive M-1 | 0.30 g |
| compound Cpd-I | 2.6 mg |
| dye D-5 | 0.020 g |
| dye D-6 | 0.010 g |
| high b.p. org. solvent Oil-3 | 0.10 g |
| 8th layer (interlayer) | |
| surface and interior fogged fine grain silver iodobromide emulsion (av. grain size 0.06 μm, var. coeff. 18%, AgI cont. 1 mol %) | Ag qty. 0.010 g |
| yellow colloidal silver | Ag qty. 0.020 g |
| gelatin | 1.00 g |
| additive P-1 | 0.05 g |
| Cpd-J | 0.10 g |
| color mixing inhibitor Cpd-C | 0.15 g |
| high b.p. org. solvent Oil-3 | 0.20 g |
| 9th layer (low-speed green-sensitive emulsion layer) | |
| emulsion E | Ag qty. 0.30 g |
| emulsion F | Ag qty. 0.25 g |
| emulsion G | Ag qty. 0.25 g |
| gelatin | 1.20 g |
| coupler C-5 | 0.25 g |
| compound Cpd-B | 0.030 g |
| compound Cpd-D | 0.010 g |
| compound Cpd-E | 0.020 g |
| compound Cpd-F | 0.040 g |
| compound Cpd-K | 0.02 g |
| high b.p. org. solvent Oil-1 | 0.02 g |
| high b.p. org. solvent Oil-2 | 0.10 g |
| 10th layer (medium-speed green-sensitive emulsion layer) | |
| emulsion G | Ag qty. 0.25 g |
| emulsion H | Ag qty. 0.25 g |
| gelatin | 0.70 g |
| coupler C-2 | 0.35 g |
| compound Cpd-B | 0.030 g |
| compound Cpd-D | 0.010 g |
| compound Cpd-E | 0.020 g |
| compound Cpd-F | 0.050 g |
| high b.p. org. solvent Oil-2 | 0.010 g |
| 11th layer (high-speed green-sensitive emulsion layer) | |
| emulsion I | Ag qty. 0.45 g |
| gelatin | 1.00 g |
| coupler C-2 | 0.50 g |
| compound Cpd-B | 0.080 g |
| compound Cpd-E | 0.020 g |
| compound Cpd-F | 0.040 g |
| high b.p. org. solvent Oil-1 | 0.020 g |
| high b.p. org. solvent Oil-2 | 0.020 g |
| 12th layer (interlayer) | |
| gelatin | 0.40 g |
| compound Cpd-K | 0.05 g |
| formalin scavenger Cpd-H | 0.20 g |
| high b.p. org. solvent Oil-1 | 0.05 g |
| 13th layer (yellow filter layer) | |
| yellow colloidal silver | Ag qty. 0.010 g |
| gelatin | 1.00 g |

-continued

| | |
|---|---|
| color mixing inhibitor Cpd-A | 0.10 g |
| high b.p. org. solvent Oil-3 | 0.05 g |
| microcrystalline solid dispersion of dye E-2 | 0.030 g |
| microcrystalline solid dispersion of dye E-3 | 0.020 g |
| 14th layer (interlayer) | |
| gelatin | 0.70 g |
| 15th layer (low-speed blue-sensitive emulsion layer) | |
| emulsion J | Ag qty. 0.35 g |
| emulsion K | Ag qty. 0.25 g |
| gelatin | 0.80 g |
| coupler C-3 | 0.20 g |
| coupler C-4 | 0.05 g |
| coupler C-7 | 0.35 g |
| compound Cpd-I | 0.02 g |
| 16th layer (medium-speed blue-sensitive emulsion layer) | |
| emulsion L | Ag qty. 0.30 g |
| emulsion M | Ag qty. 0.25 g |
| gelatin | 0.90 g |
| coupler C-3 | 0.15 g |
| coupler C-4 | 0.05 g |
| coupler C-7 | 0.45 g |
| 17th layer (high-speed blue-sensitive emulsion layer) | |
| emulsion N | Ag qty. 0.20 g |
| emulsion O | Ag qty. 0.20 g |
| gelatin | 1. 30 g |
| coupler C-3 | 0.10 g |
| coupler C-4 | 0.15 g |
| coupler C-7 | 0.70 g |
| high b.p. org. solvent Oil-2 | 0.10 g |
| 18th layer (1st protective layer) | |
| gelatin | 0.60 g |
| ultraviolet absorbent U-1 | 0.30 g |
| ultraviolet absorbent U-2 | 0.050 g |
| ultraviolet absorbent U-5 | 0.35 g |
| color mixing inhibitor Cpd-A | 0.10 g |
| formalin scavenger Cpd-H | 0.45 g |
| dye D-1 | 0.15 g |
| dye D-2 | 0.050 g |
| dye D-3 | 0.10 g |
| high b.p. org. solvent Oil-3 | 0.10 g |
| 19th layer (2nd protective layer) | |
| yellow colloidal silver | Ag qty. 0.10 mg |
| fine grain silver iodobromide emulsion (av. grain size 0.06 μm, AgI cont. 1 mol %) | Ag qty. 0.11 g |
| gelatin | 0.35 g |
| 20th layer (3rd protective layer) | |
| gelatin | 0.45 g |
| polymethyl methacrylate (av. grain size 2.0 μm) | 0.10 g |
| methyl methacrylate/methacrylic acid 6:4 copolymer (av. grain size 1.5 μm) | 0.10 g |
| silicone oil SO-1 | 0.060 g |
| surfactant W-1 | 3.0 mg |
| surfactant W-2 | 0.030 g |

All the above emulsion layers were doped with additives F-1 to F-6 in addition to the above components, and, further, each of the layers were doped with gelatin hardener H-1 and surfactants for emulsification and coating W-3, W-4, W-5 and W-6 in addition to the above components.

Moreover, phenol, 1,2-benzisothiazolin-3-one, 2-phenoxyethanol, phenethyl alcohol and butyl p-hydroxybenzoate were added as antiseptic and mildew-proofing agents.

The characteristics of the emulsions and compound used are specified below.

TABLE 1

Silver bromoiodide emulsions used in Sample 101 are as follows

| Emulsion | characteristics of grains | Average equivalent spherical diameter (μm) | Coefficient of variation (%) | AgI content (%) |
|---|---|---|---|---|
| A | Monodisperse tetradecahedral grains | 0.25 | 14 | 4.2 |
| B | Monodisperse cubic internally fogged grains | 0.28 | 10 | 4.2 |
| C | Monodisperse cubic grains | 0.36 | 10 | 5.0 |
| D | Monodisperse tabular grains Av.asp.rt[1].:3.0 | 0.60 | 8 | 1.8 |
| E | Monodisperse cubic grains | 0.20 | 17 | 4.0 |
| F | Monodisperse tetradecahedral grains | 0.23 | 15 | 3.6 |
| G | Monodisperse cubic internally fogged grains | 0.37 | 11 | 3.5 |
| H | Monbodisperse cubic grains | 0.50 | 9 | 3.5 |
| I | Monodisperse tabular grains Av.asp.rt[1].:5.0 | 0.75 | 10 | 1.8 |
| J | Monodisperse cubic grains | 0.27 | 16 | 4.0 |
| K | Monodisperse tetradecahedral grains | 0.45 | 17 | 4.0 |
| L | Monodisperse tabular grains Av.asp.rt[1].:5.0 | 0.50 | 10 | 2.0 |
| M | Monodisperse tabular grains Av.asp.rt[1].:8.0 | 0.65 | 13 | 1.8 |
| N | Monodisperse tabular grains Av.asp.rt[1].:6.0 | 1.05 | 10 | 1.5 |
| O | Monodisperse tabular grains Av.asp.rt[1].:9.0 | 1.20 | 15 | 1.5 |

note)Av. asp. rt. signifies average aspect rati0.

TABLE 2

Spectral sensitization of emulsions A to O

| Emulsion | Spectral Sensitizers added | Addition amount per mol of silver halide (g) |
|---|---|---|
| A | S-2 | 0.020 |
| | S-3 | 0.25 |
| | S-8 | 0.013 |
| B | S-1 | 0.012 |
| | S-3 | 0.25 |
| | S-8 | 0.008 |
| C | S-1 | 0.010 |
| | S-2 | 0.010 |
| | S-3 | 0.25 |
| | S-8 | 0.010 |
| D | S-2 | 0.012 |
| | S-3 | 0.10 |
| | S-8 | 0.008 |
| E | S-4 | 0.48 |
| | S-5 | 0.14 |
| F | S-4 | 0.30 |
| | S-5 | 0.10 |
| G | S-4 | 0.23 |
| | S-5 | 0.08 |
| | S-9 | 0.07 |
| H | S-4 | 0.20 |
| | S-5 | 0.060 |
| | S-9 | 0.050 |
| I | S-4 | 0.30 |
| | S-5 | 0.070 |
| | S-9 | 0.12 |
| J | S-6 | 0.050 |
| | S-7 | 0.22 |

TABLE 2-continued

Spectral sensitization of emulsions A to O

| Emulsion | Spectral Sensitizers added | Addition amount per mol of silver halide (g) |
|---|---|---|
| K | S-6 | 0.05 |
| | S-7 | 0.22 |
| L | S-6 | 0.060 |
| | S-7 | 0.24 |
| M | S-6 | 0.050 |
| | S-7 | 0.19 |

TABLE 2-continued

Spectral sensitization of emulsions A to O

| Emulsion | Spectral Sensitizers added | Addition amount per mol of silver halide (g) |
|---|---|---|
| N | S-6 | 0.040 |
| | S-7 | 0.17 |
| O | S-6 | 0.060 |
| | S-7 | 0.22 |

C-1

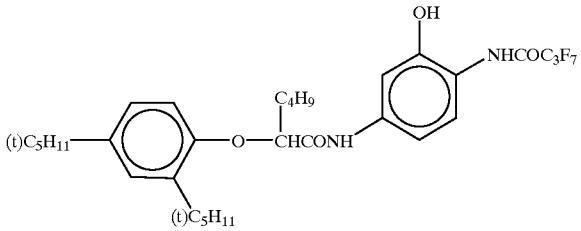

C-2

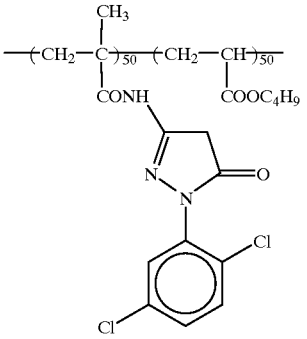

The numbers signify weight %
Average molecular weight: about 25,000

C-3

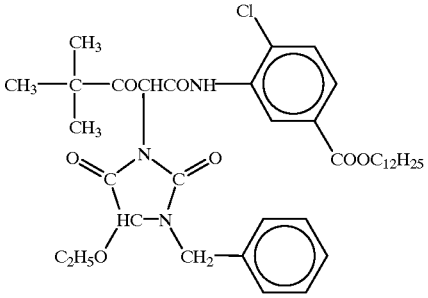

C-4

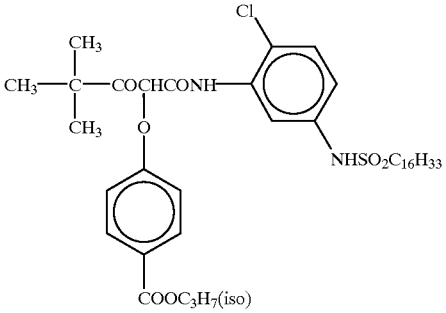

C-5

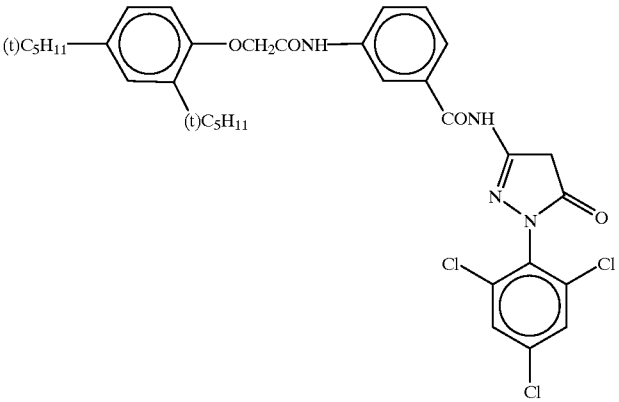

-continued
C-6
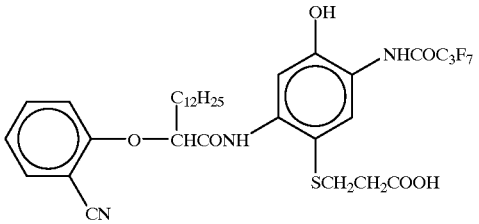
C-7
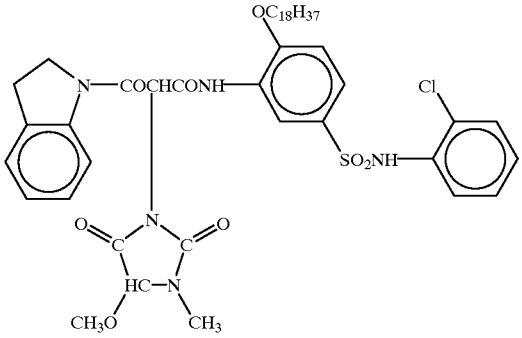
Oil-1
Dibutyl phthalate
Oil-2
Tricresyl phosphate
Oil-3
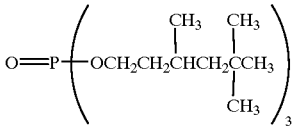
Oil-4
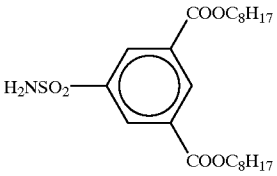
Cpd-A
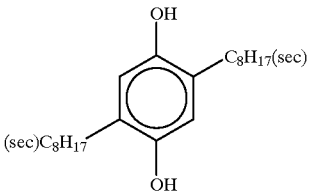
Cpd-B
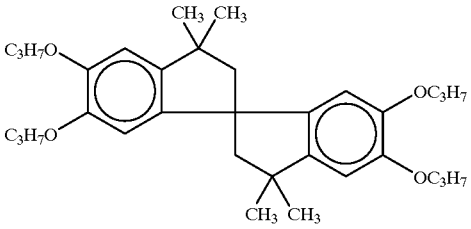
Cpd-C
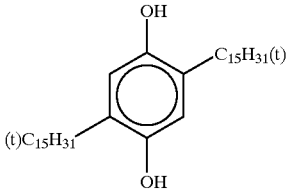
Cpd-D
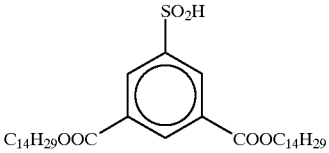
Cpd-E
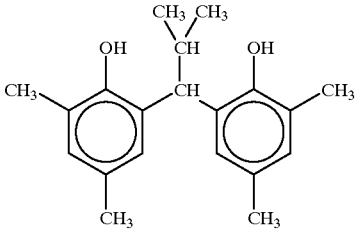
Cpd-F
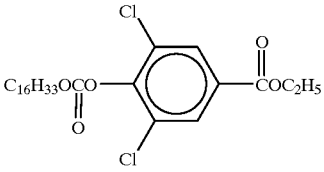

-continued
Cpd-H
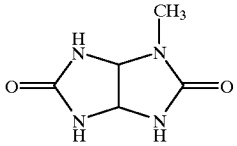
Cpd-I
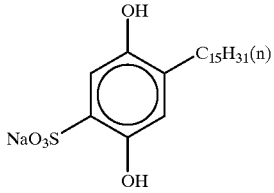
Cpd-J
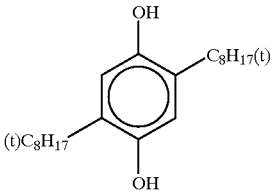
Cpd-K
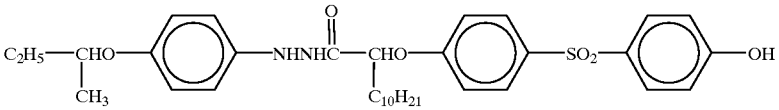
U-1
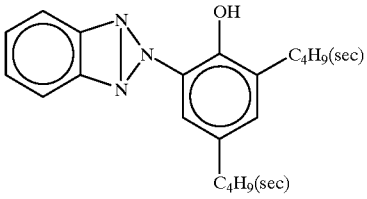
U-2
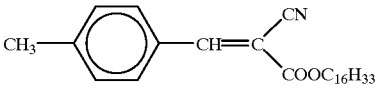
U-3
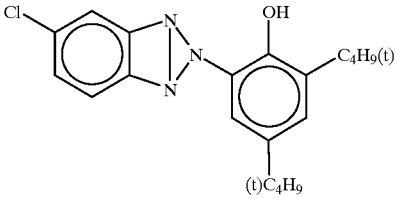
U-4
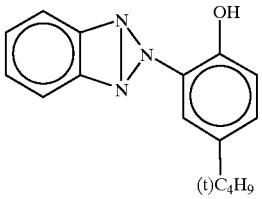
U-5
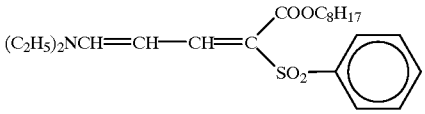
S-1
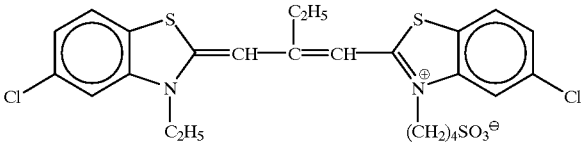
S-2
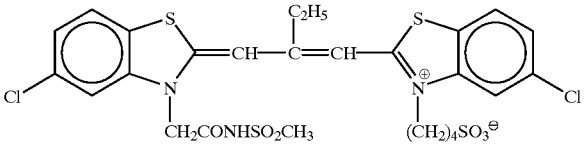

-continued
S-3
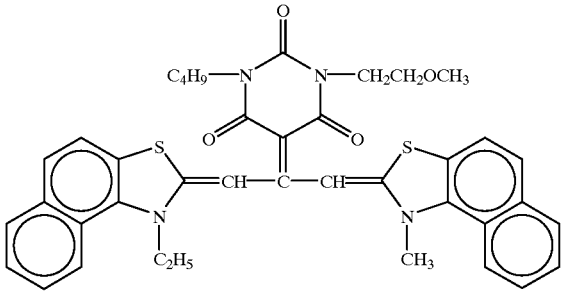
S-4
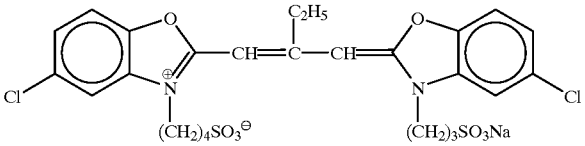
S-5
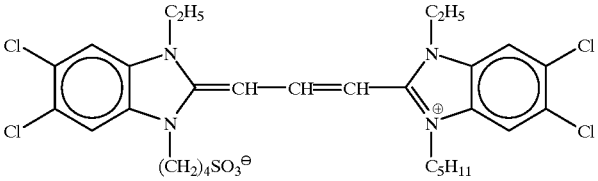
S-6
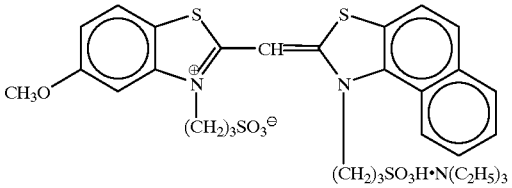
S-7
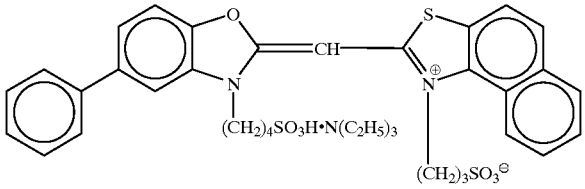
S-8
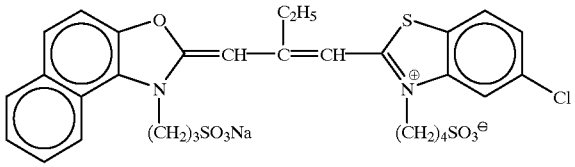
S-9
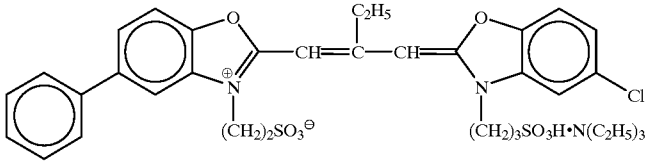

-continued
D-1
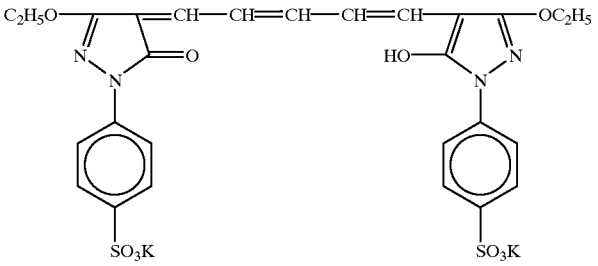
D-2
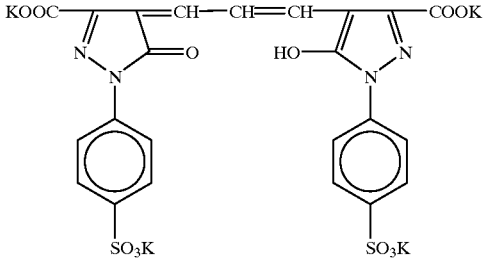
D-3
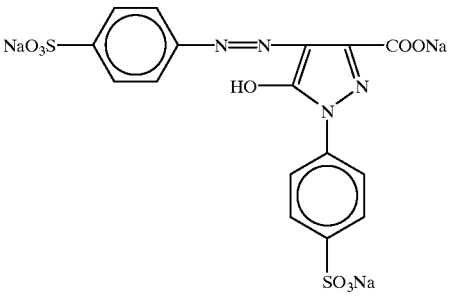
D-4
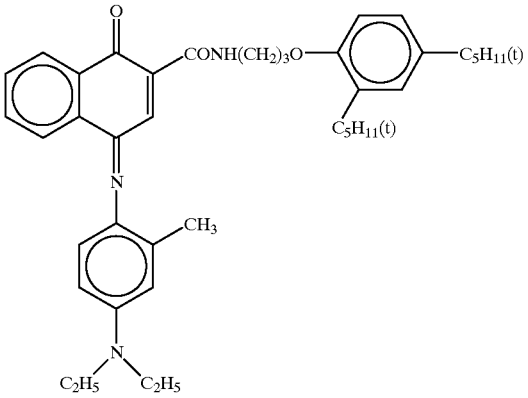
D-5
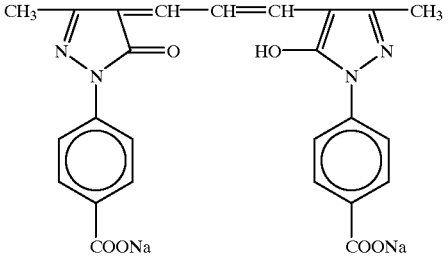
D-6
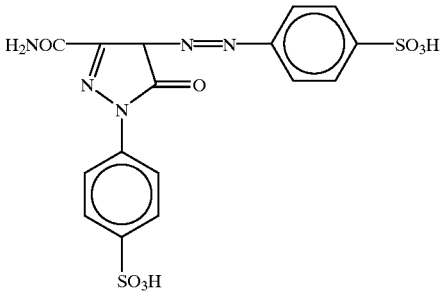
E-1
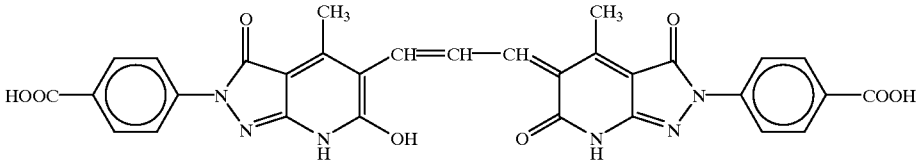

-continued
E-2
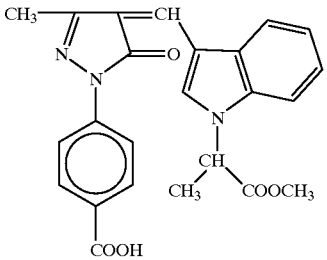
E-3
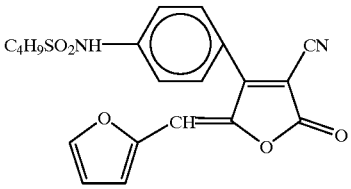
H-1
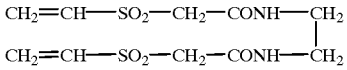
W-1
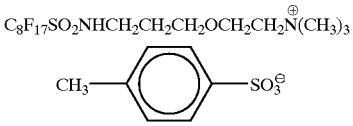
W-2
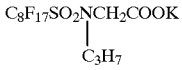
W-3
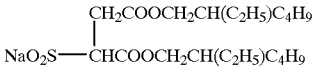
W-4
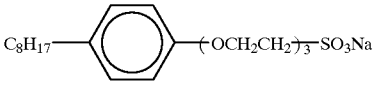
W-5
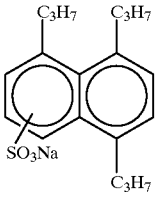
W-6
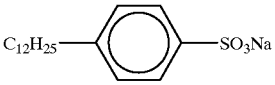
P-1
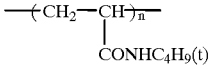
(n = 100–1000)
M-1
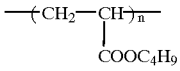
(n = 100–1000)
SO-1
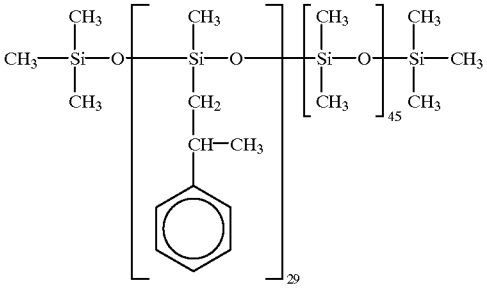
The numbers signify molar ratio
F-1
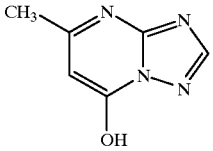
F-2
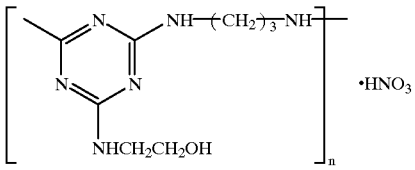
(n = 3–4)

-continued

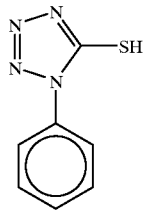

F-3

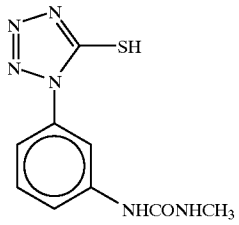

F-4

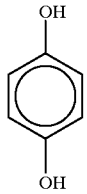

F-5

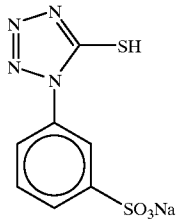

F-6

Preparation of dispersion of organic solid disperse dye:

Dye E-1 was dispersed by the following method. Illustratively, water and 180 g of Pluronic F88 (trade name for ethylene oxide/propylene oxide block copolymer) produced by BASF were added to 1430 g of dye wet cake containing 30% of methanol and agitated, thereby obtaining a slurry having a dye content of 6%. 1700 mL of zirconia beads having an average grain size of 0.5 mm were charged into Ultraviscomill (UVM-2) manufactured by Aimex Co., Ltd. and the slurry was milled at a peripheral speed of about 12 m/sec and a delivery of 0.5 L/min for 9 hr. The beads were removed by filtration and the slurry was diluted with water into a dye content of 3%. The dilution was heated at 90° C. for 10 hr for stabilization. The obtained dye fine grains had an average grain size of 0.55 μm and a grain size distribution breadth (standard deviation of grain sizes×100/average grain size) of 18%.

Solid dispersions of dyes E-2 and E-3 were obtained in the same manner. The average grain sizes thereof were 0.50 μm and 0.48 μm, respectively.

The coupler C-1 of each of the fourth layer, fifth layer and sixth layer of the thus obtained sample 101 was replaced by the coupler specified in Table 3 below. In the replacement, the amount was such that the cyan maximum density was the same as in sample 101, and the molar ratio of the fourth layer, fifth layer and sixth layer was the same as in sample 101. Further, the coupler C-5 of the ninth layer and the coupler C-2 of each of the tenth layer and eleventh layer were replaced as specified in Table 3 below. The coupler replacement was carried out in a molar ratio of 0.6 for the replacement of coupler C-5 and a molar ratio of 0.65 for the replacement coupler C-2. High-boiling-point organic solvent Oil-2 was added in an amount of 0.5 g per gram of each replacement coupler. Thus, samples 102 to 117 were produced.

TABLE 3

Constitution of Samples

| Sample | Magenta coupler | | | Cyan coupler | | |
|---|---|---|---|---|---|---|
| | 4th layer | 5th layer | 6th layer | 9th layer | 10th layer | 11th layer |
| 101 Comp | As described in the text above | | | | | |
| 102 Comp | Comparative coupler (A) | Comparative coupler (A) | Comparative coupler (A) | Same as sample 101 | Same as sample 101 | Same as sample 101 |
| 103 Comp | Comparative coupler (C) | Comparative coupler (C) | Comparative coupler (C) | Same as sample 101 | Same as sample 101 | Same as sample 101 |
| 104 Comp | Comparative coupler (A) | Comparative coupler (A) | Comparative coupler (A) | CB-8 | CB-8 | CB-8 |
| 105 Comp | Comparative coupler (C) | Comparative coupler (C) | Comparative coupler (C) | CC-1 | CC-1 | CC-1 |
| 106 Comp | Same as sample 101 | Same as sample 101 | Same as sample 101 | CC-1 | CC-1 | CC-1 |
| 107 Comp | Same as sample 101 | Same as sample 101 | Same as sample 101 | CB-8 | CB-8 | CB-8 |
| 108 Comp | Comparative coupler (A) | Comparative coupler (A) | Comparative coupler (A) | Comparative coupler (B) | Comparative coupler (B) | Comparative coupler (B) |
| 109 Comp | CA-2 | CA-2 | CA-2 | Comparative coupler (B) | Comparative coupler (B) | Comparative coupler (B) |
| 110 Inv | CA-1 | CA-1 | CA-1 | CB-8 | CB-8 | CB-8 |
| 111 Inv | CA-2 | CA-2 | CA-2 | CB-8 | CB-8 | CB-8 |
| 112 Inv | CA-3 | CA-3 | CA-3 | CB-8 | CB-8 | CB-8 |
| 113 Inv | CA-4 | CA-4 | CA-4 | CB-8 | CB-8 | Same as sample 101 |

TABLE 3-continued

| Sample | Constitution of Samples | | | | | |
|---|---|---|---|---|---|---|
| | Magenta coupler | | | Cyan coupler | | |
| | 4th layer | 5th layer | 6th layer | 9th layer | 10th layer | 11th layer |
| 114 Inv | CA-7 | CA-7 | CA-7 | CC-1 | CC-1 | CC-1 |
| 115 Inv | CA-2 | CA-18 | CA-18 | CB-34 | CB-34 | CB-34 |
| 116 Inv | CA-55 | CA-55 | Same as sample 101 | CC-25 | CC-25 | CC-25 |
| 117 Inv | CA-18 | CA-18 | CA-18 | CC-17 | CC-17 | CC-17 |

Comparative coupler (A)

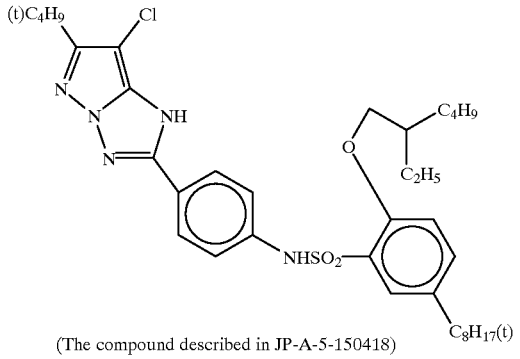

(The compound described in JP-A-5-150418)

Comparative coupler (B)

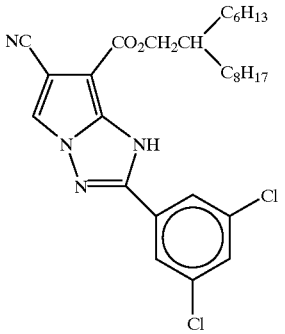

(The compound described in JP-A-5-150418)

Comparative coupler (C)

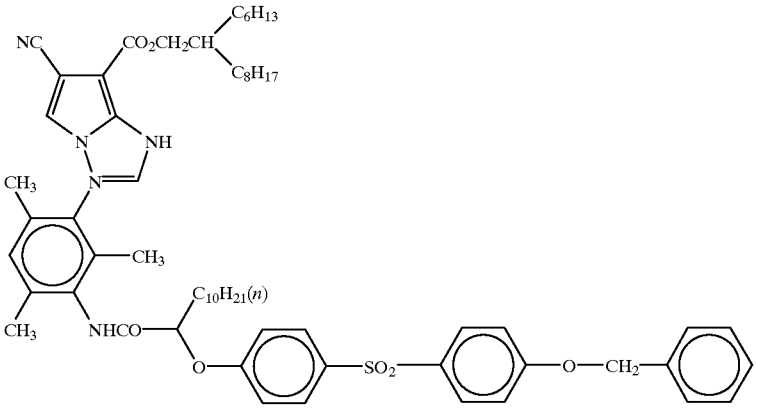

(Coupler M-1 described in JP-A-4-37747)

In this Example, the following development processing was conducted. In the processing, samples 101 and 117 having 50% thereof completely exposed to white light were passed until the quantity of replenisher became three times the tank volume, and then started the processing. In the following description, "L" means liter and "mL" means milliliter.

| Step | Time (min) | Temp. ° C. | Tank Vol. (L.) | Replenishment rate (mL/m$^2$) |
|---|---|---|---|---|
| 1st. development | 6 | 38 | 12 | 2200 |
| 1st water washing | 2 | 38 | 4 | 7500 |
| reversal | 2 | 38 | 4 | 1100 |
| color development | 6 | 38 | 12 | 2200 |
| prebleaching | 2 | 38 | 4 | 1100 |
| bleaching | 6 | 38 | 12 | 220 |
| fixing | 4 | 38 | 8 | 1100 |
| 2nd water washing | 4 | 38 | 8 | 7500 |
| final rinse | 1 | 25 | 2 | 1100 |

The composition of each processing solution was as follows.

| (1st development solution) | Tank soln. | Replenisher |
|---|---|---|
| pentasodium nitrilo-N,N,N-trimethylenephosphonate | 1.5 g | 1.5 g |
| pentasodium diethylenetriaminepentacetate | 2.0 g | 2.0 g |
| sodium sulfite | 30 g | 30 g |
| potassium hydroquinone-monosulfonate | 20 g | 20 g |
| potassium carbonate | 15 g | 20 g |
| potassium bicarbonate | 12 g | 15 g |
| 1-phenyl-4-methyl-4-hydroxymethyl-3-pyrazolidone | 1.5 g | 2.0 g |
| potassium bromide | 2.5 g | 1.4 g |
| potassium thiocyanate | 1.2 g | 1.2 g |
| potassium iodide | 2.0 mg | — |
| diethylene glycol | 13 g | 15 g |
| water | q.s. ad 1000 mL | |
| pH | 9.60 | 9.60 |

These pH's were adjusted by the use of sulfuric acid or potassium hydroxide.

| (reversal solution) | Tank soln. | Replenisher |
|---|---|---|
| pentasodium nitrilo-N,N,N-trimethylenephosphonate | 3.0 g | same as left |
| stannous chloride dihydrate | 1.0 g | " |
| p-aminophenol | 0.1 g | " |
| sodium hydroxide | 8 g | " |
| glacial acetic acid | 15 mL | " |
| water | q.s. ad 1000 mL | |
| pH | 6.00 | " |

These pH's were adjusted by the use of acetic acid or sodium hydroxide.

| (Color developer) | Tank soln. | Replenisher |
|---|---|---|
| pentasodium nitrilo-N,N,N-trimethylenephosphonate | 2.0 g | 2.0 g |
| sodium sulfite | 7.0 g | 7.0 g |
| trisodium phosphate dodecahydrate | 36 g | 36 g |
| potassium bromide | 1.0 g | — |
| potassium iodide | 90 mg | — |
| sodium hydroxide | 3.0 g | 3.0 g |
| citrazinic acid | 1.5 g | 1.5 g |
| N-ethyl-N-(β-methanesulfonamidoethyl)-3-methyl-4-aminoaniline 3/2 sulfate monohydrate | 11 g | 11 g |
| 3,6-dithiaoctane-1,8-diol | 1.0 g | 1.0 g |
| water | q.s. ad 1000 mL | |
| pH | 11.80 | 12.00 |

These pH's were adjusted by the use of sulfuric acid or potassium hydroxide.

| (Preleaching) | Tank soln. | Replenisher |
|---|---|---|
| disodium ethylenediaminetetraacetate dihydrate | 8.0 g | 8.0 g |
| sodium sulfite | 6.0 g | 8.0 g |
| 1-thioglycerol | 0.4 g | 0.4 g |
| formaldehyde/sodium bisulfite adduct | 30 g | 35 g |
| water | q.s. ad 1000 mL | |
| pH | 6.30 | 6.10 |

These pH's were adjusted by the use of acetic acid or sodium hydroxide.

| (Bleaching soln.) | Tank soln. | Replenisher |
|---|---|---|
| disodium ethylenediaminetetraacetate dihydrate | 2.0 g | 4.0 g |
| Fe(III) ammonium ethylenediaminetetraacetate dihydrate | 120 g | 240 g |
| potassium bromide | 100 g | 200 g |
| ammonium nitrate | 10 g | 20 g |
| water | q.s. ad 1000 mL | |
| pH | 5.70 | 5.50 |

These pH's were adjusted by the use of nitric acid or sodium hydroxide.

| (Fixing solution) | Tank soln. | Replenisher |
|---|---|---|
| ammonium thiosulfate | 80 g | same as left |
| sodium sulfite | 5.0 g | " |
| sodium bisulfite | 5.0 g | " |
| water | q.s. ad 1000 mL | |
| pH | 6.60 | " |

These pH's were adjusted by the use of acetic acid or aqueous ammonia.

| (Stabilizer) | Tank soln. | Replenisher |
|---|---|---|
| 1,2-benzoisothiazolin-3-one | 0.02 g | 0.03 g |
| polyoxyethylene p-monononyl-phenyl ether (av. deg. of polymn. 10) | 0.3 g | 0.3 g |
| polymaleic acid (av. mol.wt. 2,000) | 0.1 g | 0.15 g |
| water | q.s. ad 1000 mL | |
| pH | 7.0 | 7.0 |

Evaluation of Sample

Evaluation of Color Mixing

Each of samples 101 to 117 was exposed through a wedge having a continuous density change and a red filter (filter SC-62 manufactured by Fuji Photo Film Co., Ltd.) to white light with a color temperature of 4800 degrees, and the minimum density of cyan and the magenta and yellow densities at that point were measured. The level of cyan color mixing by interlayer color mixing was determined by subtracting the secondary absorptions of magenta and yellow dyes in cyan density separately taken respective absorption waveforms of coloring dye of each coupler, from the measured cyan, magenta and yellow densities, to thereby obtain the analytical density of cyan minimum density by calculation and, further, by subtracting the base density therefrom. When the value is 0, it indicates that there is no occurrence of color mixing. The greater the value, the more intense the aggravation of the color mixing. In this Example, the density is expressed by the status A density.

Evaluation of image preservability (1)

Each of samples 101 to 117 was exposed through a wedge having a continuous density change to white light with a color temperature of 5200 degrees and subjected to the above development processing. Thereafter, the density of white background portion was measured. After the measuring of the density, the samples were stored in atmosphere of 70° C. and 70% RH for one week, and the change in density at the white background portion was observed.

Evaluation of image preservability (2)

Each of samples 101 to 117 was exposed through a wedge having a continuous density change to white light with a color temperature of 5200 degrees and subjected to the above development processing. Thereafter, the density of white background portion was measured. After the measuring of the density, the emulsion side of the sample was irradiated for 2 days, and further the opposite side to the emulsion side against the support was irradiated for 2 days with xenon light (85,000 lux, 30° C., 30% RH), and the change in density at the white background portion was observed.

The results are collectively given in Table 4 below.

TABLE 4

| | Evaluation of results | | |
|---|---|---|---|
| Sample | Color-mixing Minimum density of cyan with exposure to red light (analytical density) | Coloring on white background after preservation under a high humidity condition (Increment in magenta density) | Coloring on white background after exposure to light (Increment in yellow density) |
| 101 Comp | 0.18 | 0.03 | 0.04 |
| 102 Comp | 0.22 | 0.10 | 0.04 |
| 103 Comp | 0.23 | 0.08 | 0.04 |
| 104 Comp | 0.28 | 0.17 | 0.04 |
| 105 Comp | 0.28 | 0.16 | 0.07 |
| 106 Comp | 0.20 | 0.10 | 0.14 |
| 107 Comp | 0.20 | 0.11 | 0.04 |
| 108 Comp | 0.30 | 0.17 | 0.08 |
| 109 Comp | 0.25 | 0.10 | 0.07 |
| 110 Inv | 0.15 | 0.03 | 0.04 |
| 111 Inv | 0.10 | 0 | 0.02 |
| 112 Inv | 0.13 | 0.02 | 0.04 |
| 113 Inv | 0.10 | 0 | 0.01 |
| 114 Inv | 0.10 | 0.01 | 0.02 |
| 115 Inv | 0.10 | 0 | 0.01 |
| 116 Inv | 0.10 | 0 | 0.02 |
| 117 Inv | 0.08 | 0 | 0.02 |

As summarized in Table 4, the red color mixing was aggravated and further the magenta coloring during image storage was unfavorably increased in samples 102 and 103 in which use was made of a two-equivalent comparative coupler (A) or (C) that was out side the scope of the couplers used in the present invention and in samples 106 and 107 in which only couplers of the general formula (PC-1) or (NC-1) were used in combination. In particular, the aggravation was conspicuous in samples 104, 105 and 108 in which both of the two-equivalent comparative coupler and the couplers of general formula (PC-1) or (NC-1) were simultaneously employed. In sample 106 in which use was made of coupler of the general formula (NC-1), the yellow coloring of white background was increased by light irradiation. The red color mixing was not satisfactorily improved only by changing the magenta coupler to a four-equivalent coupler used in the present invention as seen from sample 109.

By contrast, in samples 110 to 117 in which the magenta and cyan couplers were used in combination according to the present invention, the red color mixing was trivial and also the magenta coloring of white background was satisfactorily slight. These were surprising results in contrast to samples 104 and 105 in which use was made of two-equivalent magenta couplers. Moreover, although containing the same cyan coupler as in samples 105 and 106, sample 114 realized a marked improvement in the increase of yellow coloring by light irradiation.

Among the samples 110 to 113 according to the present invention, samples 111 and 113 in which the magenta coupler was one represented by the general formula (MC-2) according to the present invention exhibited especially desirable results in that there was substantially no increase of yellow coloring. As in sample 116, the effect of the present invention was retained even when the coupler within the scope of the present invention was used in combination with the pyrazolone magenta coupler.

Example 2

Another set of samples 101 to 117 were exposed in the same manner as in Example 1, evaluation of image preservability, and subjected to the processing CN-16 recommended by Fuji Photo Film Co., Ltd. The resultant samples were evaluated with respect to image preservability in the same manner as in Example 1. The combination of the present invention gave desirable results as in Example 1.

Example 3

A back layer was applied onto one side of a support of 205 μm-thick undercoated cellulose triacetate film. Thereafter, the following emulsion layers were applied onto the opposite side of the support to thereby prepare sample 301. The formulation of the applied back layer was the same as in Example 1 of JP-A-10-232470.

| | |
|---|---|
| 1st layer (antihalation layer) | |
| Exactly the same as in the 1st layer of Example 1. | |
| 2nd layer (interlayer) | |
| Exactly the same as in the 2nd layer of Example 1. | |
| 3rd layer (interlayer) | |
| gelatin | 0.50 g |
| 4th layer (low-speed red-sensitive emulsion layer) | |
| emulsion A | Ag qty. 0.15 g |
| emulsion B | Ag qty. 0.50 g |
| gelatin | 0.90 g |
| coupler C-1 | 0.30 g |
| coupler C-6 | 0.03 g |
| compound Cpd-C | 5.0 mg |
| high b.p. org. solvent Oil-2 | 0.08 g |
| additive P-1 | 0.10 g |
| 5th layer (medium-speed red-sensitive emulsion layer) | |
| emulsion B | Ag qty. 0.20 g |
| emulsion C | Ag qty. 0.20 g |
| gelatin | 0.80 g |
| coupler C-1 | 0.25 g |
| high b.p. org. solvent Oil-2 | 0.10 g |
| additive P-1 | 0.10 g |
| 6th layer (high-speed red-sensitive emulsion layer) | |
| emulsion D | Ag qty. 0.20 g |
| emulsion C | Ag qty. 0.25 g |
| gelatin | 1.50 g |
| coupler C-1 | 1.00 g |
| high b.p. org. solvent Oil-2 | 0.45 g |
| additive P-1 | 0.10 g |

-continued

| | |
|---|---|
| 7th layer (interlayer) | |
| Exactly the same as in the 7th layer of Example 1. | |
| 8th layer (interlayer) | |
| gelatin | 0.90 g |
| additive P-1 | 0.05 g |
| Cpd-J | 0.10 g |
| color mixing inhibitor Cpd-C | 0.10 g |
| high b.p. org. solvent Oil-3 | 0.10 g |
| 9th layer (low-speed green-sensitive emulsion layer) | |
| emulsion F | Ag qty. 0.15 g |
| emulsion G | Ag qty. 0.35 g |
| gelatin | 1.10 g |
| coupler C-5 | 0.25 g |
| compound Cpd-B | 0.030 g |
| compound Cpd-D | 0.020 g |
| compound Cpd-E | o .020 g |
| compound Cpd-F | 0.040 g |
| compound Cpd-K | 0.02 g |
| high b.p. org. solvent Oil-1 | 0.02 g |
| high b.p. org. solvent Oil-2 | 0.10 g |
| 10th layer (medium-speed green-sensitive emulsion layer) | |
| emulsion G | Ag qty. 0.35 g |
| emulsion H | Ag qty. 0.15 g |
| gelatin | 0.70 g |
| coupler C-2 | 0.30 g |
| compound Cpd-B | 0.030 g |
| compound Cpd-D | 0.020 g |
| Cpd-E | 0.020 g |
| compound Cpd-F | 0.050 g |
| high b.p. org. solvent Oil-2 | 0.010 g |
| 11th layer (high-speed green-sensitive emulsion layer) | |
| emulsion H | Ag qty. 0.30 g |
| emulsion I | Ag qty. 0.10 g |
| gelatin | 1.00 g |
| coupler C-2 | 0.65 g |
| compound Cpd-B | 0.080 g |
| compound Cpd-E | 0.020 g |
| compound Cpd-F | 0.040 g |
| high b.p. org. solvent Oil-1 | 0.020 g |
| high b.p. org. solvent Oil-2 | 0.020 g |
| 12th layer (interlayer) | |
| Exactly the same as in the l2th layer of Example 1. | |
| 13th layer (yellow filter layer) | |
| Exactly the same as in the 13th layer of Example 1. | |
| 14th layer (interlayer) | |
| gelatin | 0.40 g |
| 15th layer (low-speed blue-sensitive emulsion layer) | |
| emulsion K | Ag qty. 0.45 g |
| gelatin | 0.80 g |
| coupler C-3 | 0.25 g |
| coupler C-4 | 0.05 g |
| coupler C-7 | 0.35 g |
| compound Cpd-I | 0.02 g |
| 16th layer (medium-speed blue-sensitive emulsion layer) | |
| emulsion L | Ag qty. 0.25 g |
| emulsion M | Ag qty. 0.25 g |
| gelatin | 0.90 g |
| coupler C-3 | 0.20 g |
| coupler C-4 | 0.05 g |
| coupler C-7 | 0.45 g |
| 17th layer (high-speed blue-sensitive emulsion layer) | |
| emulsion N | Ag qty. 0.20 g |
| emulsion M | Ag qty. 0.25 g |
| gelatin | 1.30 g |

-continued

| | |
|---|---|
| coupler C-3 | 0.10 g |
| coupler C-4 | 0.15 g |
| coupler C-7 | 0.75 g |
| high b.p. org. solvent Oil-2 | 0.10 g |
| 18th layer (1st protective layer) | |
| Exactly the same as in the 18th layer of Example 1. | |
| 19th layer (2nd protective layer) | |
| yellow colloidal silver | Ag qty. 0.10 mg |
| fine granular silver iodobromide emulsion (av. grain size 0.06 μm, AgI cont. 1 mol %) | Ag qty. 0.11 g |
| gelatin | 0.80 g |
| polymethyl methacrylate (av. grain size 2.0 μm) | 0.10 g |
| methyl methacrylate/methacrylic acid 6:4 copolymer (av. grain size 1.5 μm) | 0.10 g |
| silicone oil SO-1 | 0.060 g |
| surfactant W-1 | 3.0 mg |
| surfactant W-2 | 0.030 g |

As in Example 1, all the above emulsion layers were doped with additives F-1 to F-6 in addition to the above components, and, further, the layers were doped with gelatin hardener H-1 and surfactants for emulsification and coating W-3, W-4, W-5 and W-6 in addition to the above components.

Moreover, phenol, 1,2-benzisothiazolin-3-one, 2-phenoxyethanol, phenethyl alcohol and butyl p-hydroxybenzoate were added as antiseptic and mildew-proofing agents.

Samples 301 to 316 were exposed through a wedge having a continuous density change to white light with a color temperature of 4800 degrees and subjected to the above reversal development processing. All the resultant samples exhibited yellow, magenta and cyan maximum densities ranging from 3.20 to 3.80, minimum densities of less than 0.20 and an average gamma between densities of 0.2 and 3.0 ranging from 1.70 to 2.30.

Samples 302 to 317 were prepared by changing the coupler as in Table 4 of Example 1.

Each of samples 301 to 317 was sized into 8 inches by 10 inches. MTF and ICF were prepared therefrom with the use of film writer Light Jet 2080 manufactured by Symbolic Science, in accordance with the standard process recommended by Fire Ware Ver 2.3. Thereafter, image data obtained by photographing Color Checker manufactured by Macbeth with the use of Fujichrome "Velvia" and incorporating the photograph with the use of a scanner and image data designed so that pure colors of red, green, blue, yellow, magenta and cyan were produced with the R, G and B signal values regarded as maximum values were outputted to thereby evaluate the color reproducibility. Celsis 6200 manufactured by Crossfield was used as the scanner.

The combination of the present invention realized desirable results such that the red color mixing was slight and such that the saturations of green, blue, cyan and magenta were high. Specifically, although in sample 301 the saturations of yellow, green and magenta were slightly unsatisfactory as compared with the original photographed by the use of Fujichrome "Velvia", the original saturations were reproduced in samples 310 to 317 of the present invention.

In the same manner, similar images were outputted by the use of Solitaire Gemini manufactured by Management Graphic. The combination of the present invention realized desirable results including high saturation. The outputted images were subjected to printing on Fujichrome Paper Type 35 and development processing. The prints obtained from the samples of the present invention exhibited high saturation and were favorable.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photographic lightsensitive material comprising a support and, superimposed thereon, a yellow color-forming blue-sensitive emulsion layer comprising at least one lightsensitive emulsion sub-layer, a magenta color-forming green-sensitive emulsion layer comprising at least one lightsensitive emulsion sub-layer and a cyan color-forming red-sensitive emulsion layer comprising at least one lightsensitive emulsion sub-layer, wherein said at least one sub-layer in said green-sensitive emulsion layer contains at least one magenta coupler represented by a general formula (MC-1):

(MC-1)

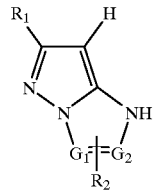

wherein $R_1$ represents a hydrogen atom or a substituent; and each of $G_1$ and $G_2$ represents a nitrogen atom or a carbon atom, provided that $G_2$ is a carbon atom when $G_1$ is a nitrogen atom, $G_1$ is a carbon atom when $G_2$ is a nitrogen atom; and $R_2$ binds to $G_1$ or $G_2$ that is a carbon atom, wherein $R_2$ represents a substituent;

and said at least one sub-layer in said red-sensitive emulsion layer contains at least one cyan coupler represented by a general formula (PC-1):

(PC-1)

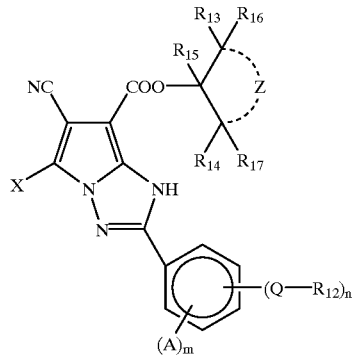

wherein X represents a hydrogen atom or a group capable of dissociating by a coupling reaction with an aromatic primary amine color developing agent; A represents a substituent; m is an integer of 0 to 4; Q represents a divalent group selected from —O—, —COO—, —$SO_2$—, —OC(O)—, —$NR_{18}$CO—, —CO$NR_{18}$—, —$NR_{18}SO_2$—, —$SO_2NR_{18}$—, —$NR_{18}COO$— and —$NR_{18}CONR_{19}$—, wherein each of $R_{18}$ and $R_{19}$ independently represents a hydrogen atom or an alkyl group; $R_{12}$ represents a substituent having a moiety of an aryl group or alkyl group each having at least 6 total carbon atoms; n is 1 or 2, provided that, when n is 1, $R_{12}$ has at least one dissociating group and that, when n is 2, two —Q—$R_{12}$ groups may be the same or different from each other and may contain a dissociating group; each of $R_{13}$ and $R_{14}$ independently represents an alkyl group; each of $R_{15}$, $R_{16}$ and $R_{17}$ independently represents a hydrogen atom or an alkyl group; and Z represents a group of nonmetallic atoms forming a 5 to 8-membered carbocyclic or heterocyclic ring, with which a saturated or unsaturated carbocyclic or heterocyclic rings may be condensed.

2. The silver halide material according to claim 1, wherein said magenta coupler represented by the formula (MC-1) is represented by a general formula (MC-2):

(MC-2)

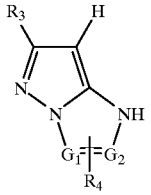

wherein $G_1$ and $G_2$ each has the same meaning as defined in the formula (MC-1), at least either of $R_3$ and $R_4$ represents a substituted or unsubstituted tertiary alkyl group, provided that the sum the total of carbon atoms contained in $R_3$ and the total carbon atoms contained in $R_4$ is 10 or more.

3. The silver halide material according to claim 2, wherein either one of $R_3$ and $R_4$ of the formula (MC-2) represents a substituted or unsubstituted tertiary alkyl group and the other one of the $R_3$ and $R_4$ is represented by a formula (BL-1):

(BL-1)

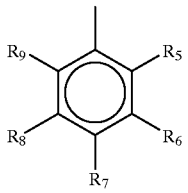

wherein each of $R_5$, $R_6$, $R_7$, $R_8$ and $R_9$ independently represents a hydrogen atom or a substituent, provided that at least two of $R_5$, $R_6$, $R_8$ and $R_9$ each independently represent a substituent having a moiety of a substituted or unsubstituted alkyl group each having 4 to 70 total carbon atoms or a substituent having a moiety of a substituted or unsubstituted aryl group each having 6 to 70 total carbon atoms.

4. The silver halide material according to claim 2, wherein either one of $R_3$ and $R_4$ of the formula (MC-2) represents a substituted or unsubstituted tertiary alkyl group and the other one of the $R_3$ and $R_4$ is represented by a formula (BL-2):

(BL-2)

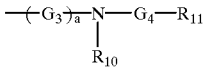

wherein $G_3$ represents a substituted or unsubstituted methylene group; a is an integer of 1 to 3; $R_{10}$ represents a hydrogen atom, an alkyl group or an aryl group; $G_4$ represents —CO— or —$SO_2$—; and $R_{11}$ represents a substituent having a moiety of a substituted or unsubstituted alkyl or aryl group each having 6 to 100 total carbon atoms.

5. The silver halide material according to claim 2, wherein said cyan coupler represented by the formula (PC-1) is represented by a general formula (PC-2):

(PC-2)

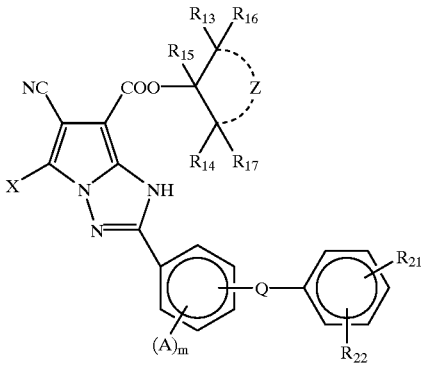

wherein each of $R_{13}$, $R_{15}$, $R_{16}$, Z, X, A, m and Q each has the same meaning as defined in the formula (PC-1), $R_{21}$ represents a substituent containing a dissociating group which exhibits a pKa value of 13 or less, $R_{22}$ represents a substituent.

6. The silver halide material according to claim 2, wherein said cyan coupler represented by the formula (PC-1) is represented by a general formula (PC-3):

(PC-3)

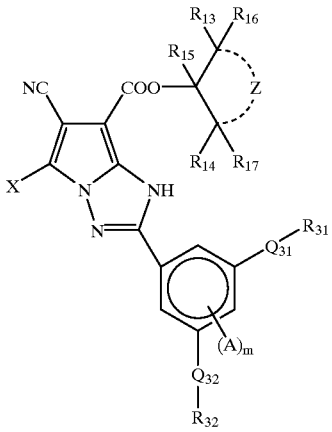

wherein $R_{13}$, $R_{14}$, $R_{15}$, $R_{16}$, Z, X, A and m has the same meaning as defined in the formula (PC-1), $Q_{31}$ and $Q_{32}$ each independently has the same meaning as defined for Q in the formula (PC-1), and $R_{31}$ and $R_{32}$ each independently represents a substituted or unsubstituted alkyl group having 4 to 50 total carbon atoms or a substituted or unsubstituted aryl group having at least 6 total carbon atoms.

7. The silver halide material according to claim 1, wherein in formula MC-1, the substituent is selected from the group consisting of a halogen atom, an alkyl group, an aryl group, a heterocyclic group, a cyano group, a hydroxyl group, a nitro group, a carboxyl group, an amino group, an alkyoxy group, an aryloxy group, an acylamino group, an aikylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an acyloxy group, a carbamoyloxy group, a silyloxy group, an aryloxycarbonylamino group, an imido group, a heterocyclic thio group, a sulfinyl group, a phosphonyl group, an aryloxycarbonyl group and an acyl group.

8. The silver halide material according to claim 2, wherein said tertiary alkyl group is selected from the group consisting of t-butyl, t-amyl, t-hexyl, t-octyl, 1,1-dimethyldecyl, adamantyl and 1-methylcyclohexyl.

* * * * *